US010549962B2

(12) United States Patent
Nakashima et al.

(10) Patent No.: US 10,549,962 B2
(45) Date of Patent: Feb. 4, 2020

(54) UPPER BODY OF MOBILE CRANE

(71) Applicants: Kobe Steel, Ltd., Kobe-shi (JP); KOBELCO CONSTRUCTION MACHINERY CO., LTD., Hiroshima-shi (JP)

(72) Inventors: Yasuhiro Nakashima, Kobe (JP); Shinji Sato, Kobe (JP); Tomokazu Nakagawa, Shinagawa-ku (JP); Yasuto Kataoka, Kobe (JP); Takanobu Yamagami, Hyogo (JP)

(73) Assignees: Kobe Steel, Ltd., Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 506 days.

(21) Appl. No.: 15/310,019

(22) PCT Filed: May 14, 2015

(86) PCT No.: PCT/JP2015/063907
§ 371 (c)(1),
(2) Date: Nov. 9, 2016

(87) PCT Pub. No.: WO2015/174495
PCT Pub. Date: Nov. 19, 2015

(65) Prior Publication Data

US 2017/0267502 A1 Sep. 21, 2017

(30) Foreign Application Priority Data

May 16, 2014 (JP) ..... 2014-102010
Jun. 3, 2014 (JP) ..... 2014-114993
Jun. 3, 2014 (JP) ..... 2014-114998

(51) Int. Cl.
*B66C 23/84* (2006.01)
*E02F 9/12* (2006.01)

(52) U.S. Cl.
CPC ..... *B66C 23/84* (2013.01); *E02F 9/121* (2013.01)

(58) Field of Classification Search
CPC .. B66C 23/62; B66C 23/84; E02F 9/12; E02F 9/121; F16C 33/60
See application file for complete search history.

(56) References Cited

U.S. PATENT DOCUMENTS 3,061,389 A * 10/1962 Bargmann ..... F16C 33/60 384/592
3,937,540 A * 2/1976 Morizur ..... E02F 9/121 384/593

(Continued)

FOREIGN PATENT DOCUMENTS

CN 201850085 U 6/2011
CN 202245853 U 5/2012

(Continued)

OTHER PUBLICATIONS

International Search Report dated Aug. 4, 2015, in PCT/JP2015/063907 filed May 14, 2015.

*Primary Examiner* — Michael R Mansen
*Assistant Examiner* — Nathaniel L Adams
(74) *Attorney, Agent, or Firm* — Oblon, McClelland, Maier & Neustadt, L.L.P.

(57) ABSTRACT

An upper body includes a bearing seat surface that is fixed by a bearing bolt to the upper surface of a swing bearing, a swing frame that includes an intersecting side plate intersecting the bearing seat surface and is fixed to the bearing seat surface, and a force dispersing member. The force dispersing member includes at least one vertical plate extending in the up-down direction. The at least one vertical (Continued)

plate is fixed to a region of the bearing seat surface other than a force dispersion target region.

21 Claims, 62 Drawing Sheets

(56) References Cited

U.S. PATENT DOCUMENTS

| | | | | | |
|---|---|---|---|---|---|
| 3,985,406 | A | * | 10/1976 | Baron | B66C 23/84 384/618 |
| 4,161,344 | A | * | 7/1979 | Delarbre | B66C 23/84 384/593 |
| 4,239,305 | A | * | 12/1980 | Baron | E02F 9/121 384/593 |
| 4,391,477 | A | * | 7/1983 | Morrow, Sr. | B66C 23/84 384/592 |
| 4,582,436 | A | * | 4/1986 | Merron | E02F 9/121 384/593 |
| 4,622,860 | A | * | 11/1986 | Cametti | E02F 9/121 212/175 |

FOREIGN PATENT DOCUMENTS

| | | | |
|---|---|---|---|
| CN | 102485633 | A | 6/2012 |
| CN | 103420287 | A | 12/2013 |
| JP | 56-124690 | U | 9/1981 |
| JP | 10-250987 | A | 9/1998 |
| JP | 2002-129590 | A | 5/2002 |
| JP | 2008-110833 | A | 5/2008 |
| JP | 2010-189188 | A | 9/2010 |
| JP | 2010-254414 | A | 11/2010 |
| JP | 2010-275100 | A | 12/2010 |
| JP | 2015-231914 | A | 12/2015 |

* cited by examiner (PRIOR ART)

(PRIOR ART)

(PRIOR ART)

UPPER BODY OF MOBILE CRANE

TECHNICAL FIELD

The present invention relates to an upper body of a mobile crane.

BACKGROUND ART

Patent Literature 1 describes a conventional mobile crane. In the abstract of the same literature, there is the following description. "The upper swing body is mounted on a lower travelling body through a swing bearing so as to be slewable around a swing center axis. The upper swing body . . . the swing frame (7) having right and left side plates (6R, 6L) . . . " A parenthesis has been added for reference signs in the description of Patent Literature 1.

In a conventional mobile crane, the axial force on a bearing bolt (bearing-bolt axial force) is locally large. The details of this problem are as follows. FIG. 17 schematically shows the flow of the force that acts on an upper body 1630 or the like of a conventional mobile crane 1001. Upon operation or upon assembly of the mobile crane 1001, a lifting load f1 caused by a suspended load L and a weight 1'2 of a boom 1021 cause a compressive force f3 to act on a portion of a swing frame 1040 on a front side X1 and generates a tension f5 in a raising-lowering rope 1024. The tension f5 causes a force f6 in the direction of an upper side Z1 (vertically upward) and the direction of the front side X1 to act on an end part (lower spreader 1025) of the swing frame 1040 on a rear side X2. As a result, a compressive load f21 acts on a portion of a swing bearing 1005 on the front side X1, and a tensile load f22 acts on a portion of the swing bearing 1005 on the rear side X2. The tensile load f22 is carried by a bearing bolt 1006 shown in FIG. 18. In FIG. 18, only a part of a plurality of the bearing bolts 1006 is denoted by a reference sign. The bearing bolt 1006 is a bolt that fastens the swing bearing 1005 and a bearing seat surface 1050 shown in FIG. 17. As shown in FIG. 18, the position in which a side plate 1042 of the swing frame 1040 and the bearing seat surface 1050 intersect when seen from an up-down direction Z is a side-plate intersecting position 1042*a*. FIG. 19 shows the relationship of the axial force (bearing-bolt axial force) of the bearing bolt 1006 and an angle θ. As shown in the same figure, the bearing-bolt axial force is locally large in the side-plate intersecting position 1042*a* (see FIG. 18) and the vicinity thereof (where θ≅±45° in an example shown in FIG. 19). As in the example, with a conventional mobile crane, the bearing-bolt axial force is locally large in the position in which the side plate of the swing frame and the bearing seat surface intersect and the vicinity thereof when seen from the up-down direction.

There are cases where the axial force on the bearing bolt determines the strength of the bearing bolt, and there are cases where the strength of the bearing bolt determines (governs) the lifting capacity and strength of the mobile crane. In such cases, it is necessary to reduce the maximum value of the axial force on the bearing bolt, in order to improve the lifting capacity and strength of the mobile crane.

Generally, by increasing the plate thickness of the bearing seat surface, the stiffness of the bearing seat surface is enhanced, the load distribution of the bearing seat surface is dispersed (localization is suppressed), and the maximum value of the axial force on the bearing bolt is reduced.

However, increasing the plate thickness of the bearing seat surface causes a problem of an increase in weight of the mobile crane.

CITATION LIST

Patent Literature

Patent Literature 1: Japanese Unexamined Patent Publication No. 2008-110833

SUMMARY OF INVENTION

An object of the present invention is to provide an upper body of a mobile crane that can reduce the maximum value of the bearing-bolt axial force, without the necessity to increase the plate thickness of a bearing seat surface.

An upper body of a mobile crane according to one aspect of the present invention is an upper body of a mobile crane that is fixed to a swing bearing by a bearing bolt and attached to a lower travelling body via the swing bearing. The upper body of a mobile crane includes a bearing seat surface that is fixed to an upper surface of the swing bearing by the bearing bolt, a swing frame that includes an intersecting side plate intersecting the bearing seat surface when seen from an up-down direction and is fixed to the bearing seat surface, and a force dispersing member that is arranged between the intersecting side plate of the swing frame and the bearing seat surface and configured to allow a force transmitted to the bearing seat surface from the intersecting side plate to be dispersed into a plurality of routes, the bearing seat surface including a force dispersion target region, the force dispersion target region including a side-plate intersecting position, in which the bearing seat surface and the intersecting side plate intersect when seen from an up-down direction, and a position located in a vicinity of the side-plate intersecting position, further toward a rear side than a center of revolution of the swing bearing, and in a middle part of the bearing seat surface between two end parts of the bearing seat surface in a bearing radial direction which is a radial direction of the swing bearing, the force dispersing member including at least one vertical plate extending in an up-down direction, and the at least one vertical plate being fixed to a region of the bearing seat surface other than the force dispersion target region.

DESCRIPTION OF EMBODIMENTS

First Embodiment

Figure 1:
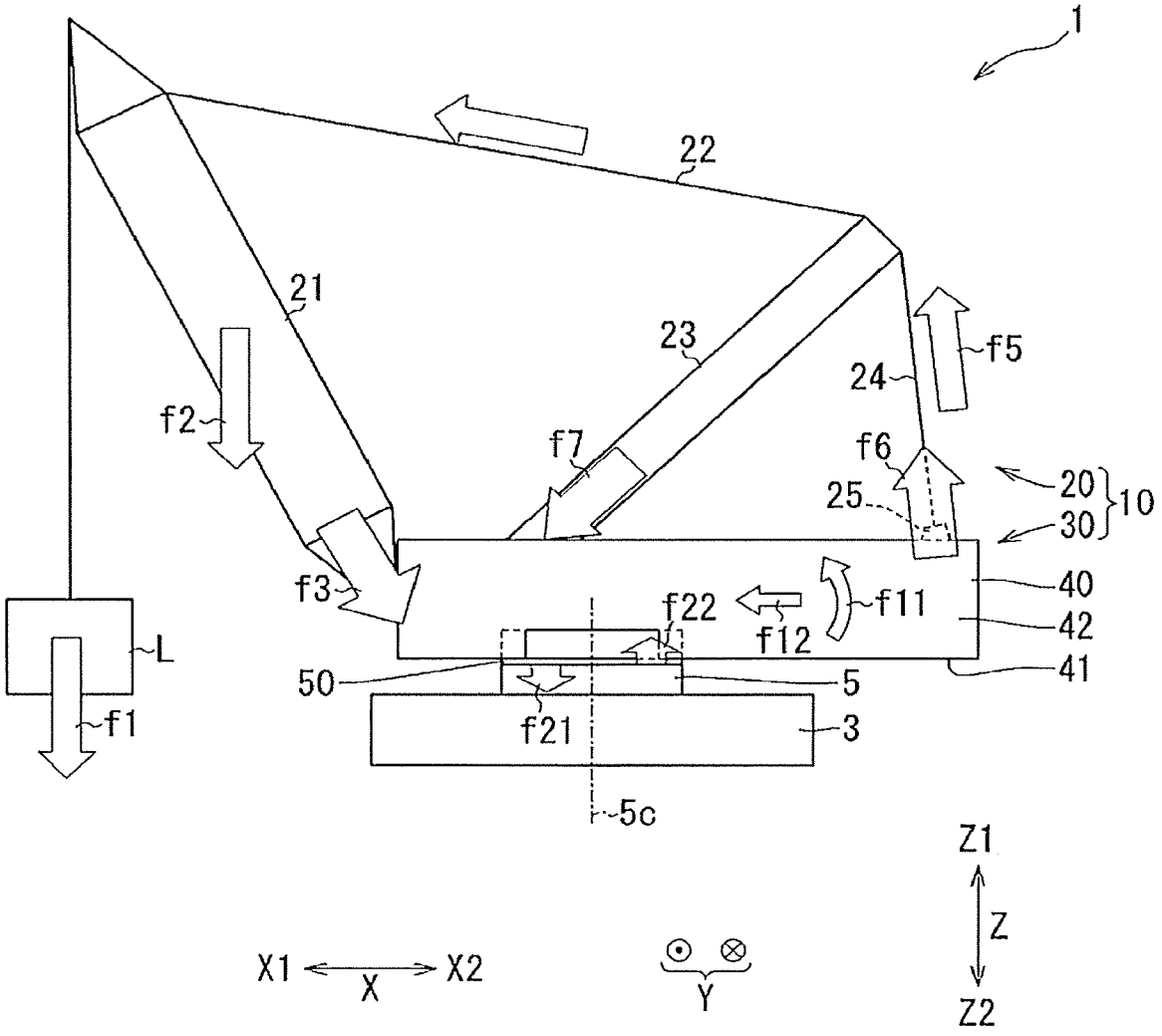
FIG. 1 is a schematic view of a mobile crane 1, seen from a machine-width direction Y.

Referring to FIG. 1 to FIG. 6, the upper body 30 of the mobile crane 1 of a first embodiment shown in FIG. 1 will be described.

The mobile crane 1 is a machine that performs work of lifting a suspended load L or the like with a boom 21 (described later). The mobile crane 1 includes a lower travelling body 3, a swing bearing 5, and an upper swing body 10. The lower travelling body 3 is a portion with which the mobile crane 1 is caused to travel. The lower travelling body 3 is a crawler-type, for example, or may be a wheel-type. The up-down direction (vertical direction) is the up-down direction Z. The upper side is the upper side Z1 and the lower side is a lower side Z2.

Figure 2:
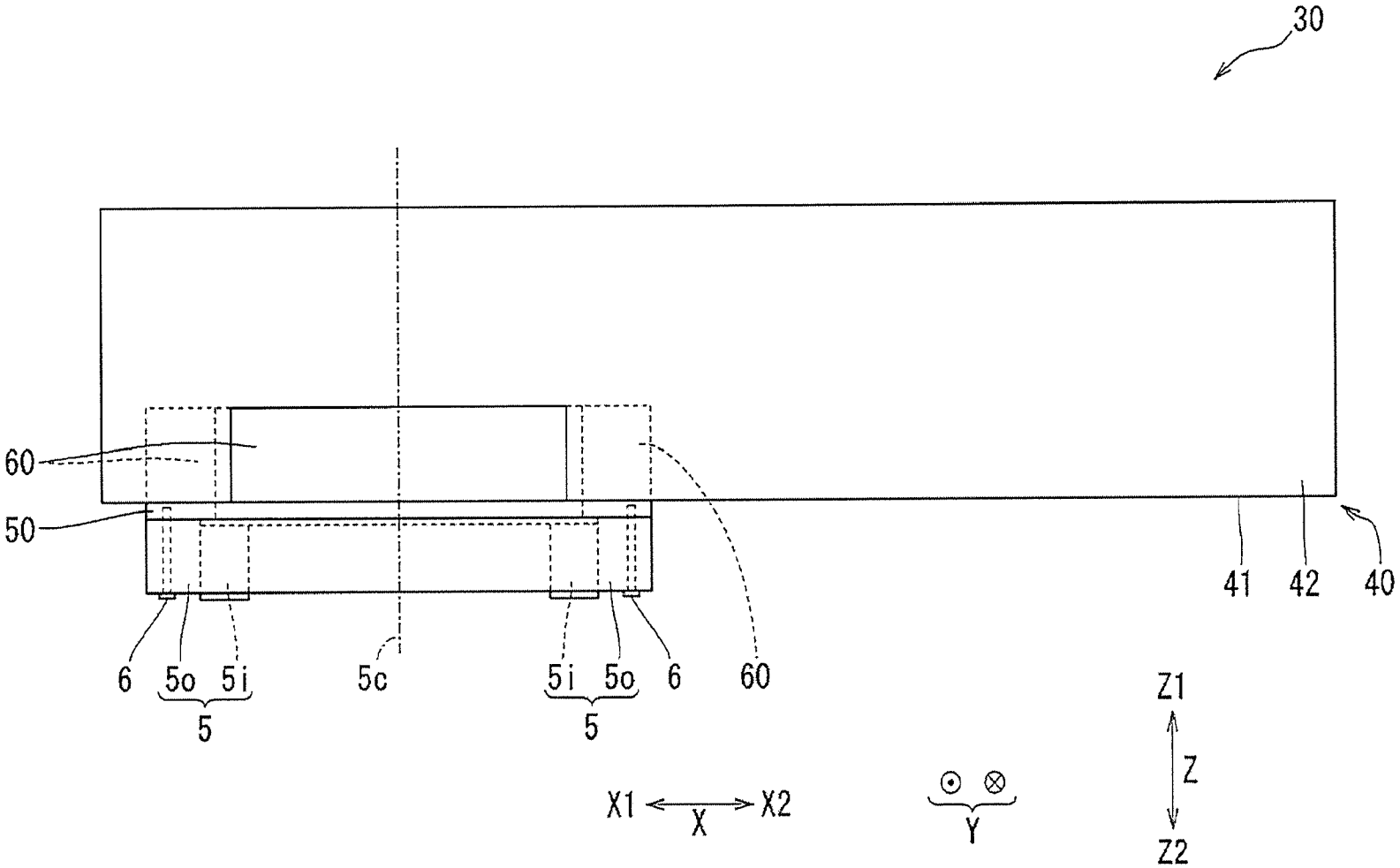
FIG. 2 is a schematic view of an upper body 30 shown in FIG. 1, seen from the machine-width direction Y.

The swing bearing 5 supports the upper swing body 10 to be slewable with respect to the lower travelling body 3. The swing bearing 5 is arranged between the lower travelling body 3 and the upper swing body 10 (the upper body 30 described later). The swing bearing 5 is annular. The radial direction of the swing bearing 5 (radial direction of a bearing seat surface 50 described later) is a "bearing radial direction." The circumferential direction of the swing bearing 5 (circumferential direction of the bearing seat surface 50 described later) is a "bearing circumferential direction." As shown in FIG. 2, the swing bearing 5 includes an inner race 5*i* (inner ring) and an outer race 5*o* (outer ring). The inner race 5*i* is fixed to the upper part (portion on the upper side Z1) of the lower travelling body 3. The outer race 5*o* is arranged on the outside of the inner race 5*i* in the bearing radial direction. The outer race 5*o* is fastened (fixed) to the bearing seat surface 50 (described later) by a plurality of bearing bolts 6. The outer race 5*o* is revolvable with respect to the inner race 5*i*. The central axis of revolution of the outer race 5*o* with respect to the inner race 5*i* (central axis of revolution of the upper swing body 10 with respect to the lower travelling body 3 shown in FIG. 1) is a center of revolution 5*c*.

Figure 3:
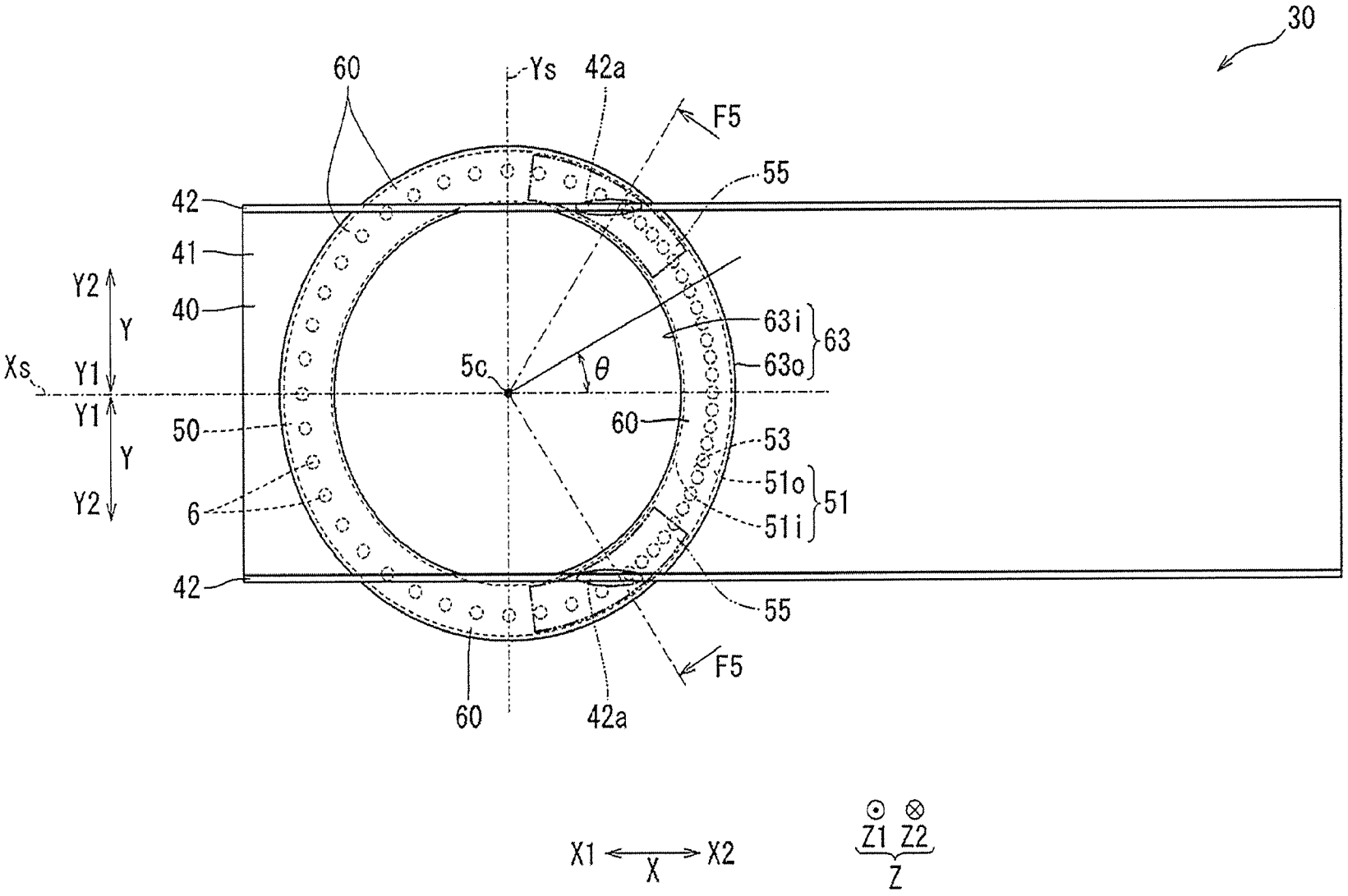
FIG. 3 is a schematic view of the upper body 30 shown in FIG. 1, seen from the upper side Z1.

Each bearing bolt 6 is a member that fastens the outer race 5*o* and the bearing seat surface 50 (described later), as shown in FIG. 2. The axial direction of each bearing bolt 6 is the up-down direction Z. Each bearing bolt 6 is passed through the outer race 5*o* from the lower side Z2 of the outer race 5*o* and fastened to the bearing seat surface 50. In the position in which a force dispersing member 60 (described later) is not arranged on the upper side Z1 of the bearing seat surface 50 (described later), the bearing bolt 6 may be passed through the bearing seat surface 50 from the upper side Z1 of the bearing seat surface 50 and fastened (not shown) to the outer race 5*o*. As shown in FIG. 3, the plurality of bearing bolts 6 are provided to be aligned at intervals along the bearing circumferential direction. Of the plurality of bearing bolts 6 in FIG. 3, the bearing bolts 6 are only partially denoted by a reference sign (and the same applies in other figures).

As shown in FIG. 1, the upper swing body 10 is arranged (mounted) on the upper side Z1 of the lower travelling body 3 and slewable with respect to the lower travelling body 3. The upper swing body 10 includes a raising-lowering member 20 and the upper body 30.

The directions relating to the upper swing body 10 (directions relating to the upper body 30) are defined as follows. The front-back direction (longitudinal direction) of the upper body 30 is a machine front-back direction X. In the machine front-back direction X, the side toward the base end part of the boom 21 (described later) from a lower spreader 25 (described later) is the front side X1. In the machine front-back direction X, the opposite side of the front side X1 is the rear side X2. As shown in FIG. 3, a straight line extending in the machine front-back direction X that is a straight line passing through the center of revolution 5*c* is a straight line Xs. A direction orthogonal to the machine front-back direction X that is a horizontal direction is the machine-width direction (left-right direction) Y. To the machine-width direction Y, there are a width-direction inside Y1 (inside in the machine-width direction) and a width-direction outside Y2 (outside in the machine-width direction). The width-direction inside Y1 is the side toward the straight line Xs in the machine-width direction Y. The width-direction outside Y2 is the side away from the straight line Xs in the machine-width direction Y. A straight line extending in the machine-width direction Y that is a straight line passing through the center of revolution 5*c* is a straight line Ys. When the lower side Z2 is seen from the upper side Z1, the angle with respect to a half-line extending from the center of revolution 5*c* to the rear side X2 is the angle θ.

As shown in FIG. 1, the raising-lowering member 20 is configured of the boom 21 and members for raising and lowering the boom 21. The raising-lowering member 20 is attached to the upper body 30. The raising-lowering member 20 includes the boom 21, a guyline 22, a mast 23, a raising-lowering rope 24, and the lower spreader 25. The boom 21 lifts the suspended load L via a lifting rope. The base end part (boom foot) of the boom 21 is attached to the end part of the upper body 30 on the front side X1. The guyline 22 is connected to the boom 21 and the mast 23. The mast 23 is arranged on the rear side X2 of the boom 21 to raise and lower the boom 21 via the guyline 22. The raising-lowering rope 24 is wound around the tip end part (an upper spreader, not shown) of the mast 23 and the lower spreader 25. The mast 23 is raised and lowered by the raising-lowering rope 24 being pulled in or let out by a winch (not shown). Accordingly, the boom 21 is raised and lowered. The lower spreader 25 is arranged at the upper surface (surface on the upper side Z1) of the end part of the upper body 30 on the rear side X2.

The upper body 30 (upper body structure) is attached to the lower travelling body 3 via the swing bearing 5. As shown in FIG. 2, the swing bearing 5 (outer race 5*o*) is fixed, via the bearing seat surface 50 (described later), to a portion of the upper body 30 on the front side X1 (portion at a position further toward the front side X1 than the middle in the machine front-back direction X). As shown in FIG. 3 and FIG. 2, the upper body 30 includes a swing frame 40, the bearing seat surface 50, and the force dispersing member 60.

The swing frame 40 (upper frame) is a structure to which the raising-lowering member 20 (see FIG. 1) and the like are attached. As shown in FIG. 2, the swing frame 40 includes a bottom part 41 and a pair of the side plates 42. The bottom part 41 is a portion of the swing frame 40 on the lower side Z2. The bottom part 41 is, for example, plate-shaped (a bottom plate or machine-body bottom plate). The bottom part 41 is a plate orthogonal to the up-down direction Z (including approximately the up-down direction Z). The bottom part 41 may include a hole or a bar-shaped member (not shown). As shown in FIG. 3, the pair of side plates 42 (machine-body side plates) are plates arranged in portions (two outer sides on the left and right) of the swing frame 40 on the width-direction outside Y2. Each side plate 42 extends to the upper side Z1 from a portion of the bottom part 41 on the width-direction outside Y2. Each side plate 42 is a plate orthogonal to the machine-width direction Y (including approximately the machine-width direction Y). Each side plate 42 intersects the bearing seat surface 50 in the up-down direction Z. That is, each side plate 42 forms an "intersecting side plate." Hereinafter, it will be referred to simply as side plate 42.

Figure 4:
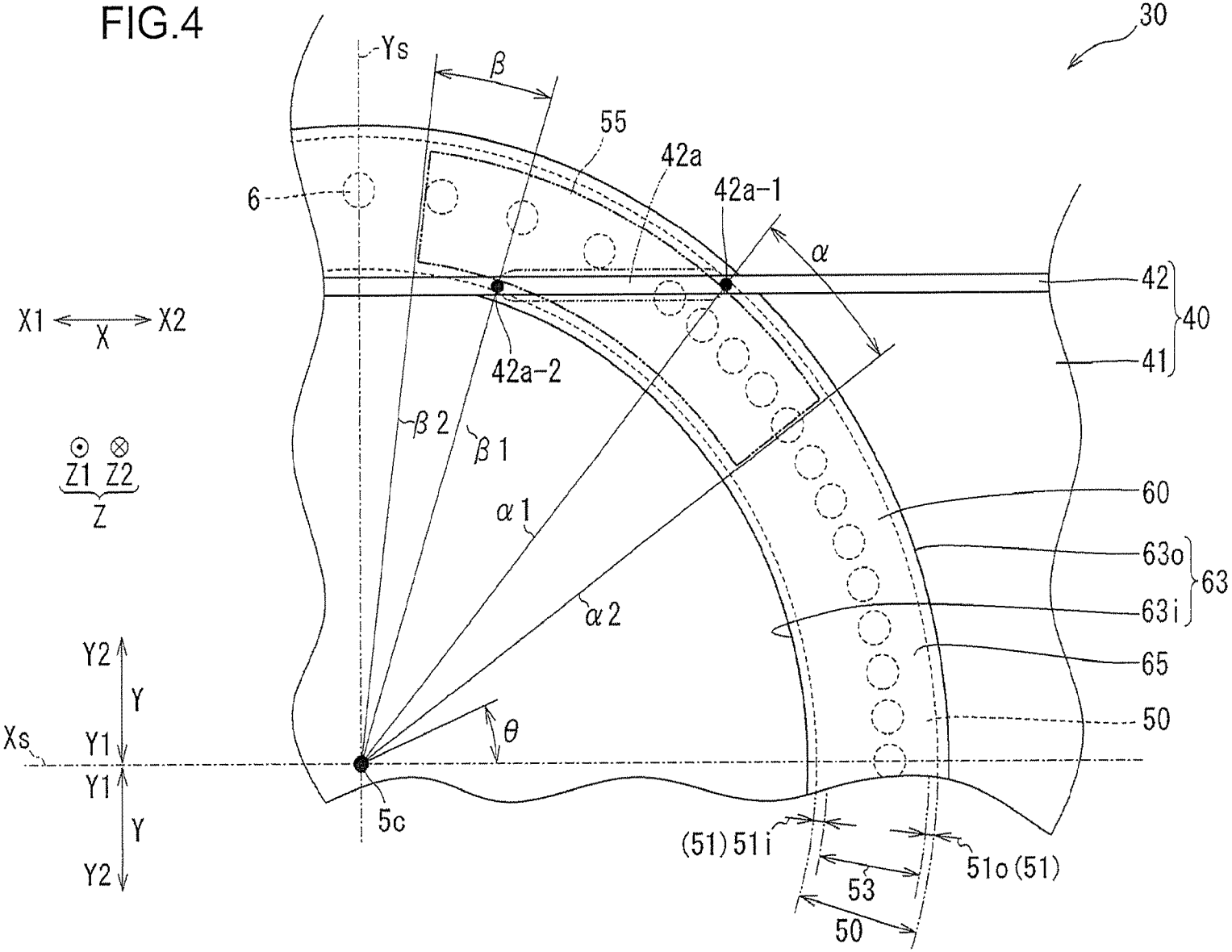
FIG. 4 is an enlarged view of a part of the upper body 30 shown in FIG. 3.
Figure 5:
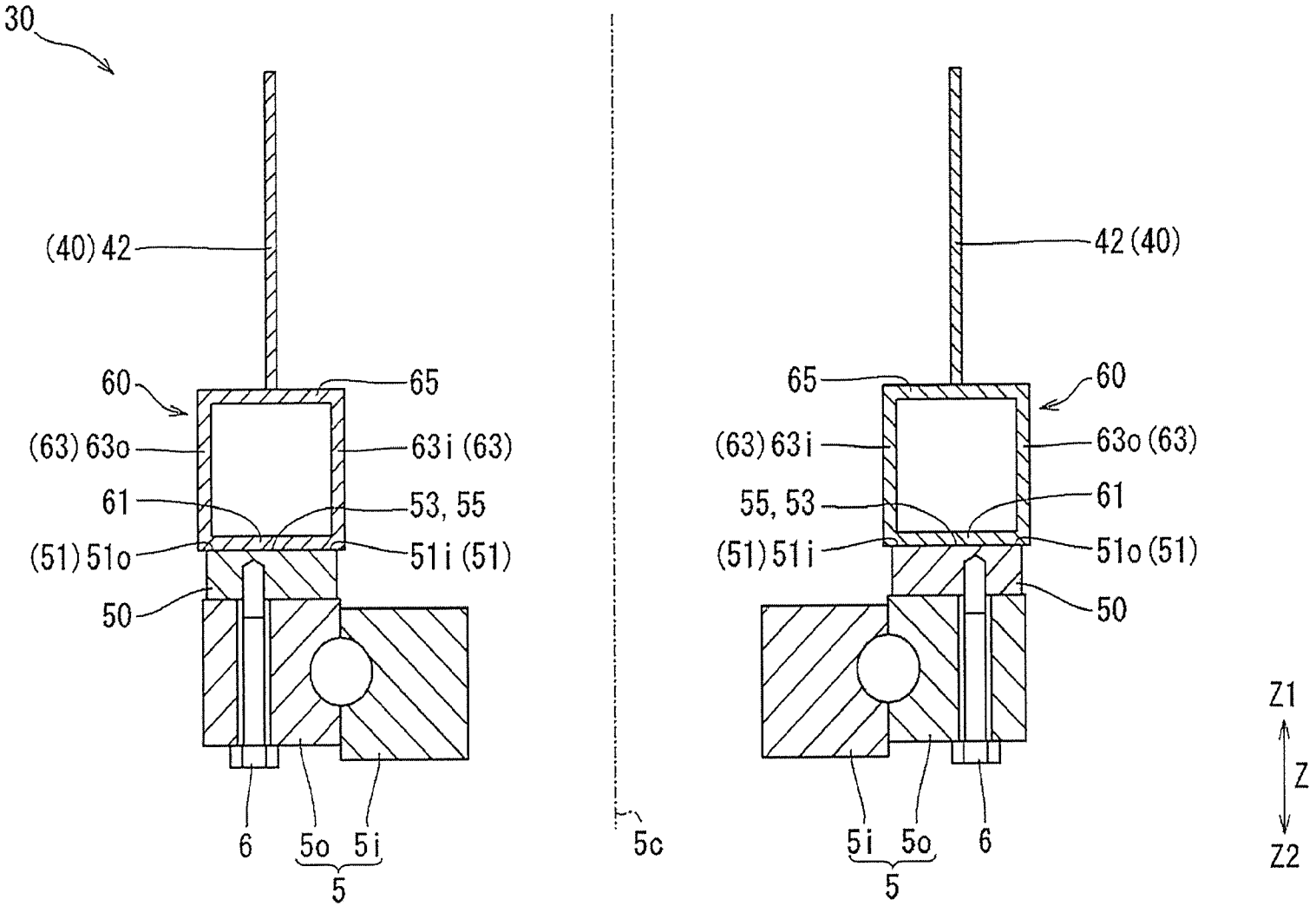
FIG. 5 is a combined sectional end view on line F5-F5 shown in FIG. 3.

As shown in FIG. 2 and FIG. 5, the bearing seat surface 50 is attached to the swing bearing 5. The bearing seat surface 50 is fixed to the upper surface (surface on the upper side Z1) of the outer race 5*o* by the fastening (described above) of the bearing bolt 6. The bearing seat surface 50 is fixed to the swing frame 40. The upper surface of the bearing seat surface 50 is joined (fixed directly by welding or the like) to the bottom part 41. As shown in FIG. 3 and FIG. 2, the upper surface of the bearing seat surface 50 is fixed to the side plate 42 (intersecting side plate) via the force dispersing member 60. The bearing seat surface 50 is annular (ring-shaped). The bearing seat surface 50 has a shape of a plate orthogonal to the up-down direction Z (shape of a plate with the thickness direction in the up-down direction Z). As shown in FIG. 3, the position in which an area of the bearing seat surface 50 at a position further toward the rear side X2 than the center of revolution 5*c* (positioned further toward the rear side X2 than the straight line Ys) and the side plate 42 intersect when seen from the up-down direction Z is a side-plate intersecting position 42*a*. As shown in FIG. 4, the bearing seat surface 50 includes an edge parts 51 and a middle part 53. In the bearing seat surface 50, there is a force dispersion target region 55.

The edge parts 51 are two end parts of the bearing seat surface 50 in the bearing radial direction. The edge parts 51 has an inside edge part 51*i* and an outside edge part 51*o*. The inside edge part 51*i* is the end part of the bearing seat surface 50 on the inside in the bearing radial direction. The outside edge part 51*o* is the end part of the bearing seat surface 50 on the outside in the bearing radial direction. The width of the inside edge part 51*i* in the bearing radial direction is, for example, less than or equal to 20%, less than or equal to 15%, less than or equal to 10%, less than or equal to 5%, or the like with respect to the width of the bearing seat surface 50 in the bearing radial direction (and the same applies to the width of the outside edge part 51*o*).

The middle part 53 is a portion interposed between the edge parts 51 among the upper surface (surface on the upper side Z1) of the bearing seat surface 50. The middle part 53 is an area of the bearing seat surface 50 located between the inside edge part 51*i* and the outside edge part 51*o*. To the middle part 53, the plurality of bearing bolts 6 are attached.

The force dispersion target region 55 is a region of the bearing seat surface 50 to disperse the force transmitted to the bearing seat surface 50 from the side plate 42. The force dispersion target region 55 is formed in the swing bearing 5 (see FIG. 2), at a position further toward the rear side X2 than the center of revolution 5*c*. The force dispersion target region 55 is located in the middle part 53 (area between the two end parts of the bearing seat surface 50 in the bearing radial direction). The force dispersion target region 55 includes the side-plate intersecting position 42*a* in which the bearing seat surface 50 and the side plate 42 intersect when seen from the up-down direction Z and the position (described later) located in the vicinity of the side-plate intersecting position 42*a*. The force dispersion target region 55 is formed on both sides in the machine-width direction Y with respect to the straight line Xs (on the left and right across the straight line Xs). The force dispersion target region 55 on one side in the machine-width direction Y (the left side or right side) with respect to the straight line Xs will be described below. The details of the "position located in the vicinity" are as follows. FIG. 4 shows an angle α and an angle β representing the breadth of the force dispersion target region 55. The force dispersion target region 55 is broader when the angle α is greater, and the force dispersion target region 55 is broader when the angle β is greater. The lower limit value or upper limit value of the angle α is, for example, 10°, 15°, 20°, 25°, 30°, 35°, 40°, or 45°. The lower limit value or upper limit value of the angle β is, for example, 0°, 5°, 10°, 15°, 20°, 25°, or 30°. The details of the angle α and the angle β are as follows. When seen from the up-down direction Z, the angle α is an angle between a line segment α1 and a line segment α2 in the following. The line segment α1 is a line segment connecting a position 42*a*-1 at the end part of the side-plate intersecting position 42*a* (ignoring the thickness of the side plate 42) on the rear side X2 and the center of revolution 5*c*. The line segment α2 is a line segment connecting a position in the force dispersion target region 55 nearest to 0° in the angle θ and the center of revolution 5*c*. The angle β is an angle between a line segment β1 and a line segment β2 in the following. The line segment β1 is a line segment connecting a position 42*a*-2 at the end part of the side-plate intersecting position 42*a* on the front side X1 and the center of revolution 5*c*. The line segment β2 is a line segment connecting a position in the force dispersion target region 55 nearest to 90° in the angle θ and the center of revolution 5*c*. In the case (not shown) where the position in which the side plate 42 and the straight line Ys intersect when seen from the up-down direction Z is on the upper side Z1 of (immediately above) the bearing seat surface 50, the position 42*a*-2 is a position on the straight line Ys, and the angle β is 0°.

As shown in FIG. 5, the force dispersing member 60 is configured to allow the force transmitted to the bearing seat surface 50 from the side plate 42 to be dispersed into a plurality of routes. The force dispersing member 60 is means (a structure or member) for increasing the routes of load transfer to the bearing seat surface 50 from the side plate 42. The force dispersing member 60 is arranged between the side plate 42 (intersecting side plate) and the bearing seat surface 50. The force dispersing member 60 is arranged further toward the lower side Z2 than the side plate 42. The force dispersing member 60 is arranged further toward the upper side Z1 than the bearing seat surface 50. The force dispersing member 60 is joined (fixed directly by welding) to the side plate 42. The force dispersing member 60 is joined to the bearing seat surface 50. As shown in FIG. 3, the force dispersing member 60 is arranged (at least) on the upper side Z1 of (immediately above) the force dispersion target region 55. The force dispersing member 60 may be fixed (joined) to the bearing seat surface 50, in a position other than the force dispersion target region 55. When seen from the up-down direction Z, the force dispersing member 60 is annular, for example, or may be approximately annular (as described later), for example. When seen from the up-down direction Z, the force dispersing member 60 is arranged along the annular bearing seat surface 50. The force dispersing member 60 is arranged such that the force dispersing member 60 and the bearing seat surface 50 form a double structure. FIG. 3 and the like show an example in which the end part (inner circumference and outer circumference) of the force dispersing member 60 in the bearing radial direction and the end part (inner circumference and outer circumference) of the bearing seat surface 50 in the bearing radial direction are displaced in the bearing radial direction. However, the displacement may be absent. As shown in FIG. 5, the force dispersing member 60 has a shape including a hollow portion inside the force dispersing member 60 (is container-like or container-shaped). The shape of the section of the force dispersing member 60 seen from the bearing circumferential direction (hereinafter referred to simply as "section of the force dispersing member 60") is a polygon or a shape (described later, see FIG. 7) in which the base is removed from a polygon. The "polygon" includes a quadrilateral, a triangle, and the like and the "quadrilateral" includes a rectangle, a trapezoid, and the like. In an example shown in FIG. 5, the section of the force dispersing member 60 is rectangular. A case where the section of the force dispersing member 60 is rectangular will be described below. The force dispersing member 60 includes a bottom plate 61, a pair of vertical plates 63, and an upper plate 65.

The bottom plate 61 forms a portion of the force dispersing member 60 on the lower side Z2. The bottom plate 61 is joined to the upper surface (surface on the upper side Z1 in the middle part 53 and the edge part 51) of the bearing seat surface 50. The bottom plate 61 is a plate orthogonal to the up-down direction Z.

Each vertical plate 63 is a plate extending in the up-down direction Z. A plate inclined with respect to the up-down direction Z (described later, see FIG. 8) is included in the vertical plate 63, and a plate (such as the bottom plate 61) orthogonal to the up-down direction Z is not included in the vertical plate 63. Each vertical plate 63 is fixed to the bearing seat surface 50 via the bottom plate 61. As shown in FIG. 4, each vertical plate 63 is fixed to the bearing seat surface 50 such that the force dispersion target region 55 is avoided.

Each vertical plate 63 is not arranged on the upper side Z1 of (immediately above) the force dispersion target region 55 (or each vertical plate 63 does not overlap with the force dispersion target region 55 when seen from the up-down direction Z). On the outside of the force dispersion target region 55, each vertical plate 63 may be arranged on the upper side Z1 of the bearing seat surface 50 (see FIG. 11). As shown in FIG. 5, each vertical plate 63 is fixed to the edge part 51 of the bearing seat surface 50. As shown in FIG. 4, each vertical plate 63 is fixed to the bearing seat surface 50 along the edge part 51. The pair of vertical plates 63 includes an inside vertical plate 63*i* and an outside vertical plate 63*o*.

The inside vertical plate 63*i* forms a portion (inner circumferential portion) of the force dispersing member 60 on the inside in the bearing radial direction. As shown in FIG. 5, the inside vertical plate 63*i* is fixed to the inside edge part 51*i* via the bottom plate 61. As shown in FIG. 4, the outside vertical plate 63*o* forms a portion (outer circumferential portion) of the force dispersing member 60 on the outside in the bearing radial direction. As shown in FIG. 5, the outside vertical plate 63*o* is fixed to the outside edge part 51*o* via the bottom plate 61. The inside vertical plate 63*i* may be arranged further toward the inner side in the bearing radial direction than the inside edge part 51*i* (as described later, see FIG. 9). The outside vertical plate 63*o* may be arranged further toward the outer side in the bearing radial direction than the outside edge part 51*o* (as described later, see FIG. 9).

The upper plate 65 is a plate forming a portion of the force dispersing member 60 on the upper side Z1. The upper plate 65 is a plate orthogonal to the up-down direction Z. The upper plate 65 is joined to the inside vertical plate 63*i* and the outside vertical plate 63*o*, such that the end parts of the inside vertical plate 63*i* and the outside vertical plate 63*o* on the upper side Z1 are connected. The upper plate 65 is joined to the side plate 42 of the swing frame 40. The force dispersing member 60 is joined to the bottom part 41 of the swing frame 40 shown in FIG. 2. The bottom part 41 is joined (not shown) to the vertical plate 63 shown in FIG. 5, for example. The bottom part 41 (see FIG. 2) may be joined (not shown) to the bottom plate 61 or the upper plate 65, for example, or may be arranged (not shown) between the bottom plate 61 and the bearing seat surface 50, for example.

(Force that Occurs in Mobile Crane 1)

As shown in FIG. 1, the forces occur in the mobile crane 1 as follows, upon operation or upon assembly of the mobile crane 1. The lifting load f1 caused by the suspended load L and the weight f2 of the boom 21 cause the compressive force f3 to act on a portion of the swing frame 40 on the front side X1 (attachment position of the boom 21). The lifting load f1 and the weight f2 are transmitted from the boom 21 to the raising-lowering rope 24 via the guyline 22 and generate the tension f5 in the raising-lowering rope 24. The tension f5 causes the force f6 in the direction of the upper side Z1 and the direction of the front side X1 to act on a portion (the lower spreader 25) of the swing frame 40 on the rear side X2. The force f6 causes a bending load f11 and a compressive load f12 to act on a portion of the swing frame 40 on the rear side X2 (portion at a position further toward the rear side X2 than the center of revolution 5*c*). The tension of the guyline 22, the tension f5 of the raising-lowering rope 24, and the weight of the mast 23 cause a compressive force f7 to act on a portion of the swing frame 40 on the front side X1 (attachment position of the mast 23).

(Force that Occurs in Bearing Seat Surface 50 and the Like)

In the bearing seat surface 50 and the like, the forces occur as follows.

[Force that occurs in portion of bearing seat surface 50 on front side X1] The compressive force f3 and the compressive force f7 that occur in the portions of the swing frame 40 on the front side X1 cause the compressive load f21 (force in the direction of the lower side Z2) to act on an area of the swing bearing 5 positioned further toward the front side X1 than the center of revolution 5*c*. The compressive load f21 is carried by the bearing seat surface 50 (and the bearing seat surface 50 pushes the swing bearing 5 in the direction of the lower side Z2). The position of the neutral axis of the swing bearing 5 (position in which neither the compressive load f21 nor the tensile load f22 is applied) may vary to some extent depending on the situation of operation (such as the mass of the suspended load L or the angle to which the boom 21 is raised or lowered). However, when seen from the machine-width direction Y, the position of the neutral axis of the swing bearing 5 and the position of the center of revolution 5*c* approximately match.

[Force that occurs, for instance, in portion of bearing seat surface 50 on rear side X2] The bending load f11 that occurs in the portion of the swing frame 40 on the rear side X2 causes the tensile load 122 (force in the direction of the upper side Z1) to act on an area of the swing bearing 5 at a position further toward the rear side X2 than the center of revolution 5*c*. The tensile load f22 is carried by the bearing bolt 6 (see FIG. 2). In more detail, the bearing bolt 6 (see FIG. 2) is subjected to a force to draw the bearing seat surface 50 and the swing bearing 5 away from each other in the up-down direction Z. As a result, an axial force is generated in the bearing bolt 6.

(Force Transmitted Through Force Dispersing Member 60)

The bending load f11 that occurs in the swing frame 40 is transmitted from the side plate 42 to the bearing seat surface 50 via the force dispersing member 60. At this time, the force is transmitted from the force dispersing member 60 shown in FIG. 3 to the bearing seat surface 50 via a region (the edge part 51) other than the force dispersion target region 55. As a result, as described later, the stress is dispersed in and in the vicinity of the force dispersion target region 55 (localization of the stress is suppressed).

(Axial Force Distribution of Bearing Bolt)

Figure 6:
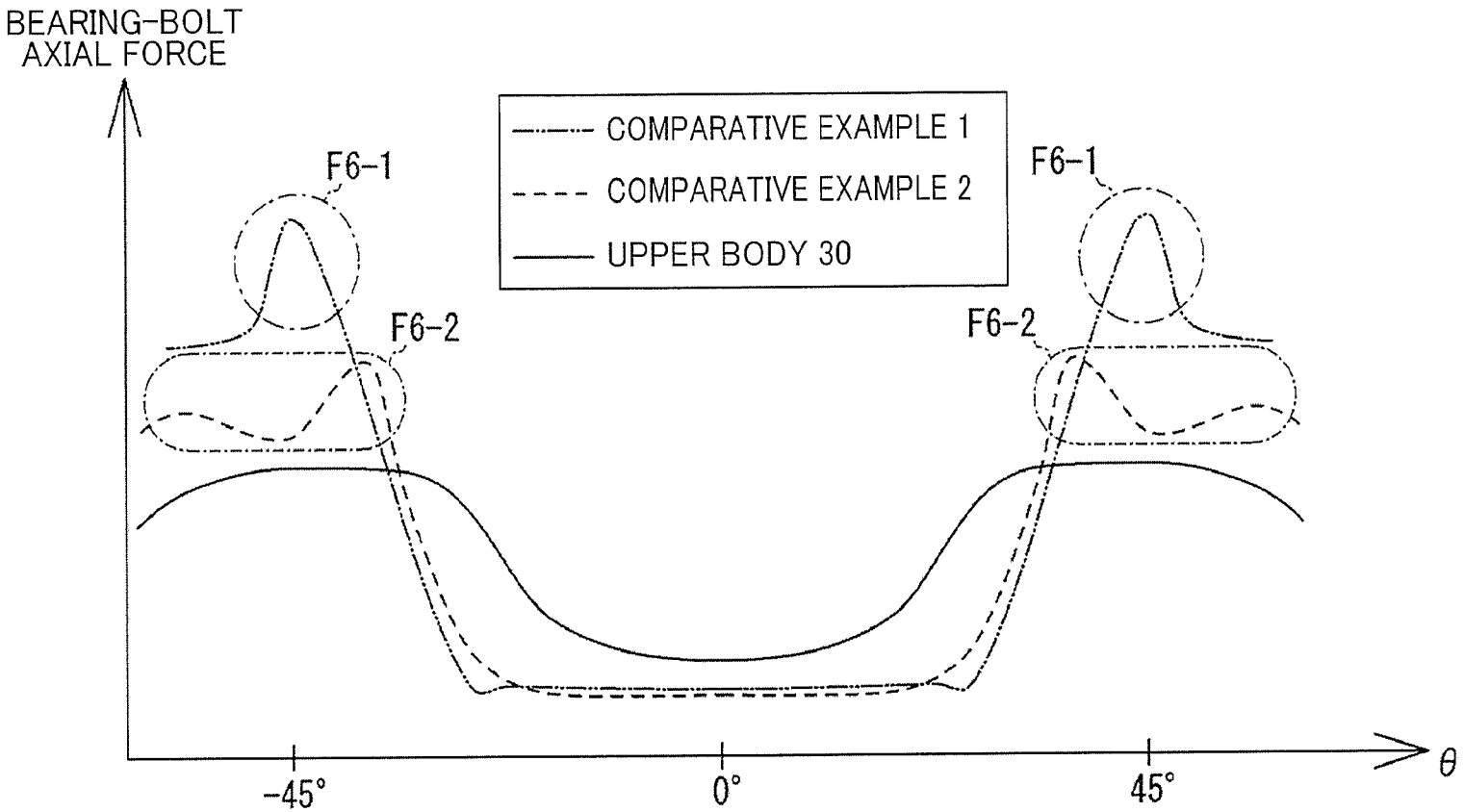
FIG. 6 is a graph showing the relationship of the angle θ shown in FIG. 3 and the bearing-bolt axial force.
Figure 18:
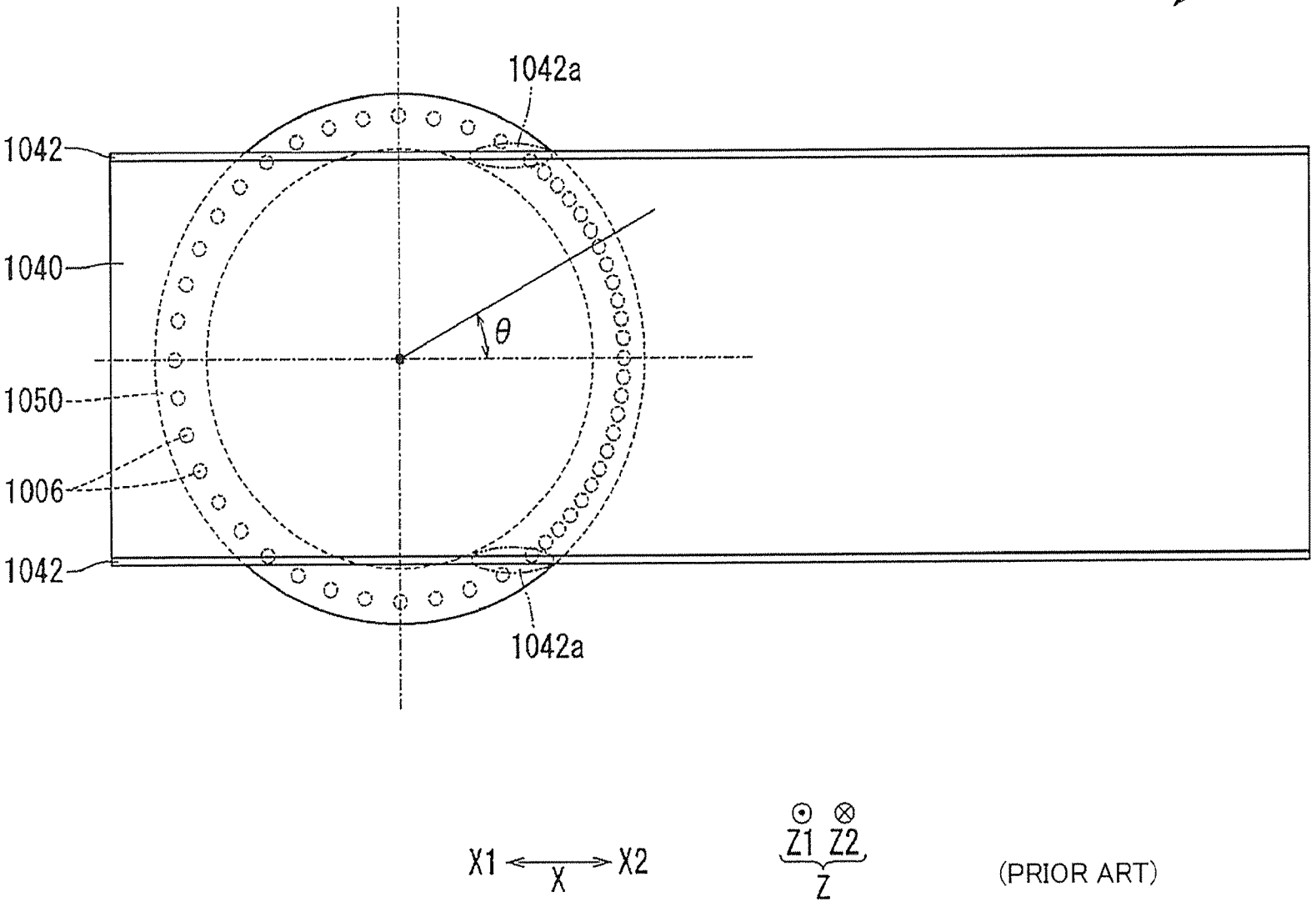
FIG. 18 is a schematic view of the conventional upper body 1630 shown in FIG. 17, seen from the upper side Z1.
Figure 19:
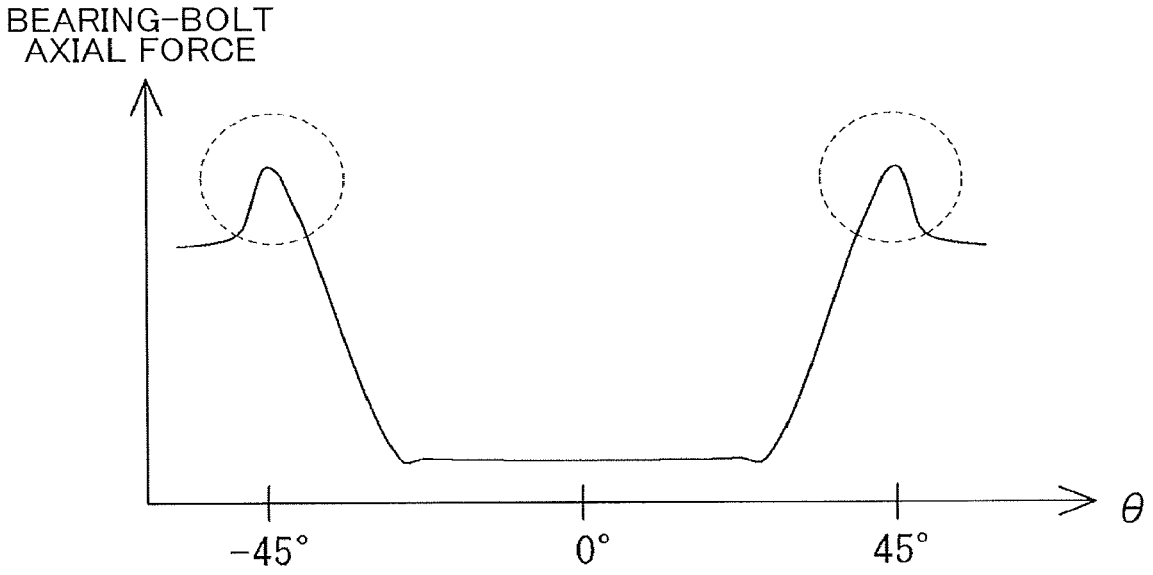
FIG. 19 is a graph showing the relationship of the angle θ shown in FIG. 18 and the bearing-bolt axial force.
Figure 20:
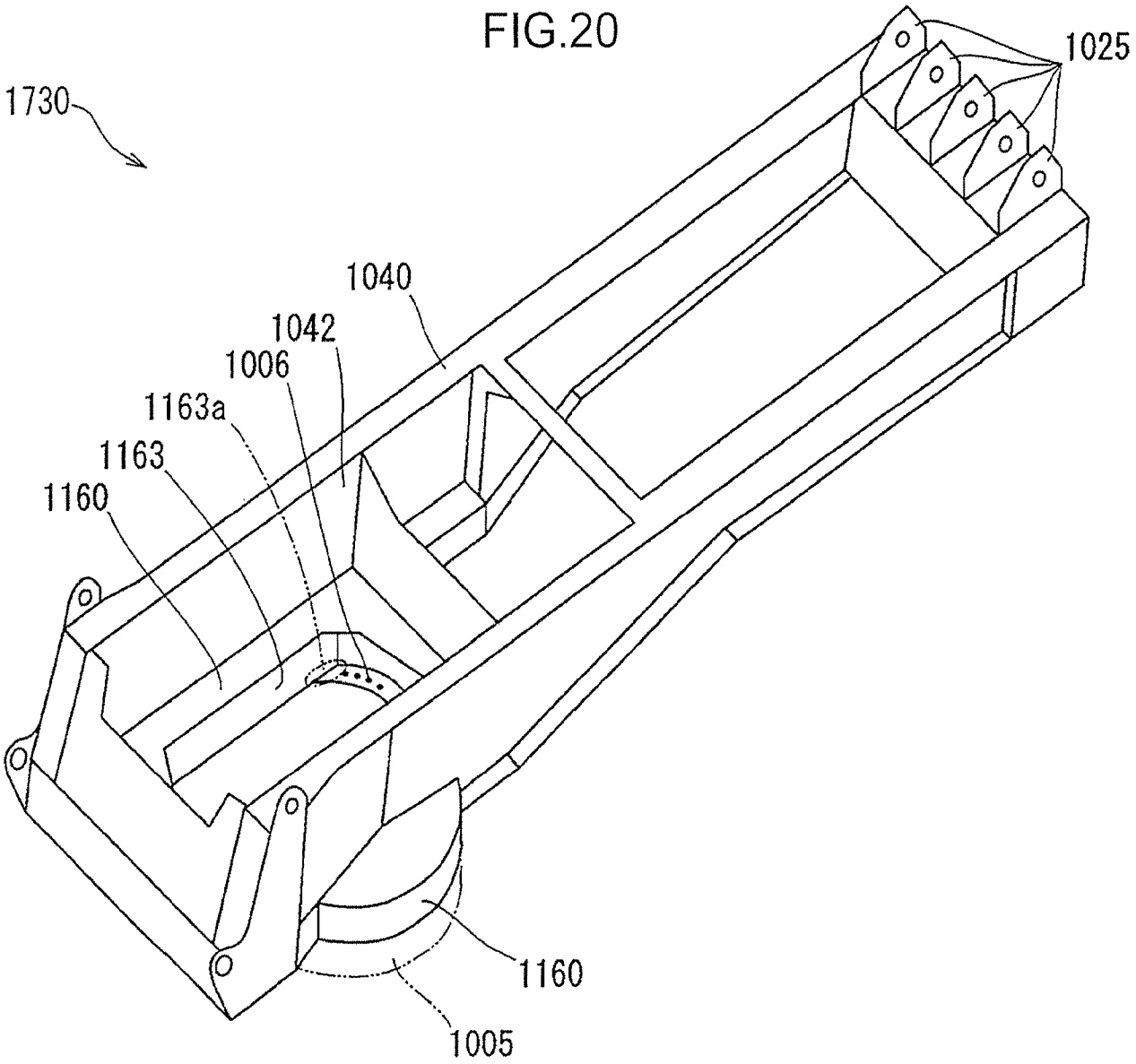
FIG. 20 is a perspective view of an upper body 1730 of comparative example 2.
Figure 21:
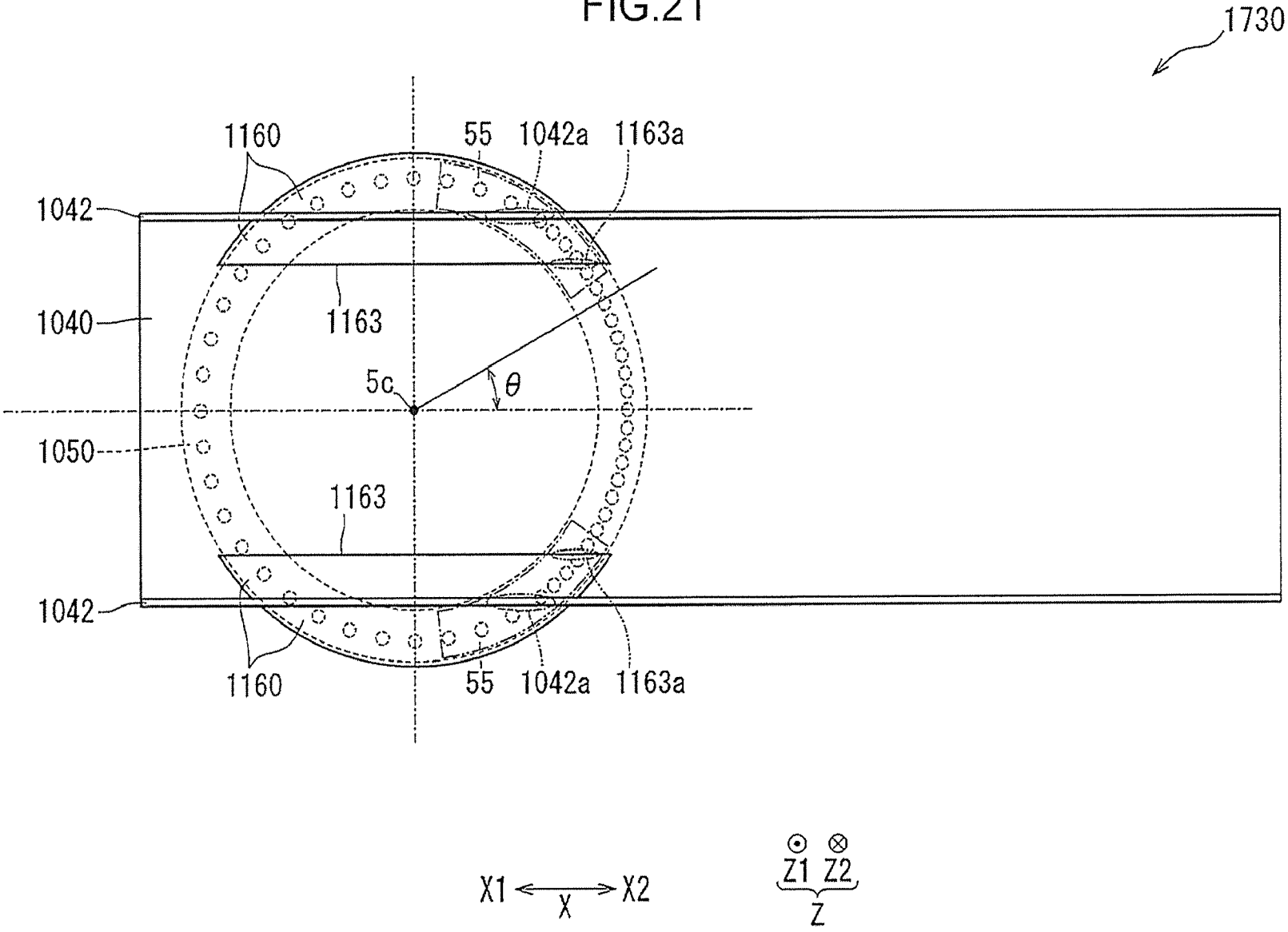
FIG. 21 is a schematic view of the upper body 1730 shown in FIG. 20, seen from the upper side Z1.

As shown in FIG. 6, the relationship of the axial force (bearing-bolt axial force) of the bearing bolt 6 (bearing bolt 1006) and the angle θ was examined, for each of comparative example 1 (see FIG. 18), comparative example 2 (see FIG. 20 and FIG. 21), and this embodiment (see FIG. 3). As shown in FIG. 18, the upper body 1630 of comparative example 1 does not include the force dispersing member 60 (see FIG. 3). As shown in FIG. 20 and FIG. 21, the upper body 1730 of comparative example 2 includes a container-shaped member 1160. As shown in FIG. 21, a vertical plate 1163 of the container-shaped member 1160 is fixed to the bearing seat surface 1050 in the position of the force dispersion target region 55. When seen from the up-down direction Z, the position in which the bearing seat surface 1050 and the vertical plate 1163 intersect is a vertical-plate intersecting position 1163*a*. In FIG. 20 and FIG. 21, components of comparative example 2 that are in common with comparative example 1 are denoted by the same reference signs as in comparative example 1.

The comparison results were as follows.

Comparative Example 1

As shown in portion F6-1 in FIG. 6, the bearing-bolt axial force in comparative example 1 was locally large in the side-plate intersecting position 1042*a* (see FIG. 18) (same position as the side-plate intersecting position 42*a* of this embodiment shown in FIG. 3) and maximum in the side-plate intersecting position 1042*a*.

Comparative Example 2

As shown in portion F6-2 in FIG. 6, the bearing-bolt axial force in comparative example 2 was locally large in the vertical-plate intersecting position 1163*a* (see FIG. 21) and maximum in the vertical-plate intersecting position 1163*a*.

This Embodiment

As shown in FIG. 6, the bearing bearing-bolt axial force in the upper body 30 (see FIG. 3) of this embodiment was more dispersed compared to comparative example 1 and comparative example 2. The maximum value of the bearing-bolt axial force in the upper body 30 was smaller than the maximum value of the bearing-bolt axial force in each of comparative example 1 and comparative example 2. This is due to the force transmitted to the bearing seat surface 50 from the side plate 42 shown in FIG. 3 being dispersed by the force dispersing member 60.

(Effect 1)

The effect of the upper body 30 of the mobile crane 1 shown in FIG. 1 will be described. The upper body 30 is attached to the lower travelling body 3 via the swing bearing 5. As shown in FIG. 2, the upper body 30 includes the swing frame 40, the bearing seat surface 50 fixed to the upper surface (surface on the upper side Z1) of the swing bearing 5 and the swing frame 40, and the force dispersing member 60.

[Configuration 1-1] As shown in FIG. 5, the force dispersing member 60 is arranged between the side plate 42 (intersecting side plate) of the swing frame 40 and the bearing seat surface 50 and configured to allow the force transmitted to the bearing seat surface 50 from the side plate 42 to be dispersed into a plurality of routes.

[Configuration 1-2] As shown in FIG. 4, the bearing seat surface 50 includes the force dispersion target region 55. The force dispersion target region 55 includes the side-plate intersecting position 42*a* in which the bearing seat surface 50 and the side plate 42 intersect when seen from the up-down direction Z and the position in the vicinity of the side-plate intersecting position 42*a*. The force dispersion target region 55 is located in the swing bearing 5 (see FIG. 2), at a position further toward the rear side X2 than the center of revolution 5*c*. Further, the force dispersion target region 55 is located in the middle part 53 between the two end parts (edge parts 51) of the bearing seat surface 50 in the bearing radial direction.

[Configuration 1-3] The force dispersing member 60 includes the pair of vertical plates 63 (see FIG. 5) extending in the up-down direction Z. Each vertical plate 63 is fixed to the region other than the force dispersion target region 55 among the bearing seat surface 50.

(Effect 1-1)

In [Configuration 1-3] described above, each vertical plate 63 is fixed to the region of the bearing seat surface 50 other than the force dispersion target region 55 (see [Configuration 1-2]). Thus, the force is dispersed and transmitted from the side plate 42 (intersecting side plate) to an area outside of the force dispersion target region 55 among the bearing seat surface 50, via the force dispersing member 60. Thus, a local increase, at the force dispersion target region 55, of the force transmitted to the bearing seat surface 50 from the side plate 42 is suppressed. Thus, the axial force on the bearing bolt 6 in the force dispersion target region 55 is reduced. Thus, increasing the plate thickness of the bearing seat surface 50 (see FIG. 5) is not necessary, and the maximum value of the axial force on the bearing bolt 6 can be reduced (see FIG. 6). In the case where the lifting capacity or strength of the mobile crane 1 (see FIG. 1) is determined (governed) by the axial force on the bearing bolt 6, the lifting capacity or strength of the mobile crane 1 can be improved by reducing the maximum value of the axial force on the bearing bolt 6.

(Effect 1-2)

As shown in FIG. 5, the force dispersing member 60 is fixed to the bearing seat surface 50 (see [Configuration 1-1] and [Configuration 1-3] described above). Thus, compared to a case where the force dispersing member 60 is not fixed to the bearing seat surface 50, the second moment of area of the force dispersing member 60 and the bearing seat surface 50 increases. As a result, the stiffness of the portion (bottom part 41) of the swing frame 40 on the lower side Z2 in the vicinity of the bearing seat surface 50 shown in FIG. 2 increases, and therefore deflection of the same portion (bottom part 41) can be reduced. Since the stiffness of the same portion increases, the stiffness (torsional stiffness) of the same portion (bottom part 41) with respect to torsional deformation can be improved. As a result, the torsional stiffness of the swing frame 40 can be improved.

(Effect 2)

[Configuration 2] As shown in FIG. 3 and FIG. 5, the vertical plate 63 is fixed to the bearing seat surface 50 along the edge part 51 of the bearing seat surface 50.

With [Configuration 2] described above, the configuration ([Configuration 1-3] described above) in which the vertical plate 63 is fixed to the region other than the force dispersion target region 55 among the bearing seat surface 50 can be realized reliably. With [Configuration 2] described above, the force dispersing member 60 can be formed in a compact manner, compared to a case (described later, see FIG. 9 or the like) where the vertical plate 63 is arranged in a position apart from the edge part 51.

Second Embodiment

Figure 7:
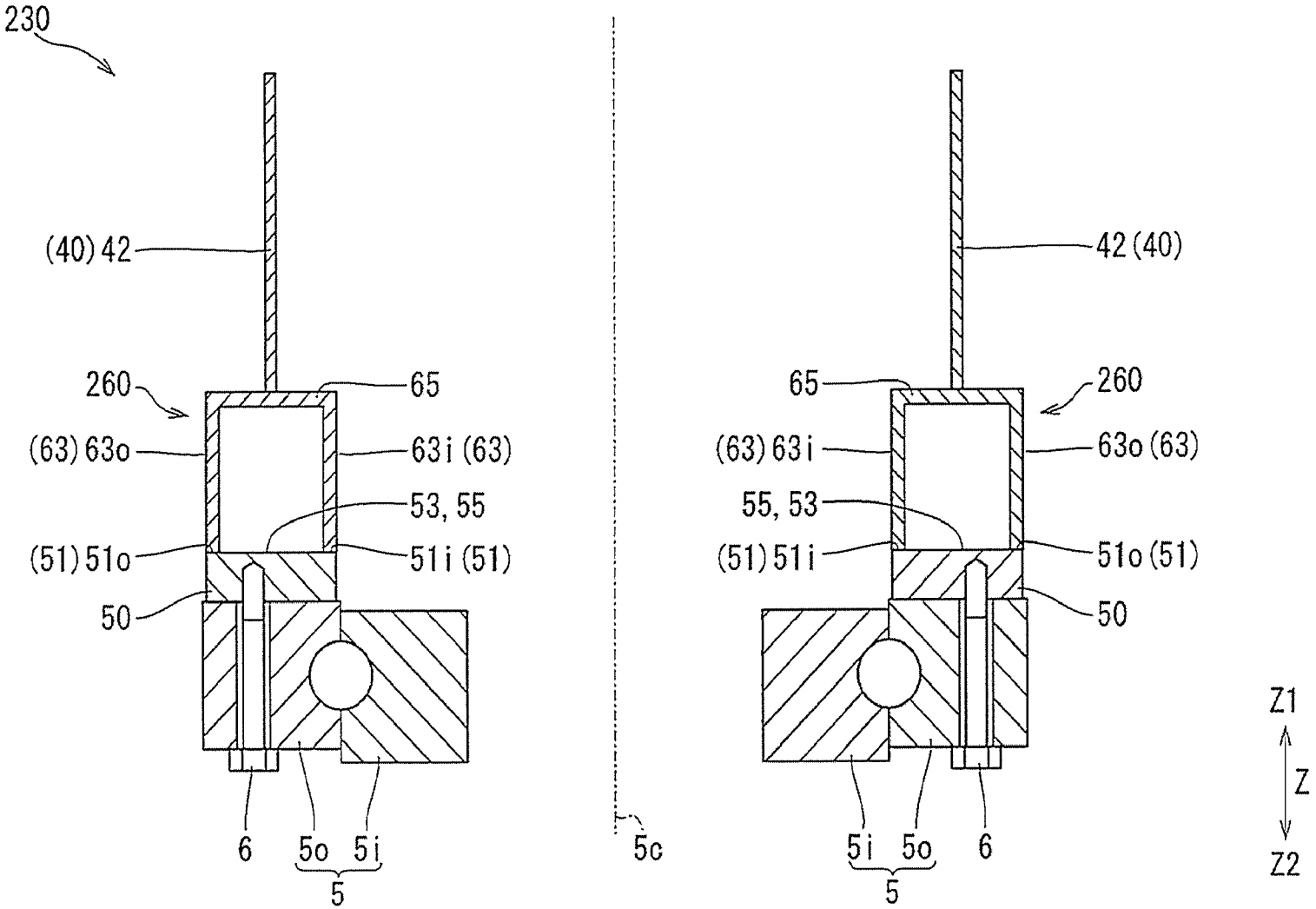
FIG. 7 is a view corresponding to FIG. 5 for a second embodiment.

Referring to FIG. 7, the difference of an upper body 230 of a second embodiment from the first embodiment will be described. Those in the upper body 230 that are common with the first embodiment are denoted by the same reference signs as in the first embodiment, with description omitted (and the same applies to other embodiments, regarding the omission of descriptions on those that are common). In the first embodiment, the section (section seen from the bearing circumferential direction) of the force dispersing member 60 (see FIG. 5) has been rectangular. In the second embodiment, the section of a force dispersing member 260 has a shape (C-shape) in which the base is removed from a rectangular shape. The force dispersing member 260 is the force dispersing member 60 (see FIG. 5) of the first embodiment with the bottom plate 61 (see FIG. 5) removed. Each vertical plate 63 of the force dispersing member 260 is joined directly to the edge part 51 of the bearing seat surface 50. In the case where the force dispersing member 260 does not include the bottom plate 61, the force dispersing member 260 is more lightweight compared to a case where the bottom plate 61 is included.

Third Embodiment

Figure 8:
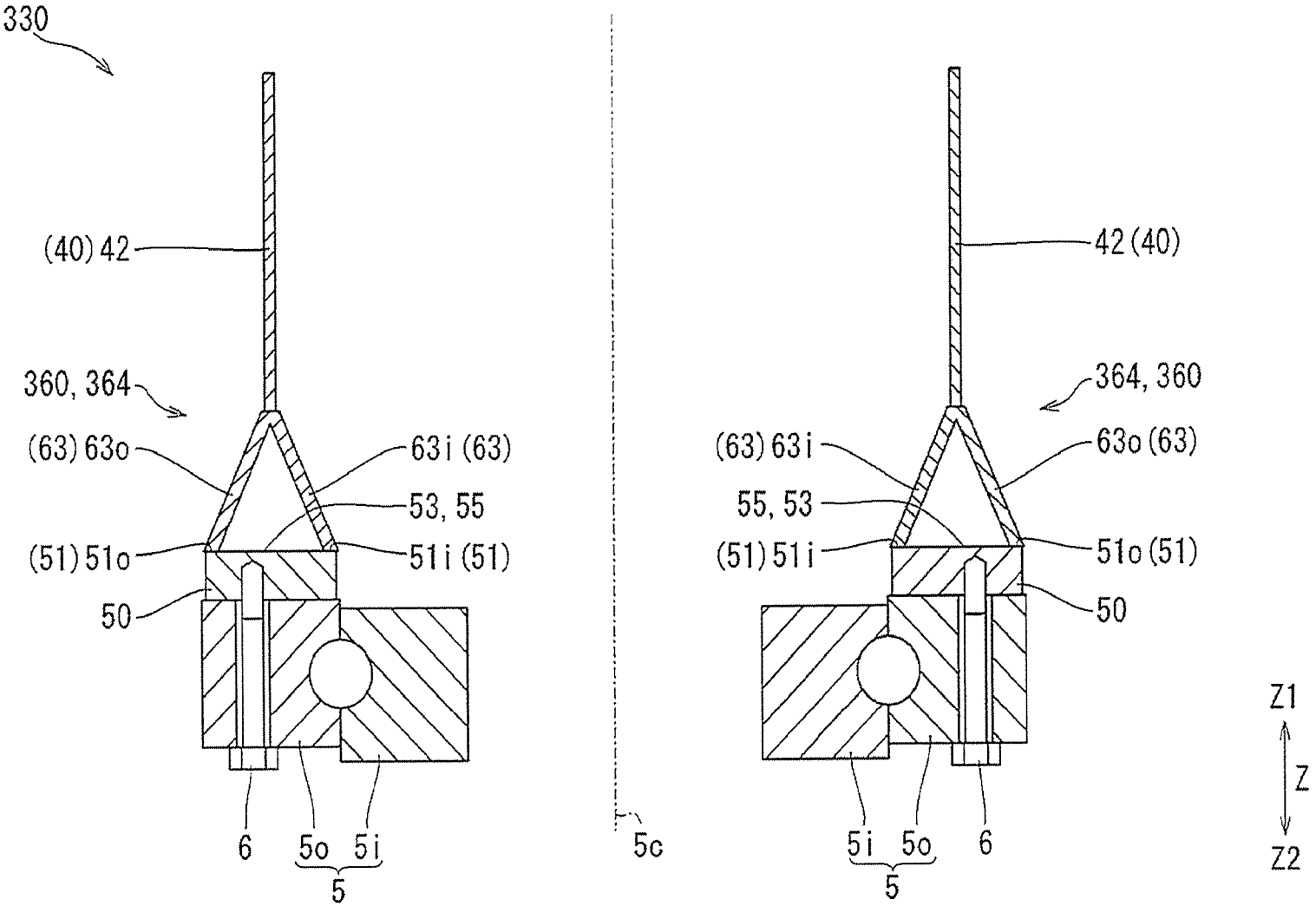
FIG. 8 is a view corresponding to FIG. 5 for a third embodiment.

Referring to FIG. 8, the difference of an upper body 330 of a third embodiment from the first embodiment will be described. In the first embodiment, the section of the force dispersing member 60 (see FIG. 5) has been rectangular. In the third embodiment, the section of the force dispersing member 360 has an inverted V-shape.

A force dispersing member 360 includes an inverted V-shaped part 364. The force dispersing member 360 as a whole is configured of the inverted V-shaped part 364. The force dispersing member 360 may include the bottom plate 61 (see FIG. 5) in a similar manner to the first embodiment (or the section of the force dispersing member 360 may be triangular). The section of the inverted V-shaped part 364 seen from the bearing circumferential direction (hereinafter referred to simply as "section of the inverted V-shaped part 364") is a shape of the letter "V" flipped vertically. The inverted V-shaped part 364 is configured of two vertical plates 63 (the inside vertical plate 63*i* and the outside vertical plate 63*o*). The two vertical plates 63 are joined to each other at the upper end parts in an inclined posture with respect to the up-down direction Z. The end part of each of the vertical plates 63*i* and 63*o* on the upper side Z1 is fixed (e.g., joined) to the side plate 42 (intersecting side plate) of the swing frame 40. The sectional shape of the inverted V-shaped part 364 is left-right symmetric. In the case where the sectional shape of the inverted V-shaped part 364 is left-right symmetric, the action of the force to bend the bearing bolt 6 (force in the direction orthogonal to the axial direction of the bearing bolt 6) is suppressed.

(Effect 3)

The effect of the upper body 330 of the third embodiment shown in FIG. 8 will be described.

[Configuration 3] The section of the force dispersing member 360 seen from the bearing circumferential direction includes the inverted V-shaped part 364. The end part of the inverted V-shaped part 364 on the upper side Z1 is fixed to the side plate 42 of the swing frame 40.

With the force dispersing member 60 of the first embodiment shown in FIG. 5, there is a risk of the upper plate 65 being bended by the side plate 42 pulling the upper plate 65 to the upper side Z1. The force dispersing member 360 of this embodiment includes [Configuration 3] described above. Thus, the force dispersing member 360 does not need to include the upper plate 65 (e.g., does not include the upper plate 65). Thus, the force can be transmitted to the bearing seat surface 50 from the side plate 42 without causing the problem of bending in the upper plate 65.

Fourth Embodiment

Figure 9:
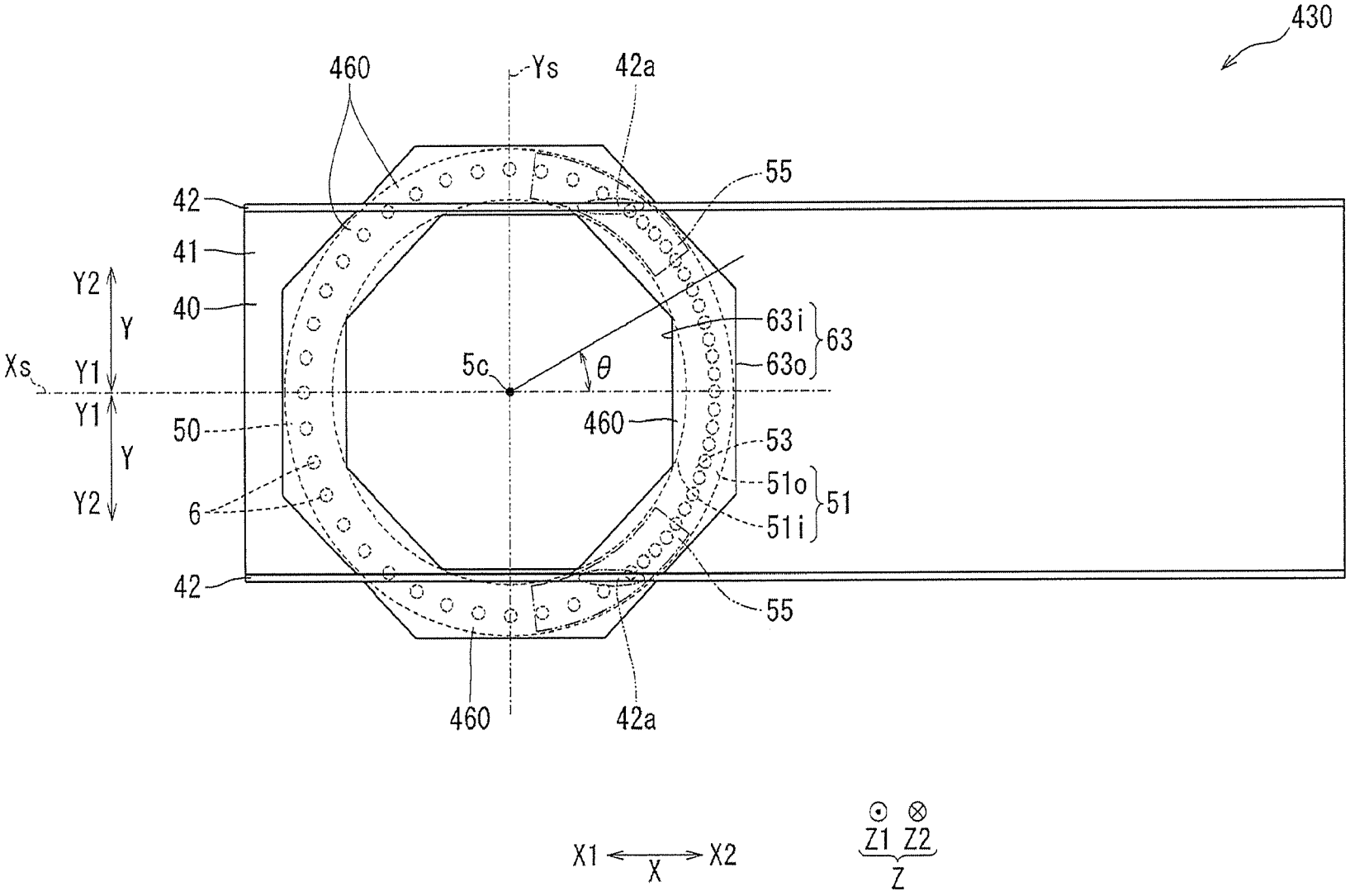
FIG. 9 is a view corresponding to FIG. 3 for a fourth embodiment.

Referring to FIG. 9, the difference of an upper body 430 of a fourth embodiment from the first embodiment will be described. In the first embodiment, the force dispersing member 60 (see FIG. 3) has been annular when seen from the up-down direction Z. In the fourth embodiment, the shape of a force dispersing member 460 when seen from the up-down direction Z differs from the first embodiment.

The force dispersing member 460 has an annular polygonal shape when seen from the up-down direction Z. When seen from the up-down direction Z, an inner circumferential portion (the inside vertical plate 63*i*) and an outer circumferential portion (the outside vertical plate 63*o*) of the force dispersing member 460 are respectively polygons. The "polygon" is, for example, an octagon. The number of angles of the "polygons" may be less than or equal to seven or greater than or equal to nine. The numbers of angles of the "polygons" are equivalent in the inner circumferential portion and the outer circumferential portion of the force dispersing member 460. The outside vertical plate 63*o* of the force dispersing member 460 is arranged approximately along the outside edge part 51*o*, and has a portion arranged further toward the outer side in the bearing radial direction than the outside edge part 51*o*. The inside vertical plate 63*i* of the force dispersing member 460 is arranged approximately along the inside edge part 51*i*, and has a portion arranged further toward the inner side in the bearing radial direction than the inside edge part 51*i*.

Fifth Embodiment

Figure 10:
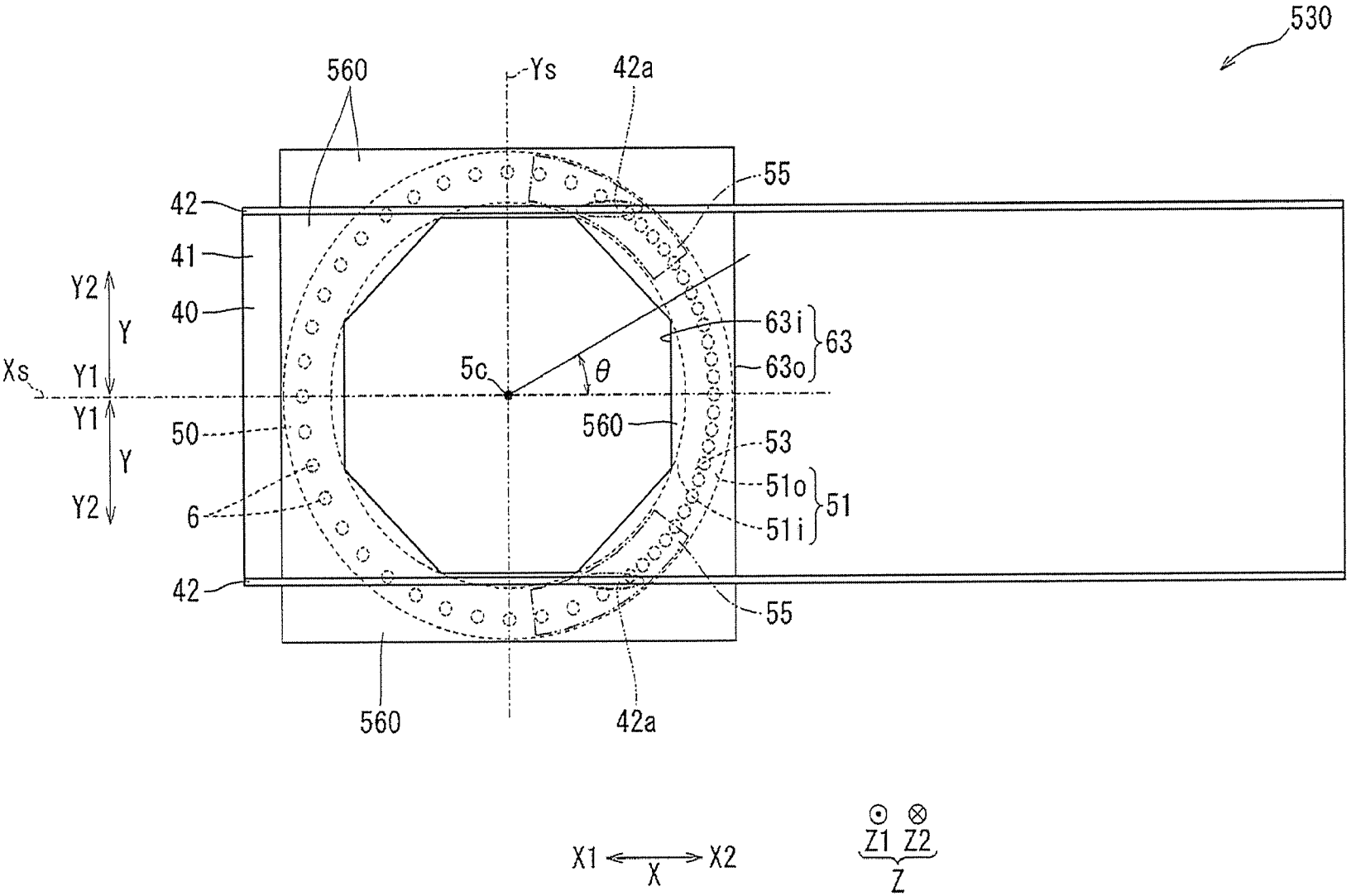
FIG. 10 is a view corresponding to FIG. 3 for a fifth embodiment.

Referring to FIG. 10, the difference of an upper body 530 of a fifth embodiment from the fourth embodiment (see FIG. 9) will be described. In the fourth embodiment, when seen from the up-down direction Z, the number of angles of the polygon formed in the inner circumferential portion (inside vertical plate 63*i*) of the force dispersing member 460 (see FIG. 9) and the number of angles of the polygons formed in the outer circumferential portion (outside vertical plate 63*o*) are equivalent. In the fifth embodiment, the number of angles (e.g., eight) of a polygon formed in an inner circumferential portion (the inside vertical plate 63*i*) of a force dispersing member 560 and the number of angles (e.g., four) of a polygon formed in an outer circumferential portion (the outside vertical plate 63*o*) are different. For example, the number of angles of the polygon formed in the inner circumferential portion (inside vertical plate 63*i*) of the force dispersing member 560 may be greater (or may be smaller) than the number of angles of the polygon formed in the outer circumferential portion (outside vertical plate 63*o*).

Sixth Embodiment

Figure 11:
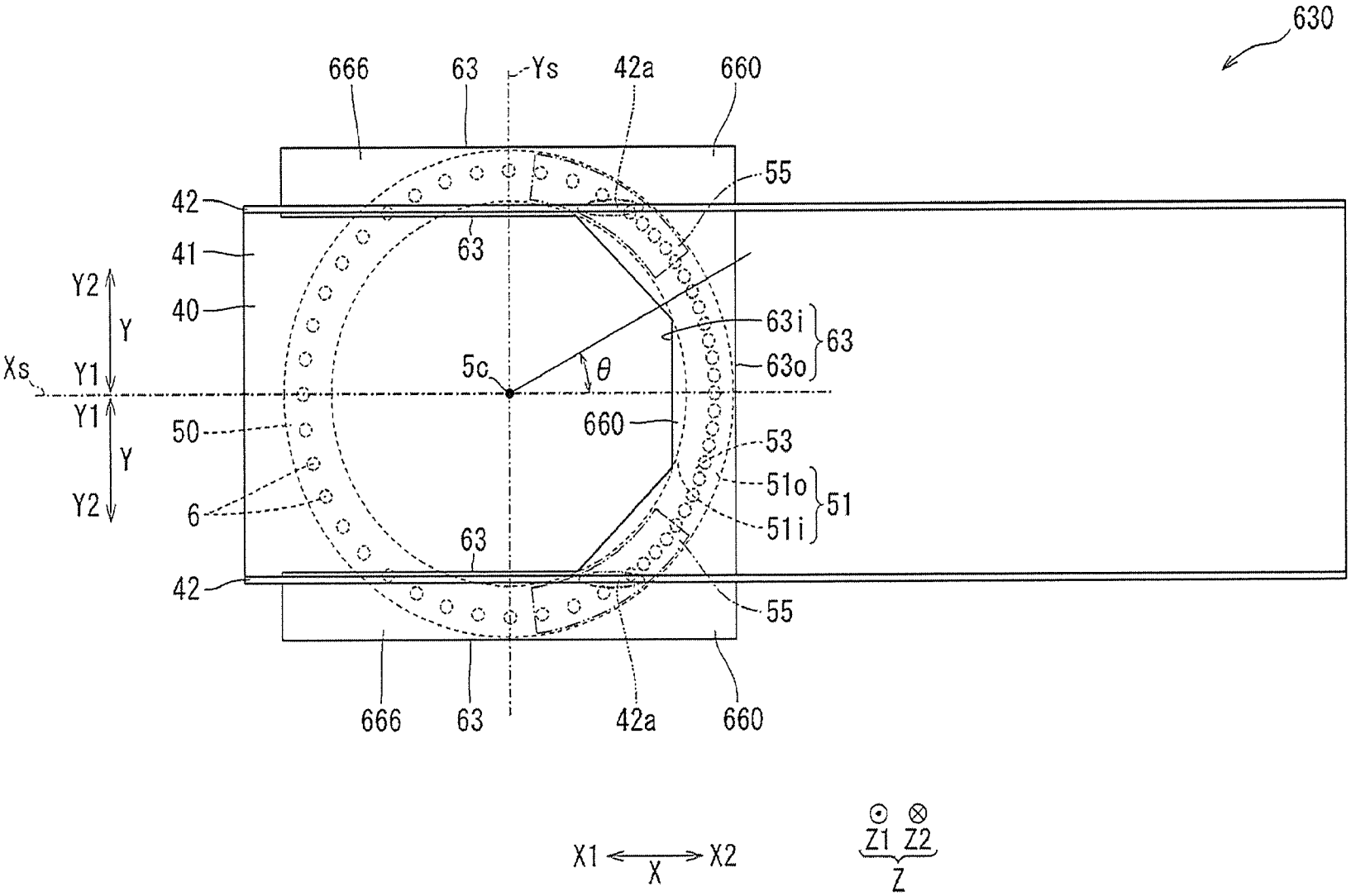
FIG. 11 is a view corresponding to FIG. 3 for a sixth embodiment.

Referring to FIG. 11, the difference of an upper body 630 of a sixth embodiment from the fifth embodiment (see FIG. 10) will be described. In the fifth embodiment, when seen from the up-down direction Z, each of the inner circumferential portion (inside vertical plate 63*i*) and the outer circumferential portion (outside vertical plate 63*o*) of the force dispersing member 560 (see FIG. 10) has a polygonal shape. In the sixth embodiment, a force dispersing member 660 is approximately U-shaped when seen from the up-down direction Z.

The force dispersing member 660 is configured as follows. A portion of the force dispersing member 660 at a position further toward the rear side X2 than the center of revolution 5*c* is configured in a similar manner to the force dispersing member 560 (see FIG. 10) of the fifth embodiment. The portion of the force dispersing member 660 at a position further toward the rear side X2 than the center of revolution 5*c* may be configured in a similar manner to the force dispersing member 60 (see FIG. 3) of the first embodiment, the force dispersing member 460 (see FIG. 9) of the fourth embodiment, or the like. A portion of the force dispersing member 660 at a position further toward the front side X1 than the center of revolution 5*c* includes a pair of linear parts 666.

Each linear part 666 is linear when seen from the up-down direction Z. Each linear part 666 extends in the machine front-back direction X. The pair of linear parts 666 is formed of two linear parts 666 provided to be apart in the machine-width direction Y. Each linear part 666 is arranged along the side plate 42. The end part of the linear part 666 on the rear side X2 is a portion in which the bearing seat surface 50 and the straight line Ys intersect when seen from the up-down direction Z. The position of the end part of the linear part 666 on the front side X1 in the machine front-back direction X is, for example, the same position as (or in the vicinity of) the position of the end part of the bearing seat surface 50 on the front side X1 in the machine front-back direction X. On the upper side Z1 of (immediately above) a part of the bearing seat surface 50, the force dispersing member 660 is not arranged (the force dispersing member 660 is absent, so to speak). The "part of the bearing seat surface 50" is, for example, an area of the bearing seat surface 50 located on the width-direction inside Y1 at a position further toward the side plate 42 and the front side X1 than the center of revolution 5*c*.

Seventh Embodiment

Figure 12:
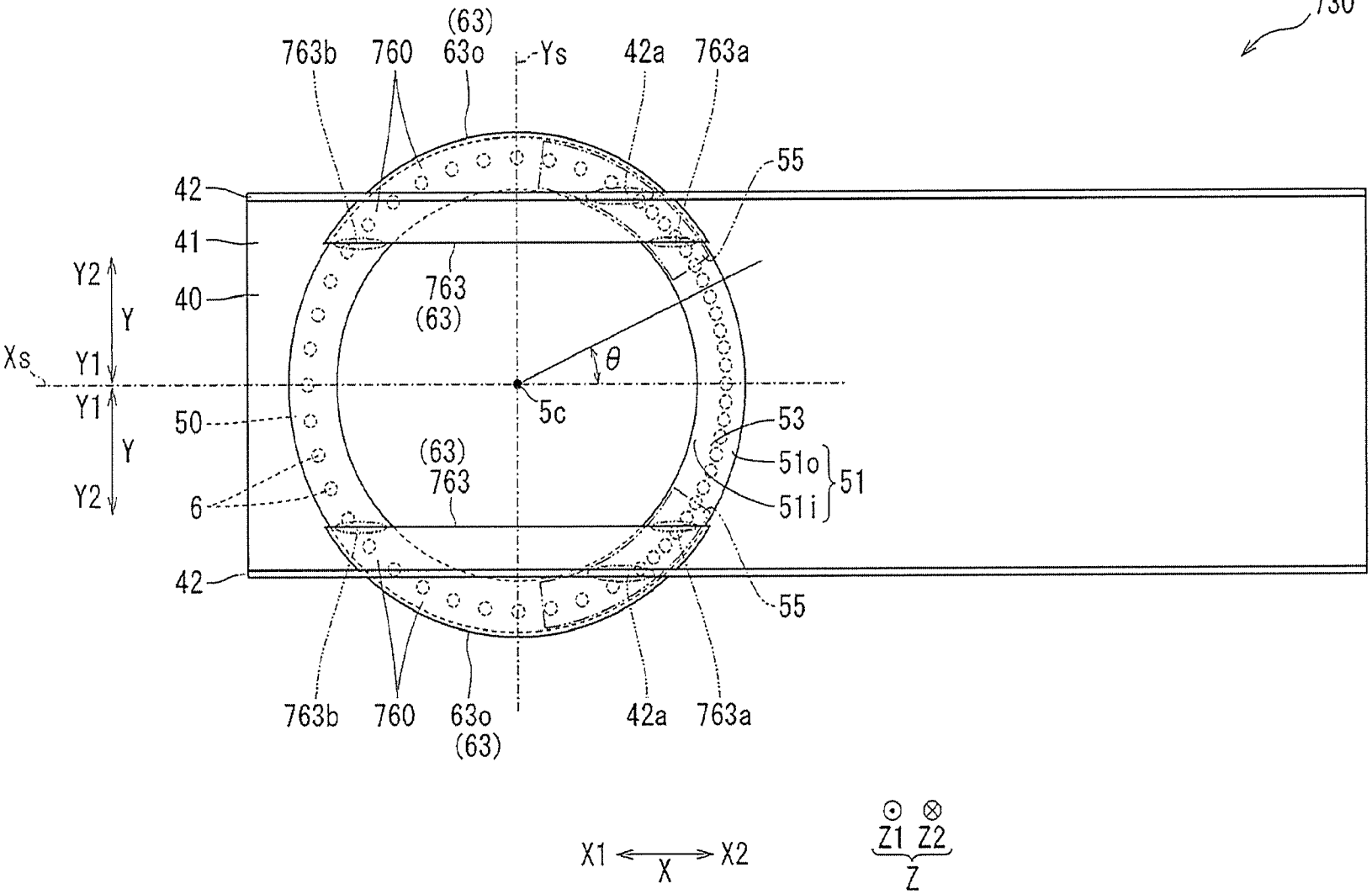
FIG. 12 is a view corresponding to FIG. 3 for a seventh embodiment.
Figure 13:
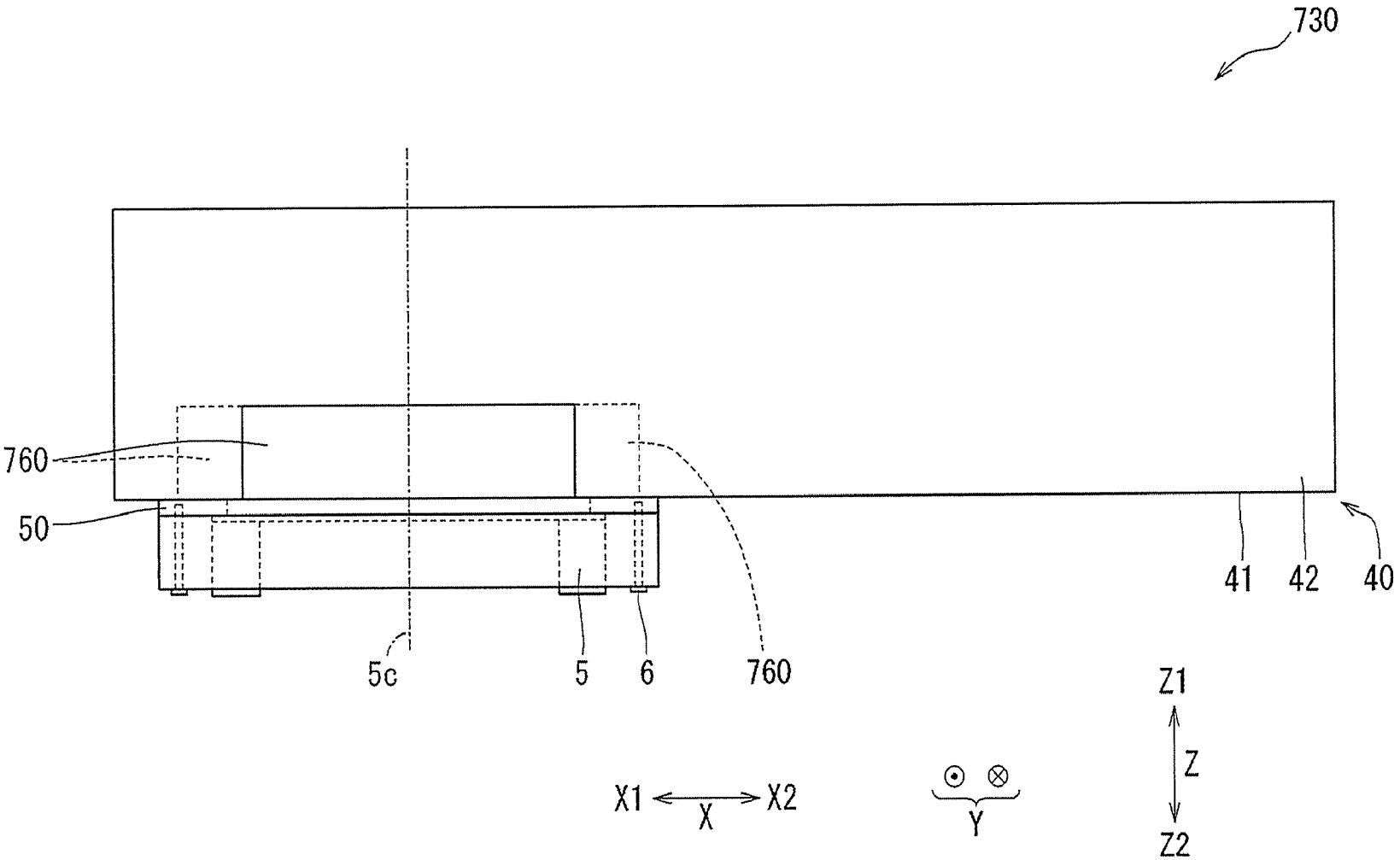
FIG. 13 is a view corresponding to FIG. 2 for the seventh embodiment.
Figure 14:
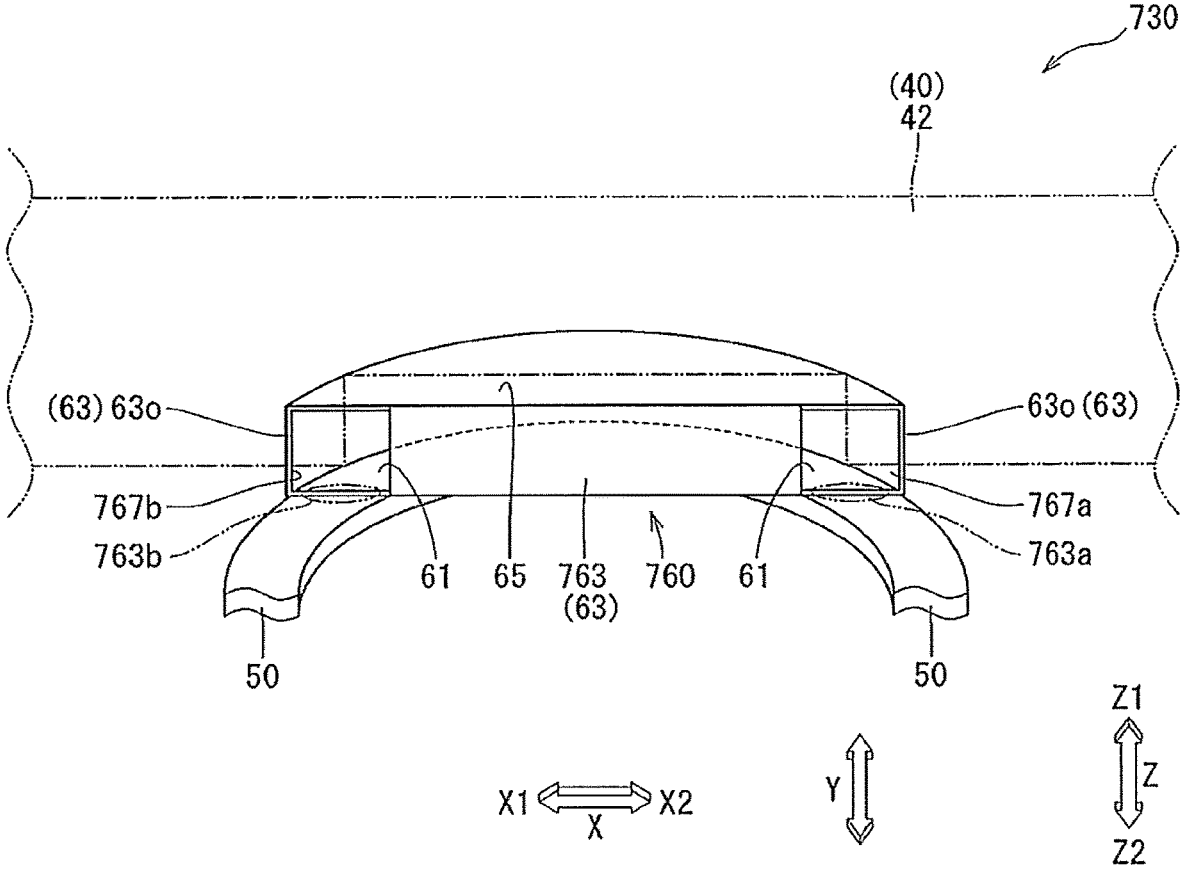
FIG. 14 is a perspective view schematically showing a force dispersing member 760 and the like shown in FIG. 12.

Referring to FIG. 12 to FIG. 14, the difference of an upper body 730 of a seventh embodiment from the first embodiment will be described. When seen from the up-down direction Z, the force dispersing member 60 (see FIG. 3) of the first embodiment has been annular. As shown in FIG. 12, the upper body 730 of the seventh embodiment includes a pair of the force dispersing members 760. In FIG. 14, the side plate 42 is shown by an imaginary line (double-dot-dashed line).

The pair of force dispersing members 760 is formed of the two force dispersing members 760 provided to be apart in the machine-width direction Y. There is a portion where the pair of force dispersing members 760 are absent in the bearing circumferential direction, so to speak, on the upper side Z1 of (immediately above) the bearing seat surface 50. The pair of force dispersing members 760 is not arranged on the upper side Z1 of (immediately above) a middle portion of the bearing seat surface 50 in the machine-width direction Y. When seen from the up-down direction Z, each force dispersing member 760 has a shape (approximately semicircular shape smaller than a semicircle) bounded by an arc of which the central angle is less than 90° and a chord connecting two ends of the arc. The outside vertical plate 63*o* (portion of the "arc") of each force dispersing member 760 is arranged along the outside edge part 51*o*. The vertical plate 63 of each force dispersing member 760 includes a seat-surface inside vertical plate 763. As shown in FIG. 14, each force dispersing member 760 includes a rear-side cutout part 767*a* (cutout part) and a front-side cutout part 767*b*.

The seat-surface inside vertical plate 763 is a portion arranged further toward the inner side in the bearing radial direction than the bearing seat surface 50 among the vertical plate 63. As shown in FIG. 12, the seat-surface inside vertical plate 763 is arranged in a part of the "chord" of the force dispersing member 760, seen from the up-down direction Z. When seen from the up-down direction Z, the seat-surface inside vertical plate 763 is linear and extends, for example, in the machine front-back direction X (or may extend in approximately the machine front-back direction X). When seen from the up-down direction Z, the position in which an extended line from the seat-surface inside vertical plate 763 and the bearing seat surface 50 positioned further toward the rear side X2 than the center of revolution 5*c* intersect is a rear-side vertical-plate intersecting position 763*a* (vertical-plate intersecting position). When seen from the up-down direction Z, the position in which the extended line from the seat-surface inside vertical plate 763 and an area positioned further toward the front side X1 than the center of revolution 5*c* among the bearing seat surface 50 intersect is a front-side vertical-plate intersecting position 763*b*.

The rear-side cutout part 767*a* (cutout part) (see FIG. 14) is arranged in the rear-side vertical-plate intersecting position 763*a*. When seen from the up-down direction Z, the rear-side cutout part 767*a* and the rear-side vertical-plate intersecting position 763*a* overlap. As shown in FIG. 14, the rear-side cutout part 767*a* is arranged on the rear side X2 of the seat-surface inside vertical plate 763 to be adjacent to the seat-surface inside vertical plate 763. The rear-side cutout part 767*a* is arranged on the upper side Z1 of the bottom plate 61 to be adjacent to the bottom plate 61. In the case (not shown) where the force dispersing member 760 does not include the bottom plate 61, the rear-side cutout part 767*a* is arranged on the upper side Z1 of the bearing seat surface 50 to be adjacent to the bearing seat surface 50. The rear-side cutout part 767*a* is, for example, arranged on the lower side Z2 of the upper plate 65 to be adjacent to the upper plate 65. On the lower side Z2 of the rear-side cutout part 767*a*, the vertical plate 63 is not arranged. On the upper side Z1 of the rear-side cutout part 767*a*, the vertical plate 63 may be arranged (not shown).

The front-side cutout part 767*b* is arranged in the front-side vertical-plate intersecting position 763*b* shown in FIG. 12. When seen from the up-down direction Z, the front-side cutout part 767*b* and the front-side vertical-plate intersecting position 763*b* overlap. As shown in FIG. 14, the front-side cutout part 767*b* and the rear-side cutout part 767*a* are plane-symmetric (with the plane of symmetry being a plane orthogonal to the machine front-back direction X and passing through the center of revolution 5*c* (see FIG. 12)). The front-side cutout part 767*b* may be not provided.

(Effect 4)

The effect of the upper body 730 of the seventh embodiment shown in FIG. 12 will be described. The vertical plate 63 includes the seat-surface inside vertical plate 763 arranged further toward the inner side in the bearing radial direction than the bearing seat surface 50.

[Configuration 4] The force dispersing member 760 includes the rear-side cutout part 767*a* (see FIG. 14). When seen from the up-down direction Z, the rear-side cutout part 767*a* (see FIG. 14) is arranged in the rear-side vertical-plate intersecting position 763*a* in which the extended line from the seat-surface inside vertical plate 763 and an area positioned further toward the rear side X2 than the center of revolution 5*c* among the bearing seat surface 50 intersect.

With [Configuration 4] described above, the configuration of [Configuration 1-3] described above in which "the vertical plate 63 is fixed to the region other than the force dispersion target region 55 among the bearing seat surface 50" can be realized reliably.

Eighth Embodiment

Figure 15:
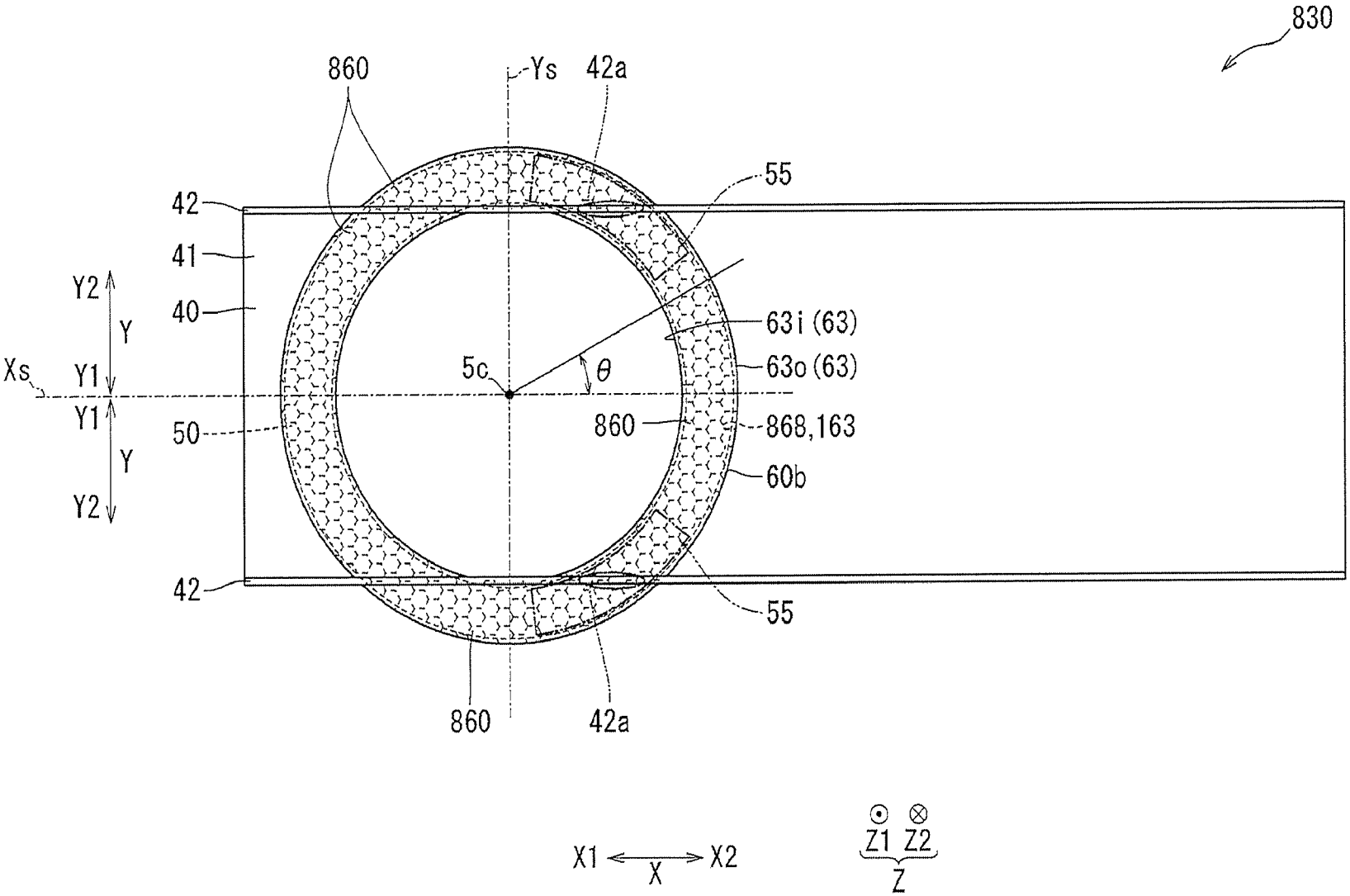
FIG. 15 is a view corresponding to FIG. 3 for an eighth embodiment.
Figure 16:
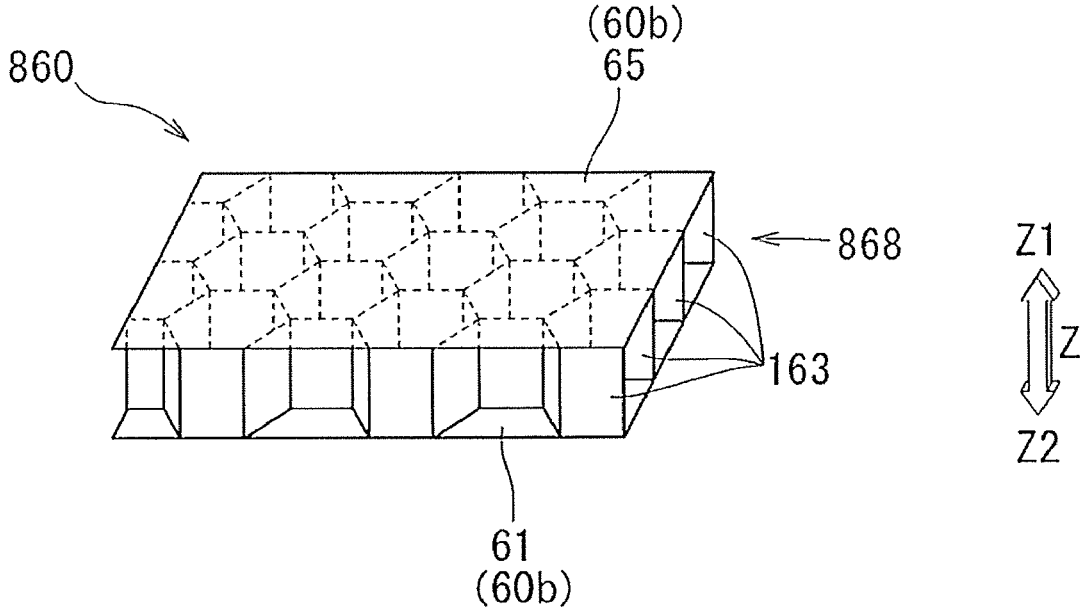
FIG. 16 is a perspective view schematically showing the structure of a force dispersing member 860 shown in FIG. 15.
Figure 17:
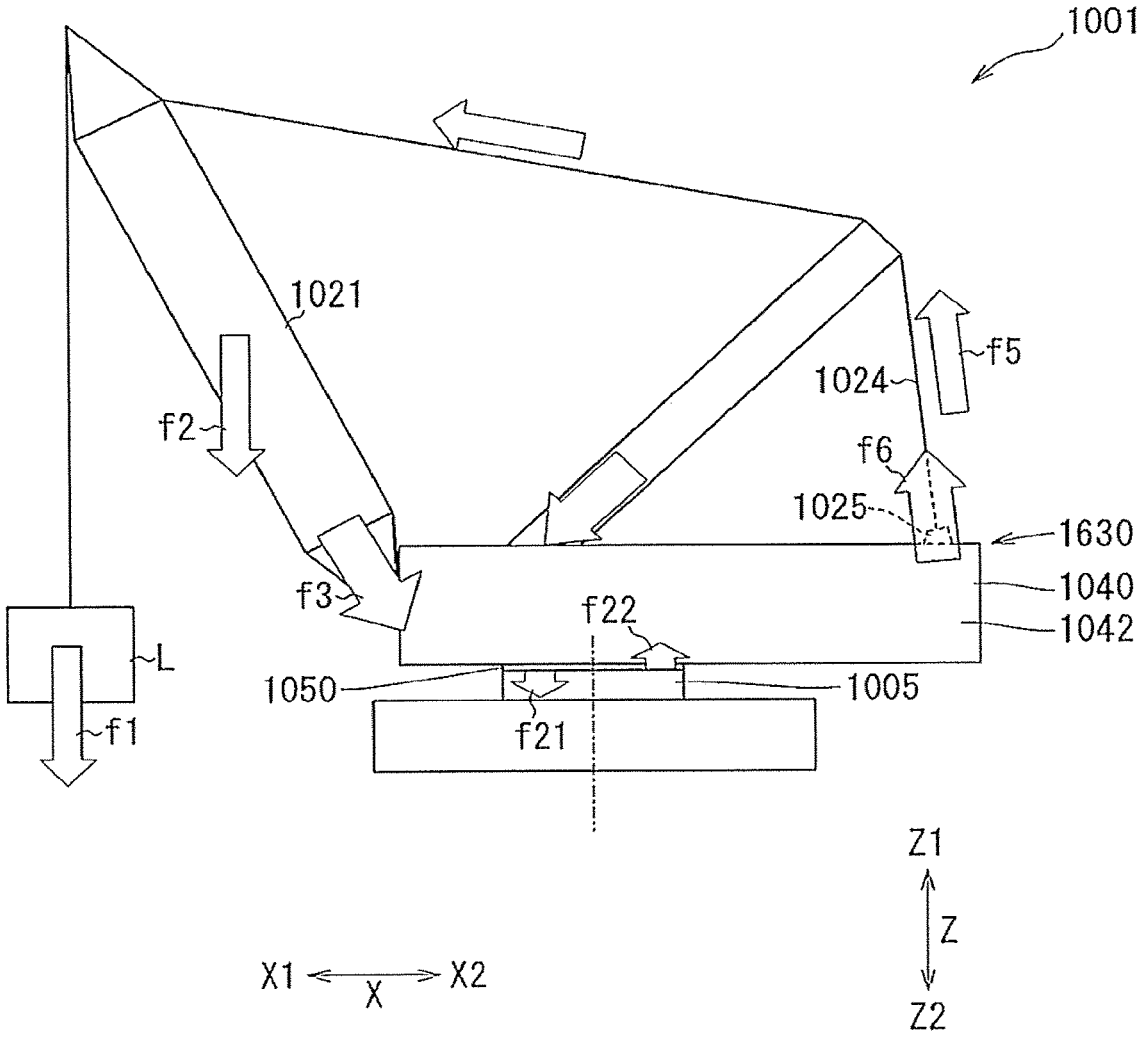
FIG. 17 is a schematic view of the conventional mobile crane 1001, seen from the machine-width direction Y.

Referring to FIG. 15 and FIG. 16, the difference of an upper body 830 of an eighth embodiment from the first embodiment will be described. As shown in FIG. 15, the force dispersing member 860 of the eighth embodiment is the force dispersing member 60 (see FIG. 3) of the first embodiment with a honeycomb part 868 added inside.

The force dispersing member 860 is configured to transmit the force from the side plate 42 (intersecting side plate) to the force dispersion target region 55 via a large number of routes. The force dispersing member 860 includes a container-shaped part 60*b* and the honeycomb part 868. The container-shaped part 60*b* is similar to the force dispersing member 60 (see FIG. 3) of the first embodiment. The container-shaped part 60*b* may be similar to the force dispersing member 260 or the like (see FIG. 7 or the like) of the second to seventh embodiments.

The honeycomb part 868 is arranged inside the container-shaped part 60*b*. The honeycomb part 868 is configured of a plurality of (e.g., three or more) vertical-plate members 163. The honeycomb part 868 is arranged at least on the upper side Z1 of (immediately above) the force dispersion target region 55 (and the plurality of vertical-plate members 163 are fixed on the force dispersion target region 55). The honeycomb part 868 may be arranged (fixed) in a region other than the force dispersion target region 55 among the bearing seat surface 50. The honeycomb part 868 is arranged throughout the inside of the container-shaped part 60*b*, for example. As shown in FIG. 16, the honeycomb part 868 has a shape extending continuously from a portion (the upper plate 65) of the container-shaped part 60*b* (respective vertical plates 63*i* and 63*o*) on the upper side Z1 to reach a portion (the bottom plate 61) on the lower side Z2. The end part of the honeycomb part 868 on the upper side Z1 is joined to the upper plate 65. The end part of the honeycomb part 868 on the lower side Z2 is joined to the bottom plate 61. In the case where the bottom plate 61 is absent in the container-shaped part 60*b*, the end part of the honeycomb part 868 on the lower side Z2 is joined to the bearing seat surface 50 shown in FIG. 15. The end part of the honeycomb part 868 on the inside in the bearing radial direction is joined to the inside vertical plate 63*i*, and the end part of the honeycomb part 868 on the outside in the bearing radial direction is joined to the outside vertical plate 63*o*. The honeycomb part 868 has a plurality of hollow polygons in section when seen from the up-down direction Z. The "polygons" are hexagons, for example, or may be triangles or quadrilaterals (not shown), for example.

(Effect 5)

The effect of the upper body 830 of the eighth embodiment shown in FIG. 15 will be described. [Configuration 5-1] As shown in FIG. 16, the force dispersing member 860 includes the honeycomb part 868 provided from the portion on the upper side Z1 up to the portion on the lower side Z2 in the container-shaped part 60*b*. [Configuration 5-2] As shown in FIG. 15, the honeycomb part 868 includes the plurality of vertical-plate members 163 fixed to the force dispersion target region 55. [Configuration 5-3] The honeycomb part 868 has a plurality of hollow polygons in section when seen from the up-down direction Z.

(Effect 5-1)

With [Configuration 5-1] and [Configuration 5-2] described above, the force is dispersed and transmitted to the force dispersion target region 55 from the side plate 42 (intersecting side plate) shown in FIG. 15 via the plurality of vertical-plate members 163. Thus, a local increase, at the side-plate intersecting position 42*a* or the like, of the force transmitted to the bearing seat surface 50 from the side plate 42 is suppressed. Thus, increasing the plate thickness of the bearing seat surface 50 is not necessary, and the maximum value of the axial force on the bearing bolt 6 is reduced.

(Effect 5-2)

With [Configuration 5-2] and [Configuration 5-3] described above, the area of a fixed portion of the bearing seat surface 50 and the force dispersing member 860 in the force dispersion target region 55 increases, compared to a case where the honeycomb part 868 is absent. Thus, the stress that occurs in the bearing seat surface 50 is further dispersed, and therefore a local increase in the axial force on the bearing bolt 6 is suppressed.

Other Modified Examples

The respective embodiments described above can be modified in various ways.

For example, the components of the respective embodiments may be combined. For example, the inverted V-shaped part 364 of the third embodiment shown in FIG. 8 may be applied to the annular force dispersing member 60 of the first embodiment shown in FIG. 3. The force dispersing member 360 including the inverted V-shaped part 364 of the third embodiment shown in FIG. 8 may be configured in a polygonal shape, seen from the up-down direction Z, as in the fourth embodiment shown in FIG. 9. The annular force dispersing member 60 of the first embodiment shown in FIG. 3 may be absent in a position of the middle part of the bearing seat surface 50 in the machine-width direction Y, as in the seventh embodiment shown in FIG. 12. There may be a combination of the first embodiment shown in FIG. 3 in which the vertical plate 63 is fixed to the bearing seat surface 50 while avoiding the force dispersion target region 55 and a portion of the eighth embodiment shown in FIG. 15 in which the plurality of vertical-plate members 163 (honeycomb part 868) are fixed to the force dispersion target region 55. For example, it may be such that one side (e.g., right side) with respect to the straight line Xs is configured as in the first embodiment, and the other side (e.g., left side) is configured as in the eighth embodiment.

The force dispersing member 60 or the like (see FIG. 3 or the like) of the respective embodiments may be not provided further toward the front side X1 than the center of revolution 5*c* (than the straight line Ys).

Ninth Embodiment

Referring to FIG. 22 to FIG. 38, the difference of an upper body 930 of a ninth embodiment from the first embodiment will be described. In each figure, illustration of the force dispersing member 60 is omitted.

Figure 24:
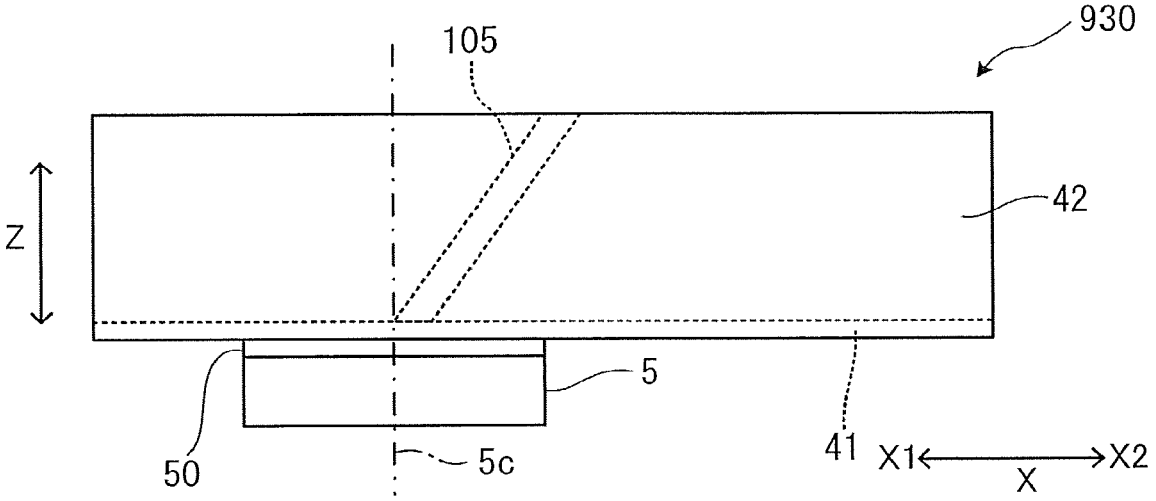
FIG. 24 is a side view of the upper body in the ninth embodiment.
Figure 25:
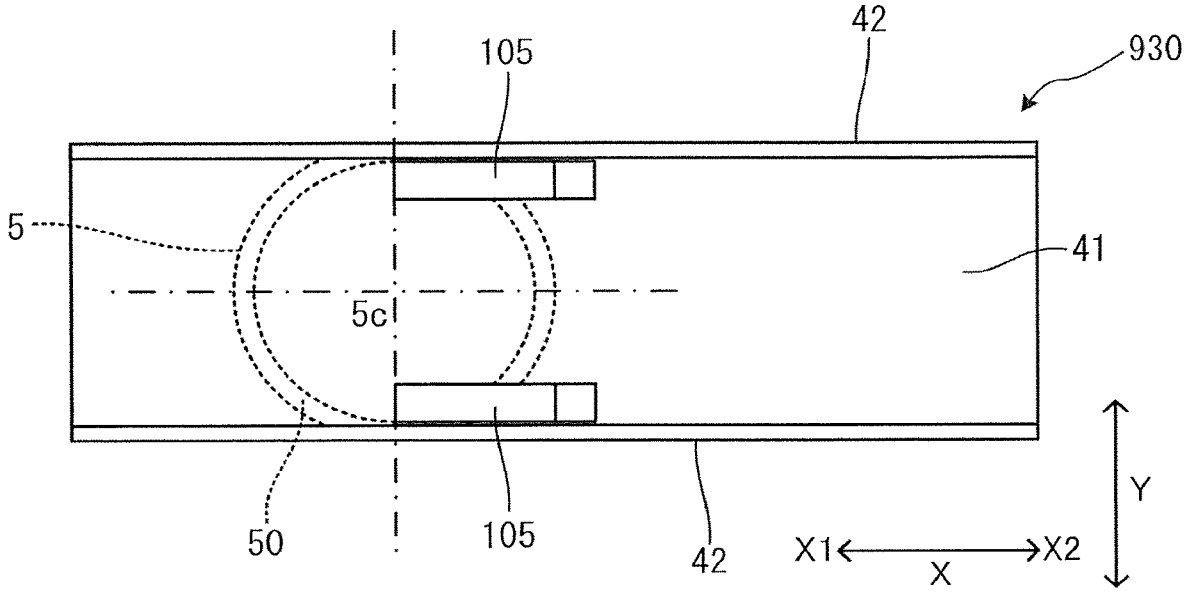
FIG. 25 is an upper view of the upper body in the ninth embodiment.

In this embodiment, a horizontal flange 104 is attached horizontally to each of the upper end surfaces of the pair of side plates 42. The upper end surface of the side plate 42 and the middle of the horizontal flange 104 are welded. The attachment position of the horizontal flange 104 is not limited as such, and the end surface of one of the left and right horizontal flanges 104 and the upper end surface of the side plate 42 may be welded. In FIG. 24 and FIG. 25, illustration of the horizontal flange 104 is omitted.

Figure 23:
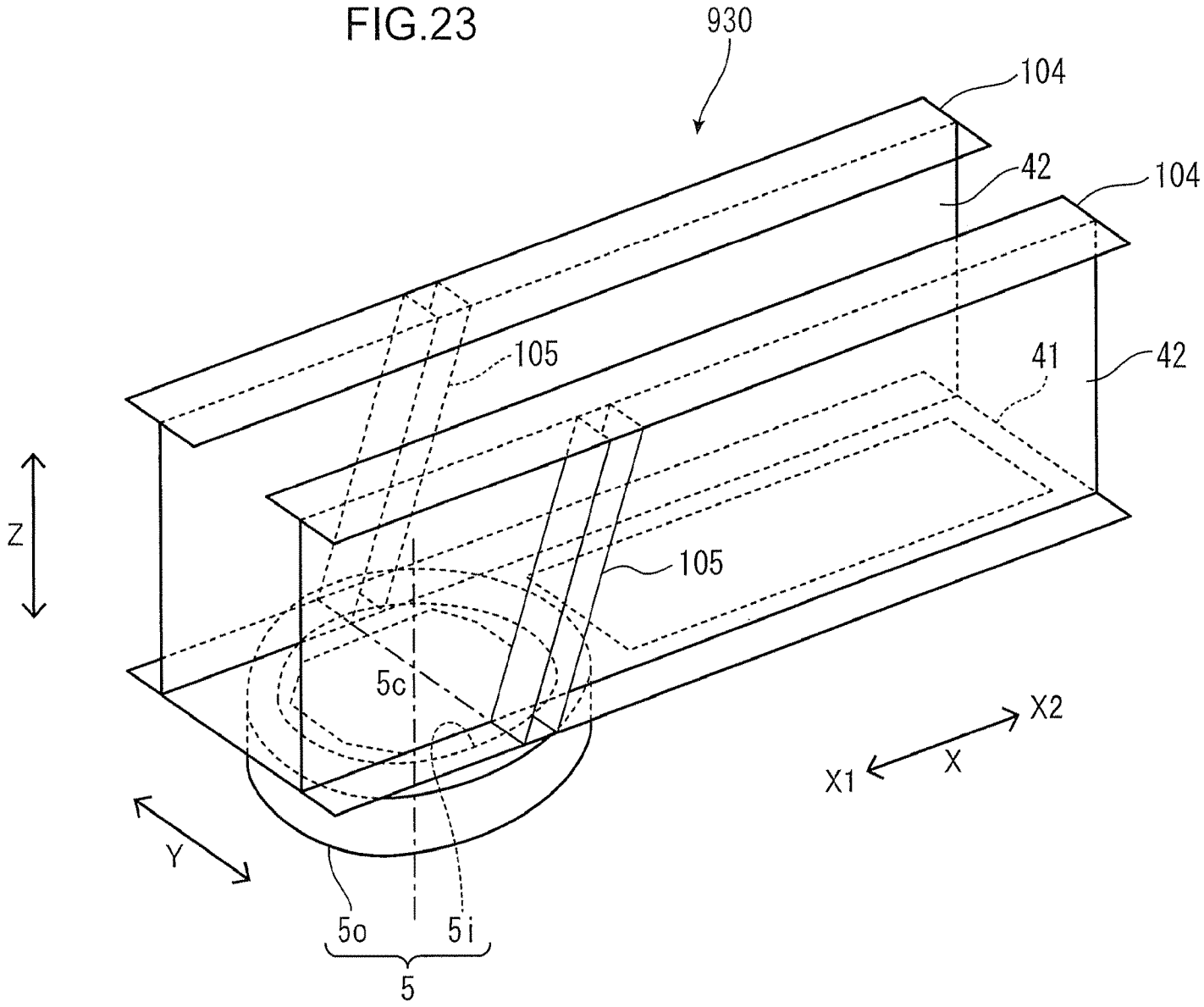
FIG. 23 is a view showing a modified example of the upper body shown in FIG. 22.

The swing frame 40 includes a pair of reinforcing members 105 attached to the respective side surfaces of the pair of side plates 42 opposing each other in the left-right direction Y. In this embodiment, each reinforcing member 105 is attached to the inner side surface of each of the pair of side plates 42. Note that, as shown in FIG. 23, each reinforcing member 105 may be attached to the outer side surface of each of the pair of side plates 42. A case where each reinforcing member 105 is attached to the inner side surface of each of the pair of side plates 42 will be described below. The pair of reinforcing members 105 is, as shown in FIG. 24, inclined from the lower front toward the upper rear in the mobile crane 1. The inclination angle of the reinforcing member 105 with respect to the horizontal direction is greater than or equal to 40° and less than or equal to 70°. The pair of reinforcing members 105 are, as shown in FIG. 25, arranged further toward the rear side than the center of revolution 5*c* of the swing bearing 5.

Figure 22:
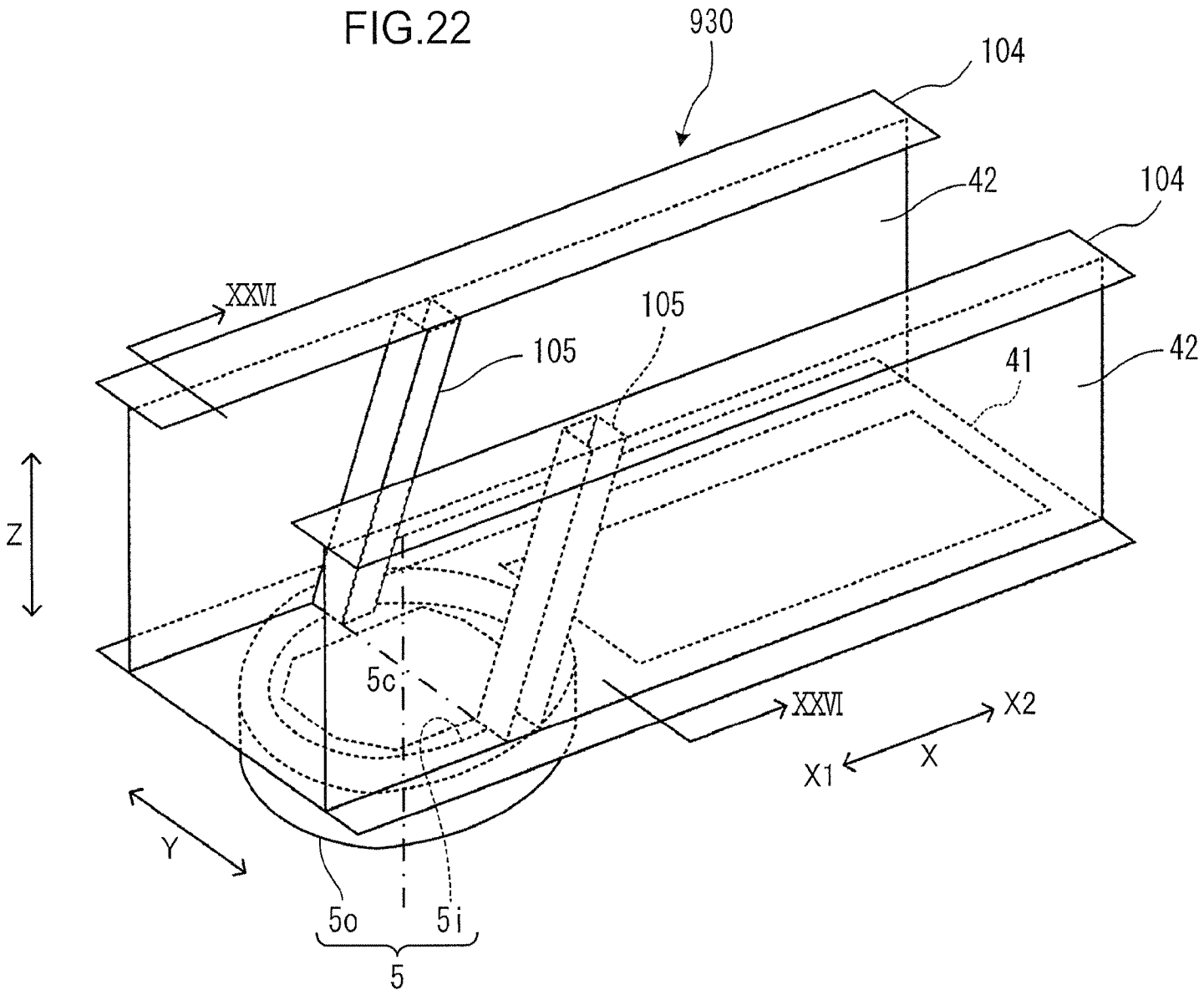
FIG. 22 is a perspective view of an upper body in a ninth embodiment.

In the up-down direction Z of the mobile crane 1, as shown in FIG. 22, the reinforcing member 105 is provided over the entire width of the side plate 42 in the up-down direction Z. The lower end of the pair of reinforcing members 105 is welded (secured) to the bottom part 41 of the swing frame 40.

Figure 26:
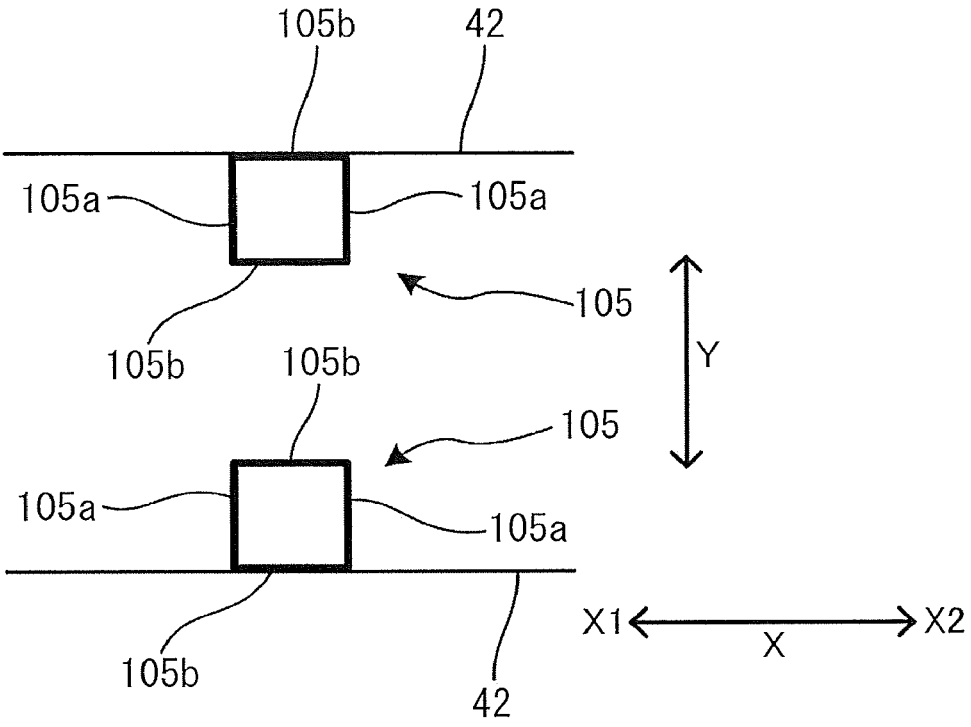
FIG. 26 is a sectional view on XXVI-XXVI in FIG. 22.

As shown in FIG. 26 on XXVI-XXVI in FIG. 22, the pair of reinforcing members 105 are angled materials that are a hollow quadrilateral in horizontal section. That is, each reinforcing member 105 includes a pair of plate materials 105*a* each arranged along the direction orthogonal to the side surface of the side plate 42 and a pair of connecting plates 105*b* connecting the pair of plate materials 105*a*. Of the respective connecting plates 105*b*, the connecting plate 105*b* located on the side plate 42 side is welded to the side plate 42 in a state of adhesion with the side surface of the side plate 42. Each reinforcing member 105 is disposed in such a manner as not to come into contact with unillustrated equipment components such as an engine or pipe that are arranged near the side plate 42.

Of the pair of connecting plates 105*b*, the connecting plate 105*b* adhered to the side plate 42 may be absent. That is, the configuration may be such that, seen in horizontal section, a closed space is formed between the reinforcing member 105 and the side plate 42.

In FIG. 22, each reinforcing member 105 may include at least one of a top plate parallel to the upper end surface of the side plate 42 and a bottom plate parallel to the lower end surface of the side plate 42. In the case where each reinforcing member 105 includes a top plate, the top plate is welded to the horizontal flange 104 in a state of adhesion with the lower surface of the horizontal flange 104. In the case where each reinforcing member 105 includes a bottom plate, the bottom plate is welded to the bottom part 41 in a state of adhesion with the bottom part 41 of the swing frame 40.

Upon normal crane operation, as shown in FIG. 1, the compressive load f21 acts on a portion of the swing bearing 5 on the front side X1, and the tensile load f22 acts on a portion of the swing bearing 5 on the rear side X2. As a result, the pair of side plates 42 is easily buckled above the swing bearing 5.

Figure 27:
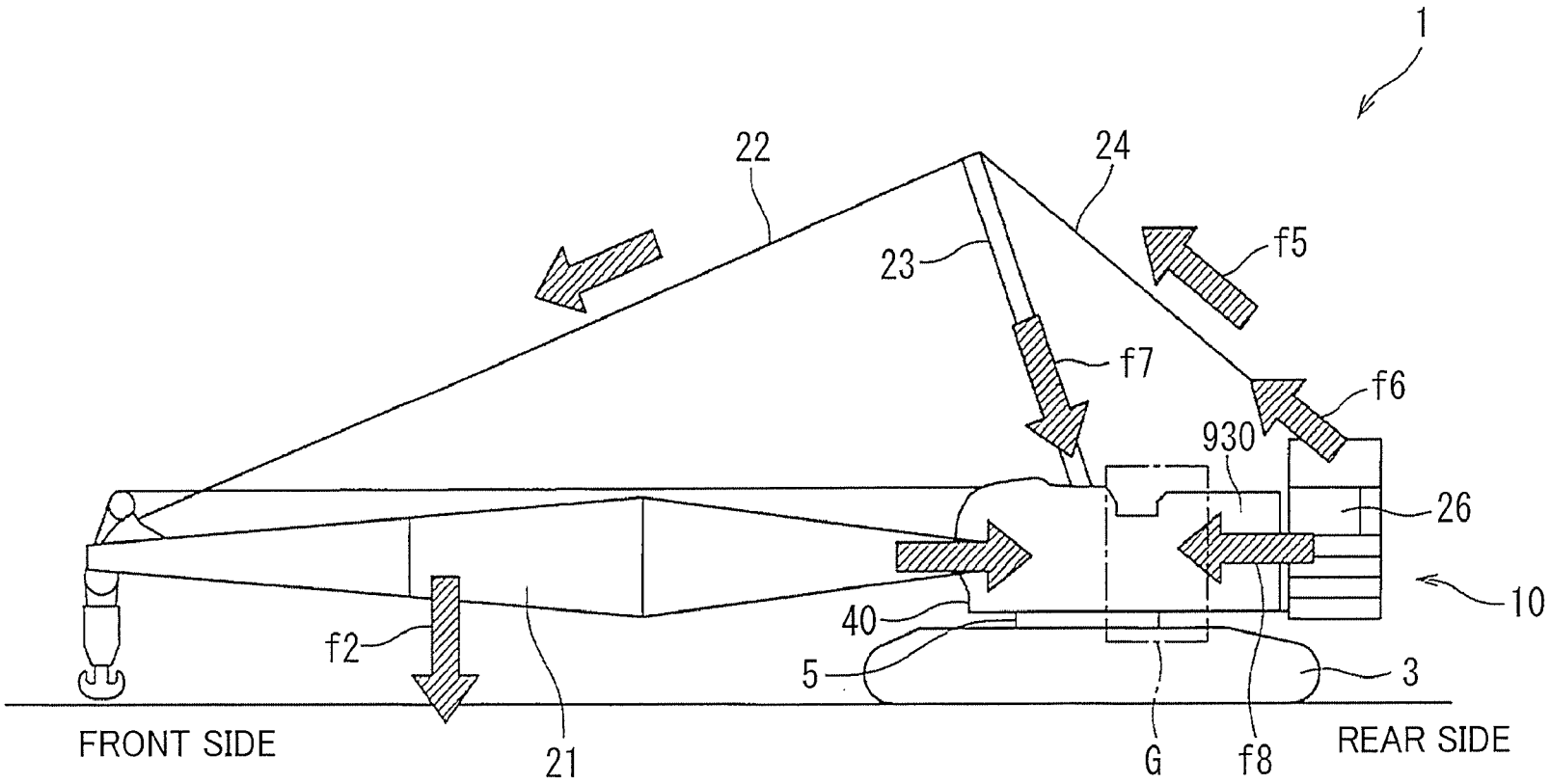
FIG. 27 is a side view of a crane when a boom is supporting itself.

As shown in FIG. 27, which is a side view, the force f6 in the upward direction and in the direction of the front side X1 that acts on the end part (lower spreader) of the swing frame 40 on the rear side increases, when the boom 21 that has been touching the ground is raised to support itself. Therefore, between a part where the lower spreader is attached and the bearing seat surface 50 (see FIG. 24) of the swing bearing 5, a compressive force f8 in the direction of the front side X1 that acts on the pair of side plates 42 of the swing frame 40 increases. As a result, buckling easily occurs in the pair of side plates 42.

Figure 28:
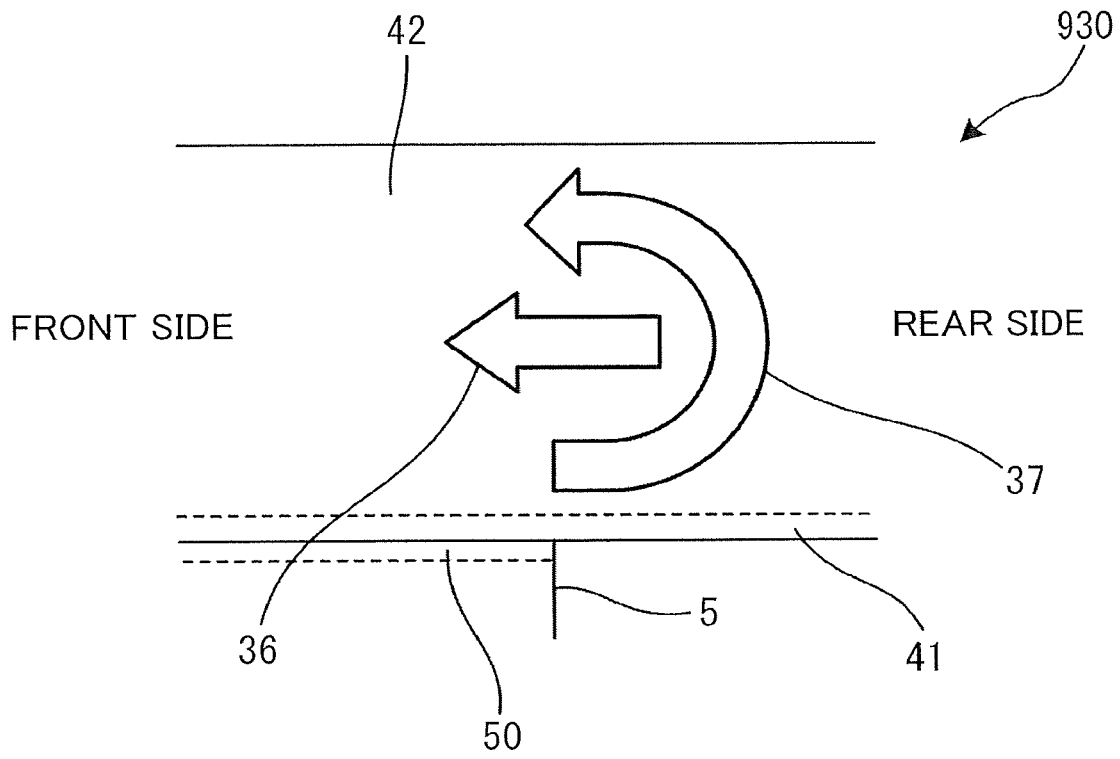
FIG. 28 is an illustrative view of the force that acts on a main part G in FIG. 27.

As shown in FIG. 28, which is an illustrative view of the force that acts on the main part Gin FIG. 27, the force f6 (see FIG. 27) in the upward direction and in the direction of the front side X1 causes a forward compressive force 36 and a bending 37 directed upward with a turn from below to act on the rear side in an area in which the swing bearing 5 and the swing frame 40 are fixed. Accordingly, a compressive shear force combining the compressive force 36 and the bending 37 acts on the rear side in the swing frame 40. The compressive shear force refers to a compressive force generated by shear deformation.

Thus, conventionally, buckling of the side plate 42 has been suppressed by providing a horizontal rib to the side plate 42 in the horizontal direction or providing a vertical rib in the vertical direction. However, the shear force received by the side plate 42 acts in the direction of shear (diagonal direction). Therefore, the direction of reinforcement by the horizontal rib or vertical rib differs from the direction of shear toward which a compressive load acts. There are limits to improving the buckling strength of the side plate 42 with the horizontal rib or vertical rib.

Thus, as shown in FIG. 22, the pair of reinforcing members 105 attached respectively to the side surfaces of the pair of side plates 42 are inclined gradually from the lower front toward the upper rear in the mobile crane 1 and arranged toward the rear side than the center of revolution 5*c* of the swing bearing 5. Accordingly, the direction of attachment of the reinforcing member 105 approximately matches the direction in which the compressive shear force acts, and therefore the buckling strength of the side plate 42 with respect to the compressive shear force can be improved efficiently.

By arranging the pair of reinforcing members 105 in an area on which a tensile load acts, i.e., an area toward the rear side than the center of revolution 5*c* of the swing bearing 5, the buckling strength of the side plate 42 with respect to the compressive shear force can be improved efficiently.

Accordingly, occurrence of buckling in the side plate 42 can be suppressed while suppressing an increase in weight.

By causing the direction of attachment of the reinforcing member 105 to approximately match the direction in which the compressive shear force acts, the stiffness of the side plate 42 with respect to shear deformation can be improved. As a result, the stiffness of the swing frame 40 with respect to torsional deformation can be improved.

By providing the reinforcing member 105 over the entire width of the side plate 42 in the up-down direction Z, the buckling strength of the side plate 42 with respect to the compressive shear force and the stiffness of the side plate 42 with respect to shear deformation can be improved over the entire width of the side plate 42 in the up-down direction Z.

By causing the inclination angle of the reinforcing member 105 with respect to the horizontal direction to be greater than or equal to 45° and less than or equal to 60°, the direction of attachment of the reinforcing member 105 can be caused to approximately match the direction in which the compressive shear force acts. Accordingly, the buckling strength of the side plate 42 with respect to the compressive shear force and the stiffness of the side plate 42 with respect to shear deformation can be improved efficiently.

By causing the reinforcing member 105 to be hollow in horizontal section, as shown in FIG. 26, the strength of the reinforcing member 105 can be improved while suppressing an increase in weight due to the reinforcing member 105. Accordingly, the buckling strength of the side plate 42 with respect to the compressive shear force and the stiffness of the side plate 42 with respect to shear deformation can be improved suitably.

Particularly, by arranging the plate material 105*a* along the direction orthogonal to the side surface of the side plate 42 and adjusting the width of the plate material 105*a* in the left-right direction Y in the reinforcing member 105, the strength of the reinforcing member 105 can be improved while suppressing an increase in weight due to the reinforcing member 105. Accordingly, the buckling strength of the side plate 42 with respect to the compressive shear force and the stiffness of the side plate 42 with respect to shear deformation can be improved suitably.

Even in the case where the connecting plate 105*b* of the pair of connecting plates 105*b* that is adhered to the side plate 42 is omitted, the strength of the reinforcing member 105 can be improved while suppressing an increase in weight due to the reinforcing member 105, by forming a closed space, seen in horizontal section, between the reinforcing member 105 and the side plate 42.

By welding the lower end of the reinforcing member 105 to the bottom part 41 as shown in FIG. 22, the stress that acts on the lower end of the reinforcing member 105 can be dispersed to the bottom part 41. Accordingly, the strength of the reinforcing member 105 can be improved.

(Buckling Evaluation)

Figure 29:
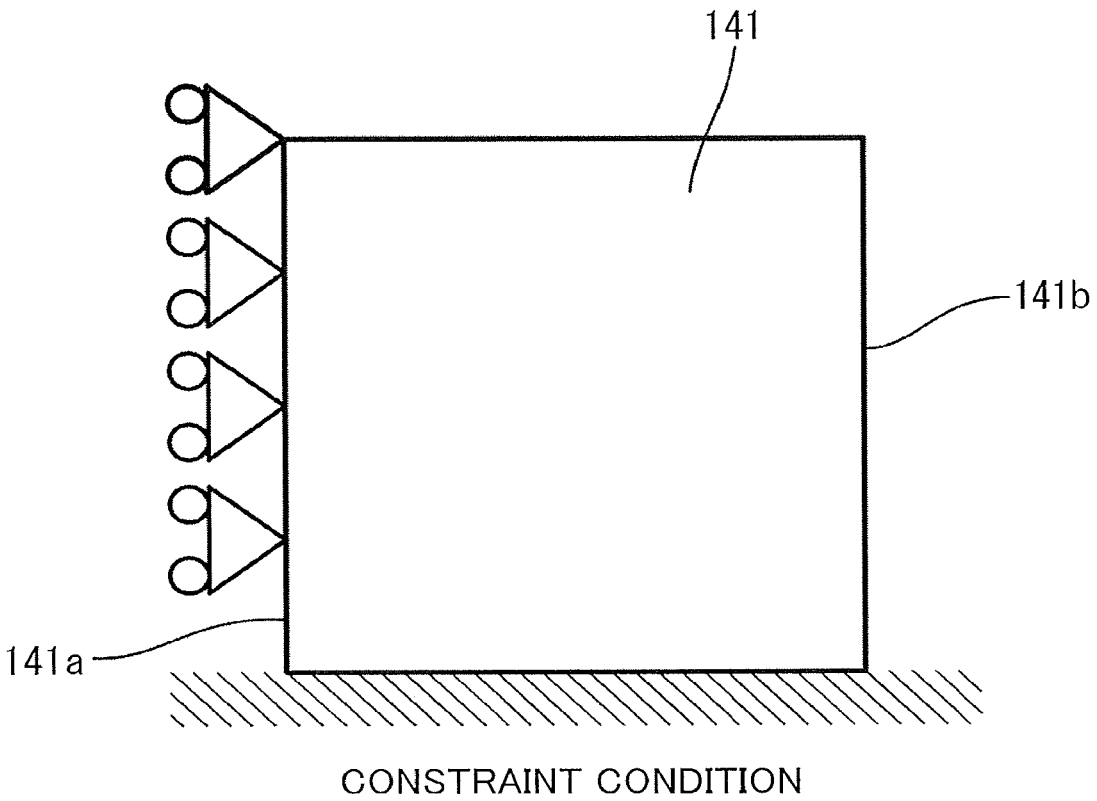
FIG. 29 is a view of a model showing a constraint condition.
Figure 30:
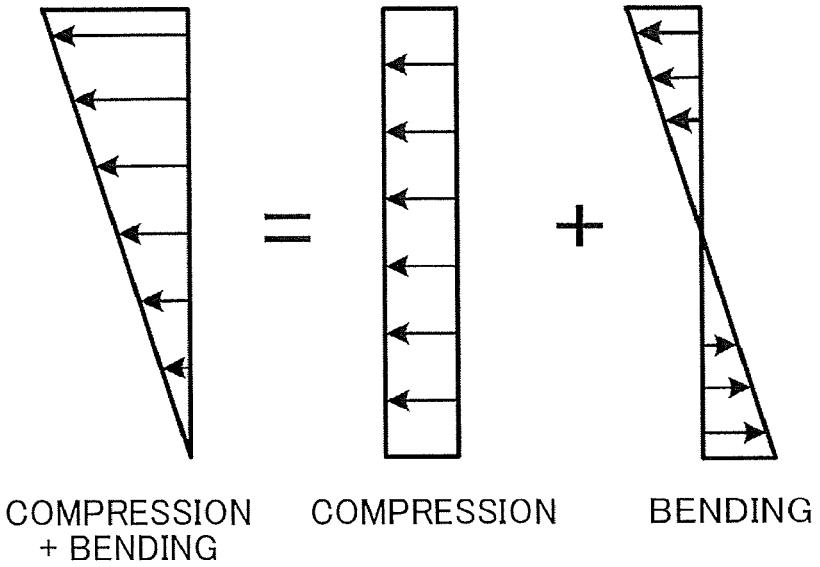
FIG. 30 is a view of a model showing a load condition.

Next, a buckling evaluation for a conventional example and this embodiment was performed, while varying the presence or absence of a rib that is the reinforcing member 105 or the direction of providing the rib. As shown in FIG. 29, which is a view of a model showing a constraint condition, a plate 141 of which the vertical length is 100 mm, the horizontal length is 100 mm, the thickness is 1 mm, and the volume is 10,000 $mm^3$ was used as a sample. As the constraint condition, a left edge 141*a* of the plate 141 was constrained. As shown in FIG. 30, which is a view of a model showing a load condition, a load combining a compressive load and a bending load was applied to a right edge 141*b* (see FIG. 29) of the plate 141.

Figure 31:
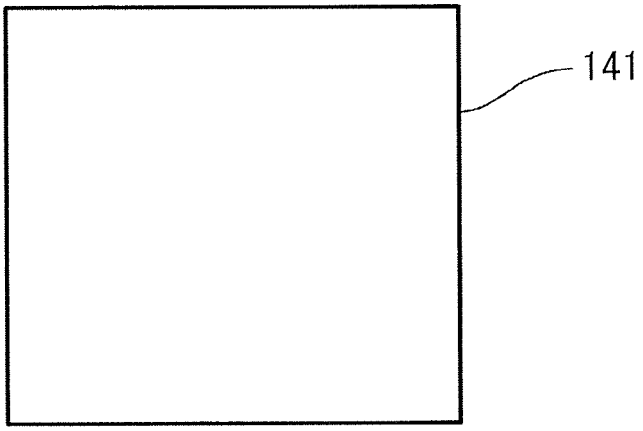
FIG. 31 is a view of a model for a sample not provided with a rib in a buckling evaluation.
Figure 32:
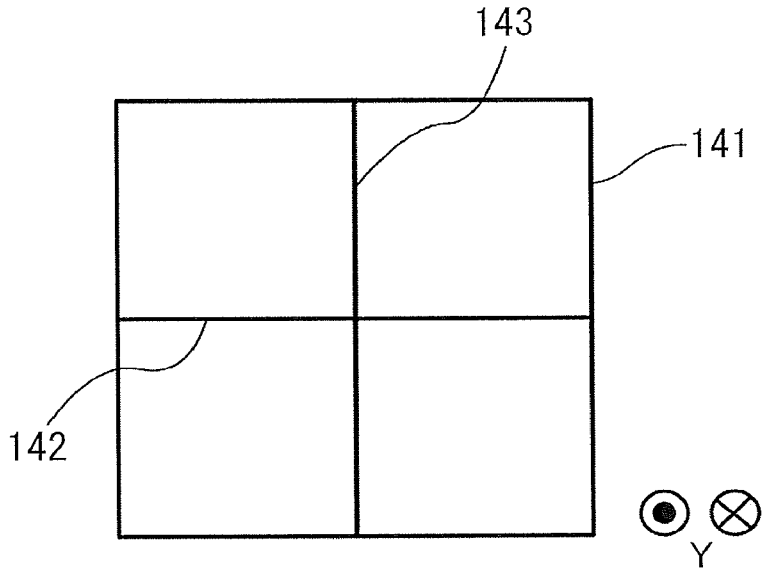
FIG. 32 is a view of a model for a sample provided with each of a horizontal rib and a vertical rib in a buckling evaluation.
Figure 33:
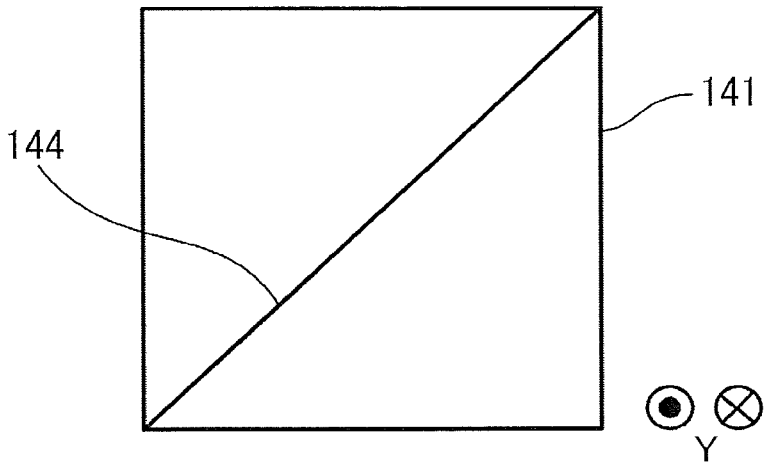
FIG. 33 is a view of a model for a sample provided with an inclined rib in a buckling evaluation.

Views of a model of the sample are shown in FIG. 31, FIG. 32, and FIG. 33. In the case where a rib (reinforcing member) is not provided to the plate 141 as shown in FIG. 31, the first buckling eigenvalue was "0.01434." In contrast, in the case where a horizontal rib 142 and a vertical rib 143 as a model of the conventional example are provided to the plate 141 as reinforcing members along respective center lines as shown in FIG. 32, the first buckling eigenvalue was "0.02810." This is a 96.0% increase with respect to the first buckling eigenvalue of the case where the rib is not provided to the plate 141. The horizontal rib 142 and the vertical rib 143 are 5 mm in width in the left-right direction Y (direction orthogonal to the plane of the paper), 1 mm in respective thicknesses (plate thicknesses), 200 mm in overall length, and 1000 $mm^3$ in volume.

In the case where an inclined rib 144 with a 45° inclination as a model of this embodiment is provided to the plate 141 as shown in FIG. 33, the first buckling eigenvalue was "0.02892." This is a 101.7% increase with respect to the first buckling eigenvalue of the case where the rib is not provided to the plate 141. This is a 2.9% increase with respect to the first buckling eigenvalue of the case where the horizontal rib 142 and the vertical rib 143 are each provided to the plate 141. The inclined rib 144 is 5 mm in width in the left-right direction Y (direction orthogonal to the plane of the paper), 1.4 mm in thickness (plate thickness), 141.4 mm in overall length, 990 $mm^3$ in volume, and approximately equivalent in weight to (99% in weight of) the horizontal rib 142 and the vertical rib 143.

As such, it can be seen that by providing a rib (reinforcing member) diagonally along the direction in which the compressive shear force acts, the buckling strength with respect to the compressive shear force can be improved efficiently.

Modified Example

Figure 34:
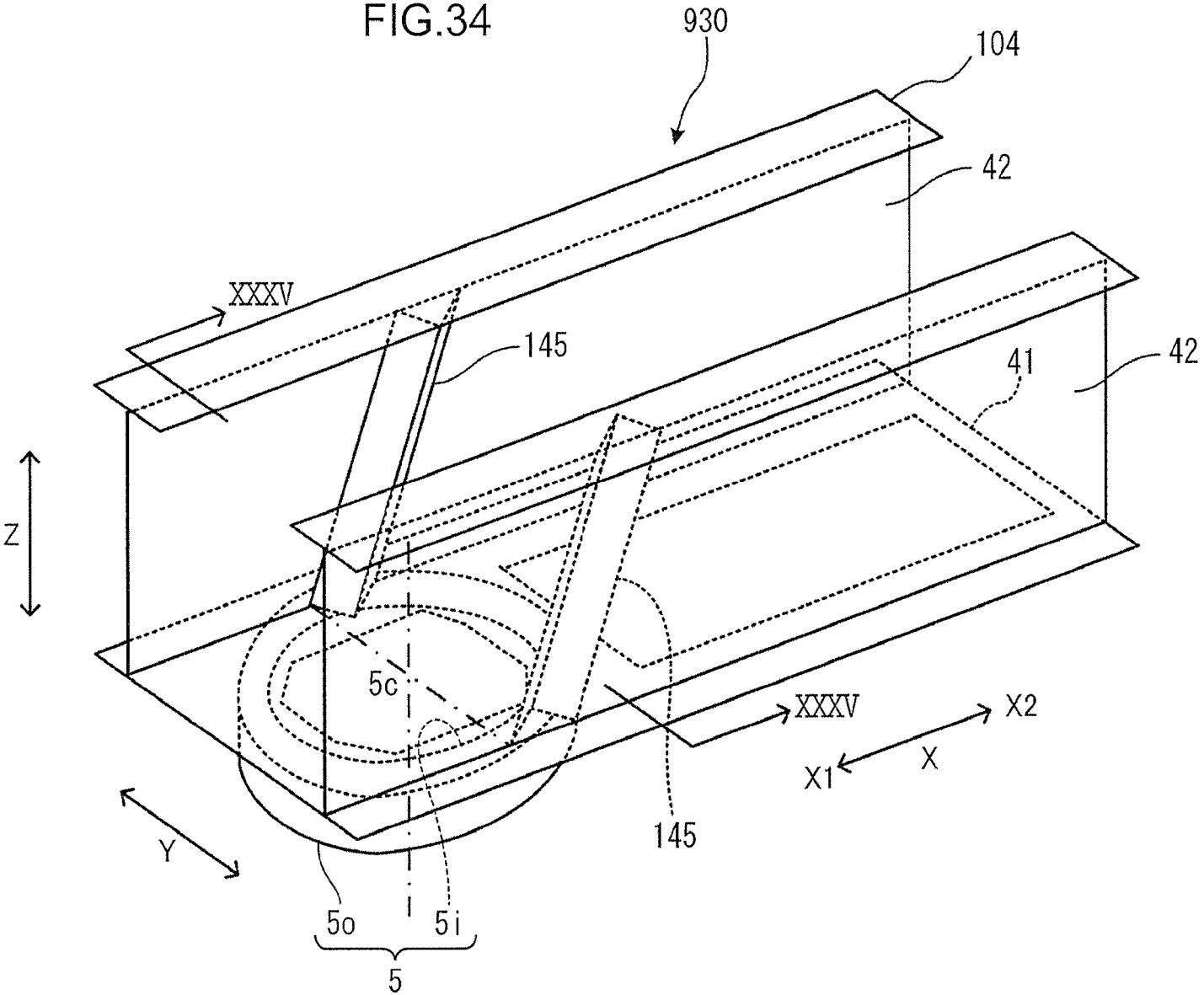
FIG. 34 is a perspective view of an upper body in a first modified example.
Figure 35:
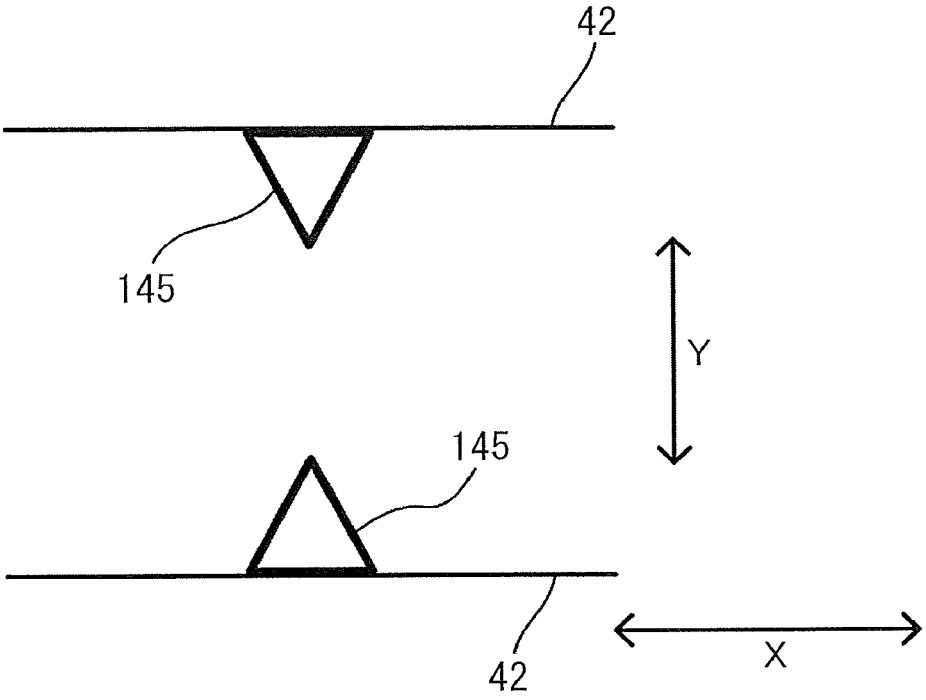
FIG. 35 is a sectional view on XXXV-XXXV in FIG. 34.

Next, modified examples will be described. In a first modified example, as shown in FIG. 34, the sectional shape of a pair of reinforcing members 145 includes a triangle in section. As shown in FIG. 35, which is a sectional view on XXXV-XXXV in FIG. 34, the pair of reinforcing members 145 is angled materials of which the section is a hollow triangle. Of three plate materials forming the triangle, a plate material parallel to the side plate 42 may be absent. That is, the configuration may be such that, seen in horizontal section, a closed space is formed between the reinforcing member 145 and the side plate 42.

Figure 36:
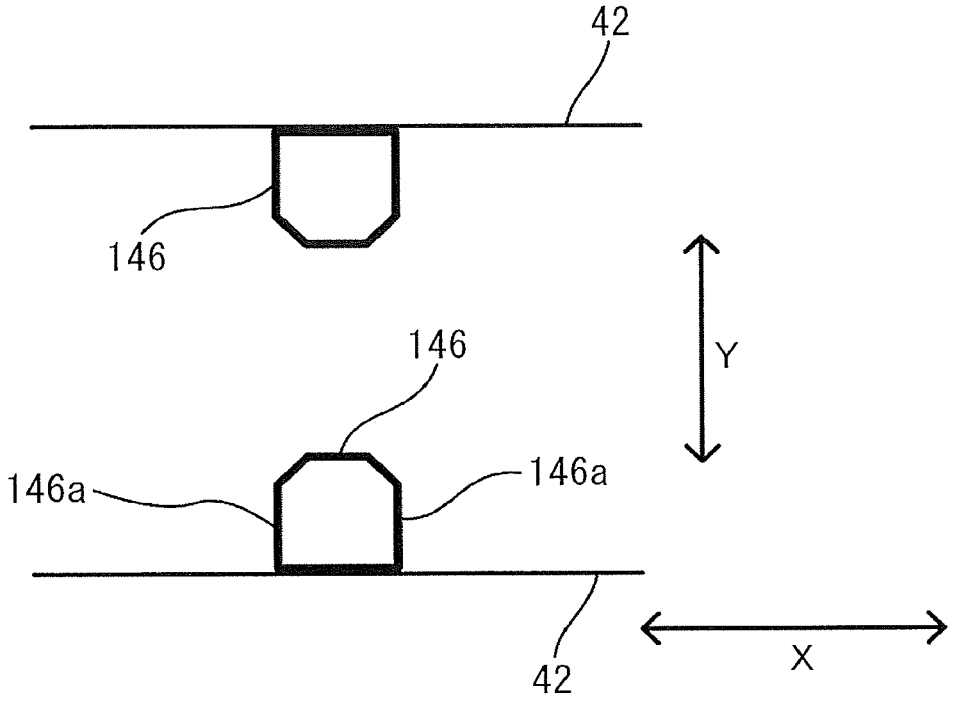
FIG. 36 is a view corresponding to FIG. 35 for a second modified example.

In a second modified example, as shown in FIG. 36, which is a view corresponding to FIG. 35, a pair of reinforcing members 146 includes angled materials of which the section is a hollow polygon. The reinforcing member 146 includes a pair of plate members 146*a* arranged along the direction orthogonal to the side surface of the side plate 42. Thus, the strength of the reinforcing member 146 can be improved while suppressing an increase in weight due to the reinforcing member 146. The configuration may be such that, seen in horizontal section, a closed space is formed between the reinforcing member 146 and the side plate 42.

Figure 37:
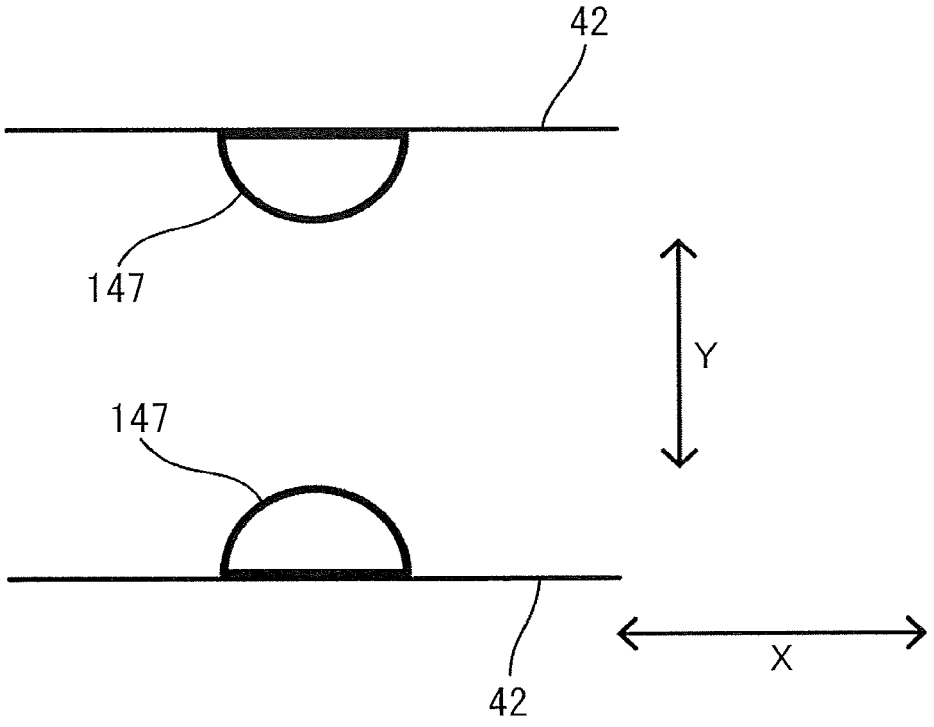
FIG. 37 is a view corresponding to FIG. 35 for a third modified example.

In a third modified example, as shown in FIG. 37, which is a view corresponding to FIG. 35, a pair of reinforcing members 147 includes pipes of which the section is a hollow semicircle. The configuration may be such that, seen in horizontal section, a closed space is formed between the reinforcing member 147 and the side plate 42.

Figure 38:
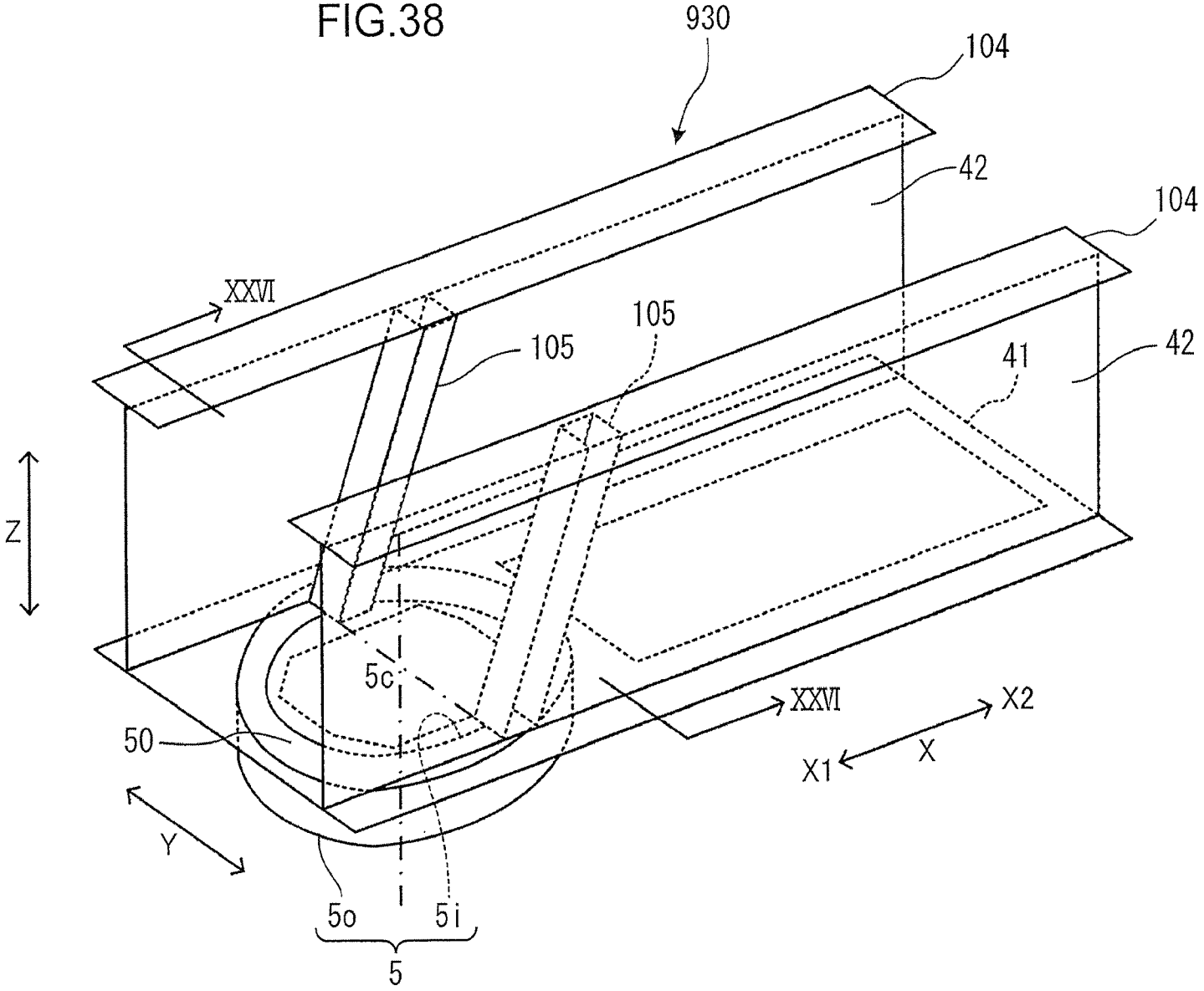
FIG. 38 is a perspective view of an upper body in a fourth modified example.

In a fourth modified example, as shown in FIG. 38, the lower end of the reinforcing member 105 is welded (secured) to the upper surface of the annular bearing seat surface 50 attached to the upper surface of the swing bearing 5. That is, the bottom part 41 of the swing frame 40 is provided on the inside of and around the bearing seat surface 50, and the upper surface of the bearing seat surface 50 is exposed. A part of the lower end of the side plate 42 is welded to the bearing seat surface 50. That is, the part of the side plate 42 is provided to stand on the bearing seat surface 50. With such a configuration as well, the stress that acts on the lower end of the reinforcing member 105 can be dispersed to the bearing seat surface 50, and therefore the strength of the reinforcing member 105 can be improved.

(Effect)

With the upper body 930 according to this embodiment, as described above, the pair of reinforcing members 105 attached respectively to the side surfaces of the pair of side plates 42 are, as shown in FIG. 22, inclined from the lower front toward the upper rear and arranged toward the rear side than to the center of revolution 5*c* of the swing bearing 5. Accordingly, the direction of attachment of the reinforcing member 105 approximately matches the direction in which the compressive shear force acts, and therefore the buckling strength of the side plate 42 with respect to the compressive shear force can be improved efficiently. By arranging the pair of reinforcing members 105 toward the rear side than the center of revolution 5*c* of the swing bearing 5, the buckling strength of the side plate 42 with respect to the compressive shear force can be improved efficiently. Accordingly, occurrence of buckling in the side plate 42 can be suppressed while suppressing an increase in weight. By causing the direction of attachment of the reinforcing member 105 to approximately match the direction in which the compressive shear force acts, the stiffness of the side plate 42 with respect to shear deformation can be improved. As a result, the stiffness of the swing frame 40 with respect to torsional deformation can be improved.

By providing the reinforcing member 105 over the entire width of the side plate 42 in the up-down direction Z, the buckling strength with respect to the compressive shear force and the stiffness with respect to shear deformation can be improved over the entire width of the side plate 42 in the up-down direction Z.

By causing the inclination angle of the reinforcing member 105 with respect to the horizontal direction to be greater than or equal to 45° and less than or equal to 60°, the direction of attachment of the reinforcing member 105 can be caused to approximately match the direction in which the compressive shear force acts. Accordingly, the buckling strength with respect to the compressive shear force and the stiffness with respect to shear deformation can be improved efficiently.

By arranging the plate material 105*a* along the direction orthogonal to the surface of the side plate 42 and adjusting the width of the plate material 105*a* in the left-right direction Y as shown in FIG. 26, the strength of the reinforcing member 105 can be improved while suppressing an increase in weight due to the reinforcing member 105. Accordingly, the buckling strength with respect to the compressive shear force and the stiffness with respect to shear deformation can be improved suitably.

By causing the reinforcing member 105 to be hollow in horizontal section, the strength of the reinforcing member 105 can be improved while suppressing an increase in weight due to the reinforcing member 105.

Seen in horizontal section, a closed space may be formed between the reinforcing member 105 and the side plate 42. This can also improve the strength of the reinforcing member 105 while suppressing an increase in weight due to the reinforcing member 105.

By welding the lower end of the reinforcing member 105 to the bottom part 41 as shown in FIG. 24, the stress that acts on the lower end of the reinforcing member 105 can be dispersed to the bottom part 41. Accordingly, the strength of the reinforcing member 105 can be improved.

As shown in FIG. 38, the lower end of the reinforcing member 105 may be welded to the bearing seat surface 50. This can also cause the stress that acts on the lower end of the reinforcing member 105 to be dispersed to the bearing seat surface 50, and therefore the strength of the reinforcing member 105 can be improved.

Tenth Embodiment (Configuration of Swing Frame)

Figure 39:
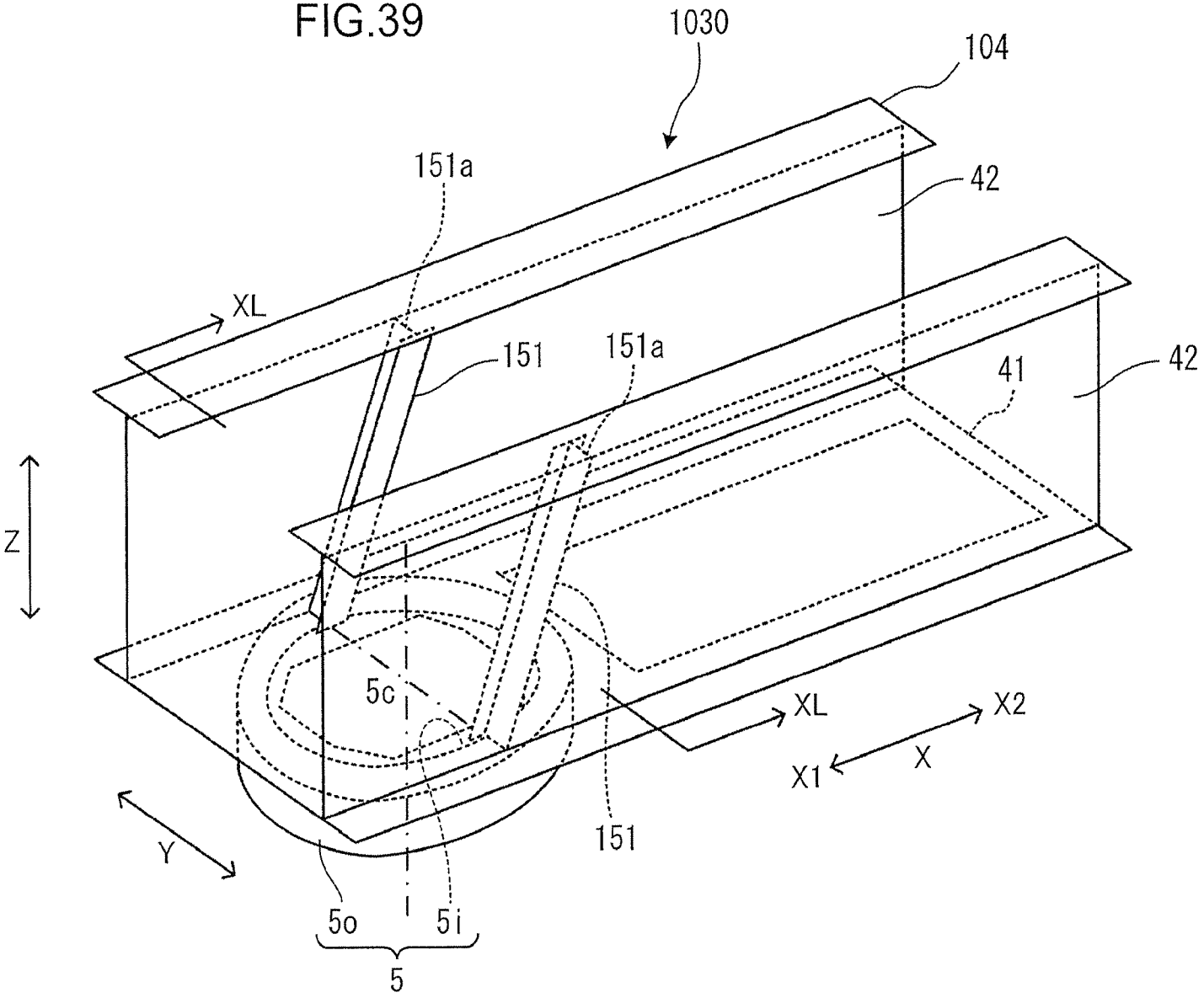
FIG. 39 is a perspective view of an upper body in a tenth embodiment.
Figure 40:
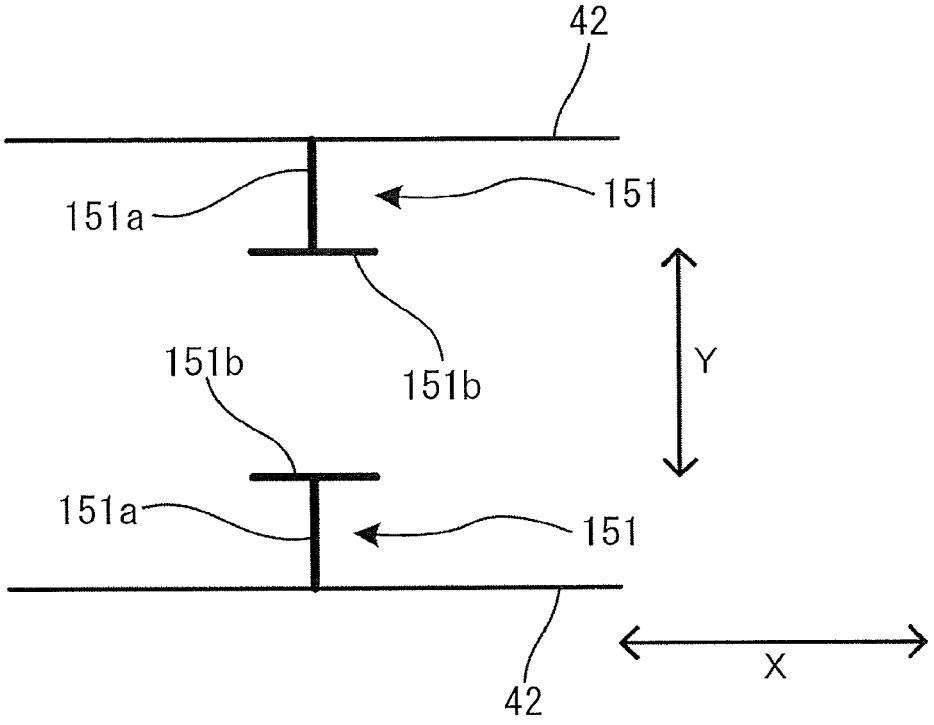
FIG. 40 is a sectional view on XL-XL in FIG. 39.

Next, the difference of an upper body 1030 according to a tenth embodiment of the present invention from the ninth embodiment will be described. The difference of the upper body 1030 of this embodiment from the upper body 930 of the ninth embodiment is the shape of respective reinforcing members 151. As shown in FIG. 39, in this embodiment, the respective reinforcing members 151 each include one plate material 151*a* arranged along the direction orthogonal to the side surface of the pair of side plates 42. That is, as shown in FIG. 40, which is a sectional view on XL-XL in FIG. 39, the reinforcing member 151 is not hollow in horizontal section, and a closed space is not formed between the reinforcing member 151 and the side plate 42. In respective figures illustrating this embodiment as well, illustration of the force dispersing member 60 is omitted.

Each reinforcing member 151 includes a flange 151*b* attached to the end surface of the plate material 151*a* on the inside. The end surface of the plate material 151*a* on the inside and the middle of the flange 151*b* are welded. With the flange 151*b*, the strength of the reinforcing member 151 is improved. As described above, equipment components such as an engine or pipe, not shown, are arranged near the side plate 42. By causing the reinforcing member 151 to be not hollow in horizontal section and not forming a closed space between the reinforcing member 151 and the side plate 42, space occupied by the reinforcing member 151 can be reduced. Accordingly, interference of each reinforcing member 151 with the equipment components is suppressed.

Modified Example

Figure 41:
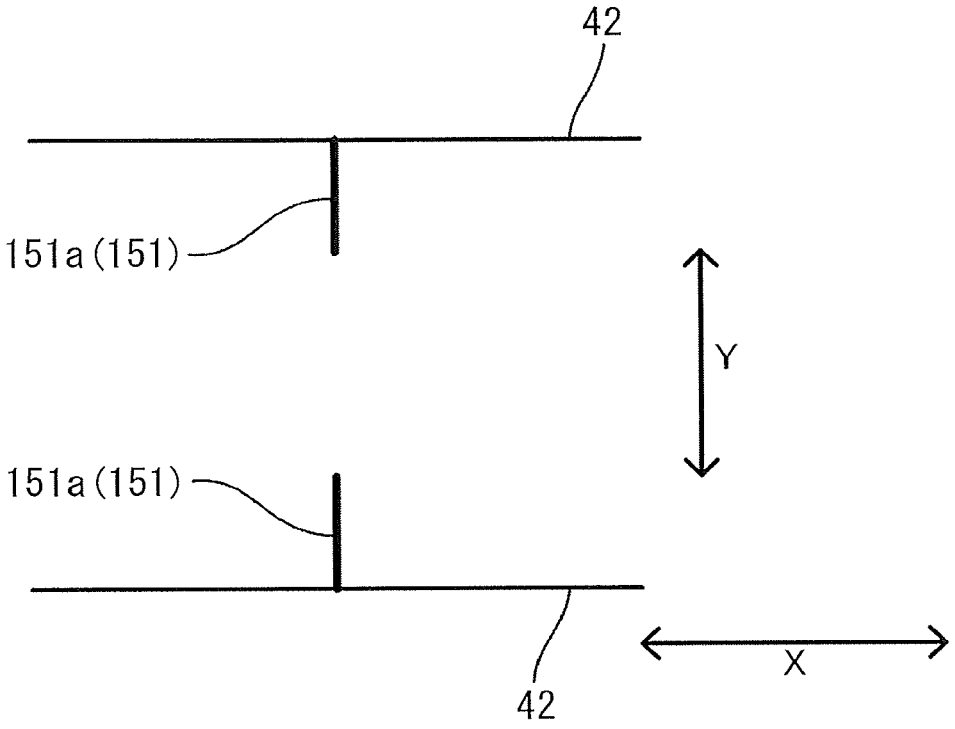
FIG. 41 is a view corresponding to FIG. 40 for a fifth modified example.

Next, modified examples will be described. In a fifth modified example, as shown in FIG. 41, which is a view corresponding to FIG. 40, the reinforcing member 151 is configured of only the plate material 151*a*.

Figure 42:
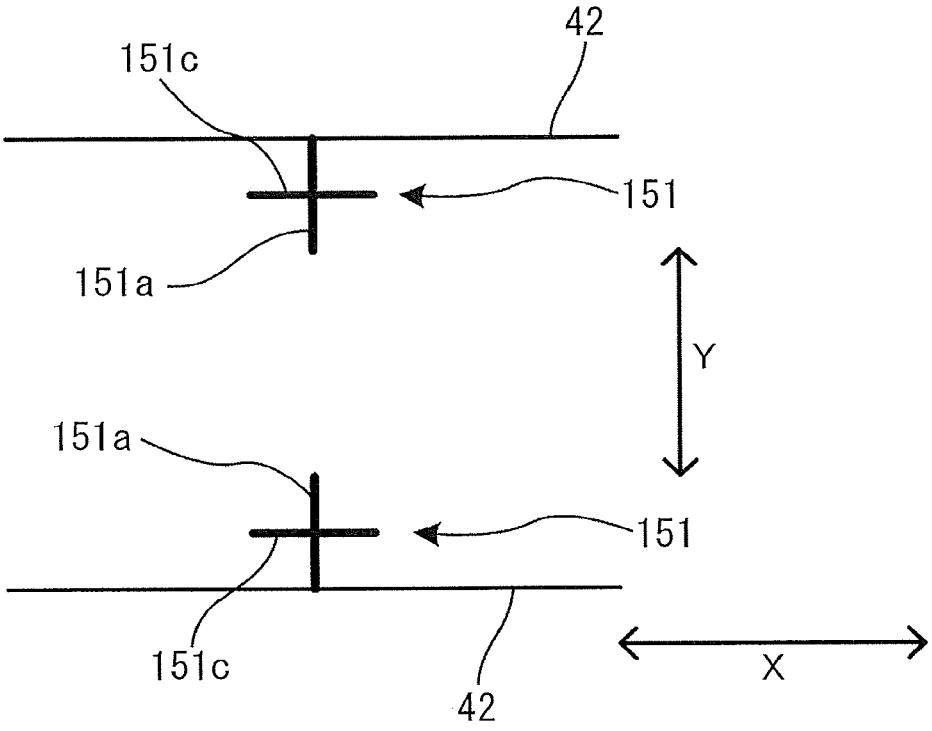
FIG. 42 is a view corresponding to FIG. 40 for a sixth modified example.

In a sixth modified example, as shown in FIG. 42, which is a view corresponding to FIG. 40, the reinforcing member 151 includes a plate material 151*c* intersecting the plate material 151*a*. The plate material 151*c* may be provided with a slit into which the plate material 151*a* is fitted or may be formed of a pair of flanges attached respectively to two surfaces of the plate material 151*a*. With the plate material 151*c*, the strength of the reinforcing member 151 can be improved.

Figure 43:
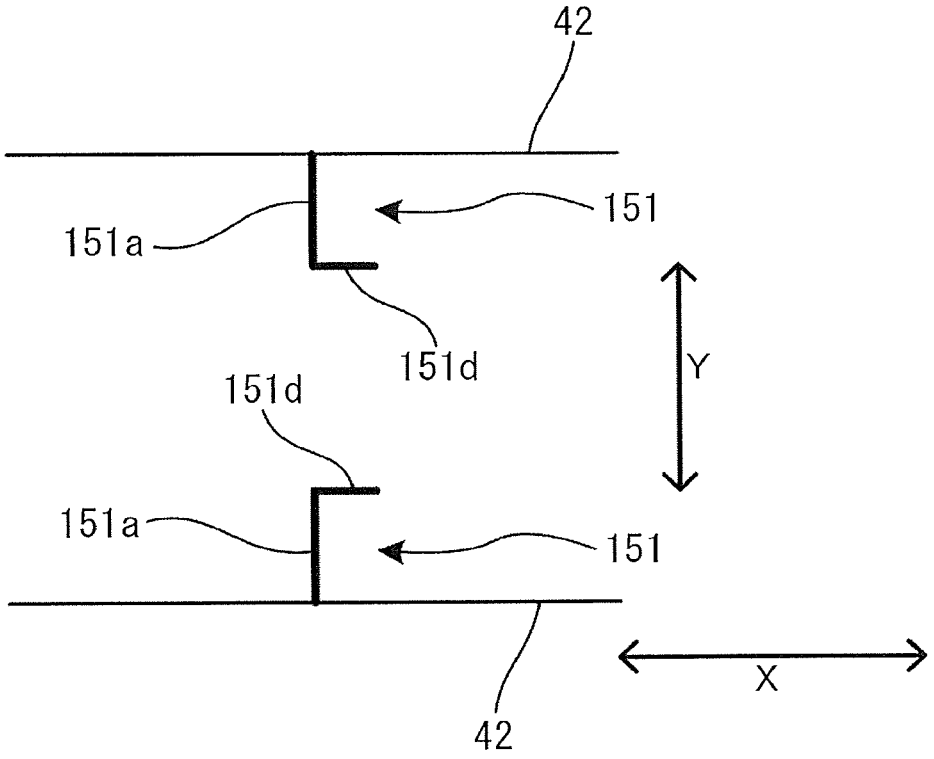
FIG. 43 is a view corresponding to FIG. 40 for a seventh modified example.

In a seventh modified example, as shown in FIG. 43, which is a view corresponding to FIG. 40, the reinforcing member 151 includes a flange 151*d* of which the front end is attached to the end surface of the plate material 151*a* on the inside. The flange 151*d* is provided along the front-back direction X, and the end surface of the plate material 151*a* on the inside and the front end of the flange 151*d* are welded. With the flange 151*d*, the strength of the reinforcing member 151 can be improved.

Figure 44:
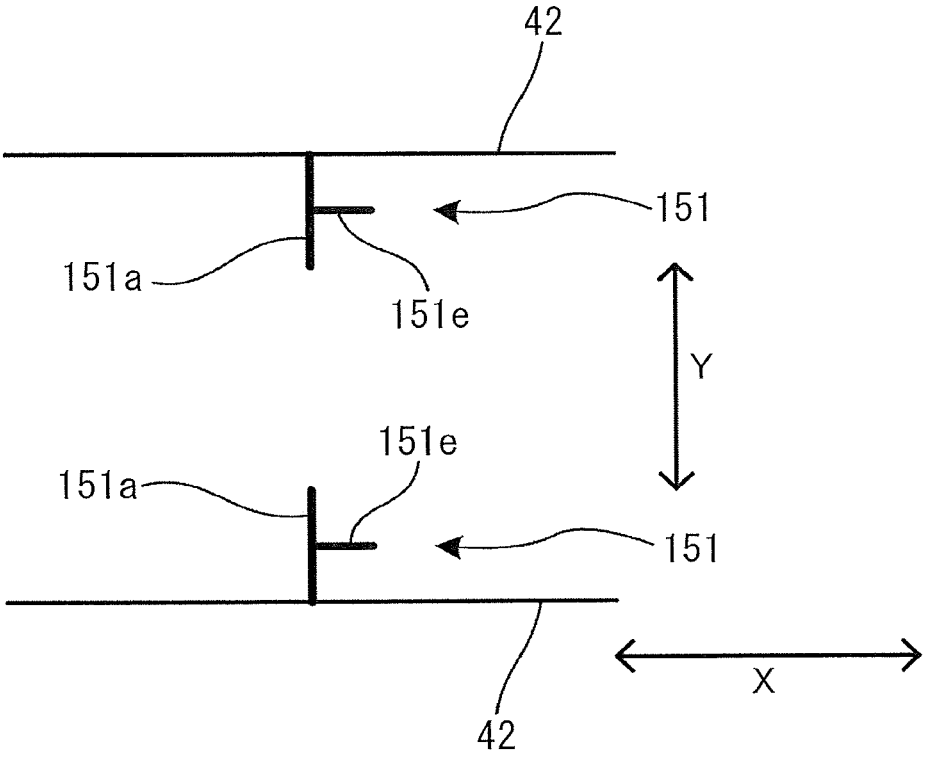
FIG. 44 is a view corresponding to FIG. 40 for an eighth modified example.

In an eighth modified example, as shown in FIG. 44, which is a view corresponding to FIG. 40, the reinforcing member 151 includes a flange 151*e* of which the front end is attached to middle of the side surface of the plate material 151*a* on the rear side. The flange 151*e* is provided along the front-back direction X, and the middle of the side surface of the plate material 151*a* on the rear side and the front end of the flange 151*e* are welded. With the flange 151*e*, the strength of the reinforcing member 151 can be improved.

Figure 45:
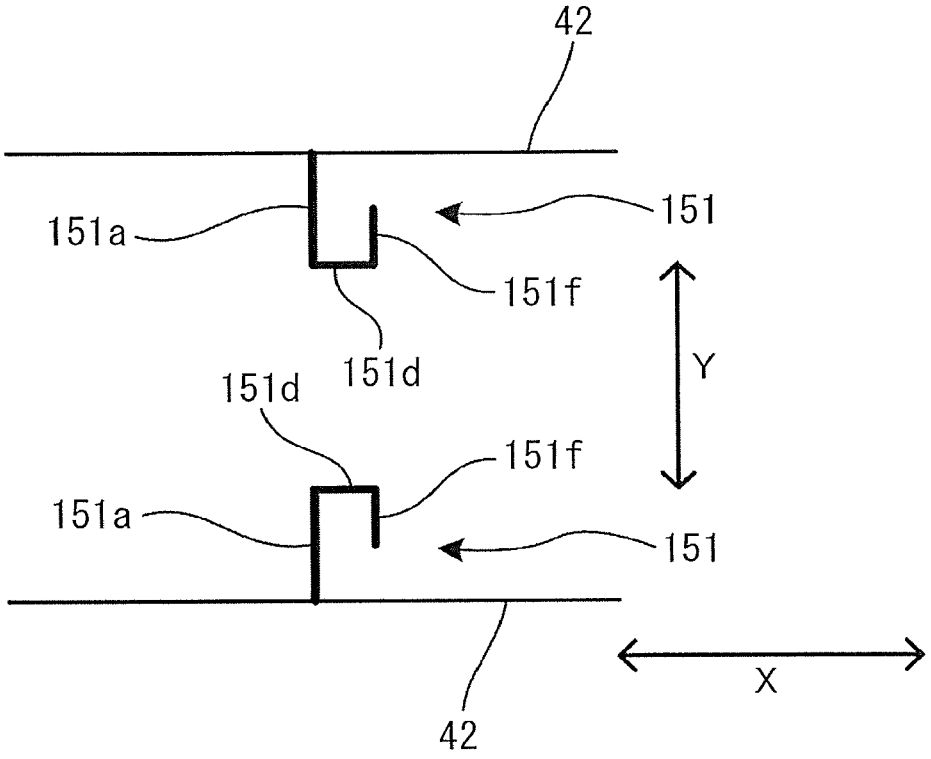
FIG. 45 is a view corresponding to FIG. 40 for a ninth modified example.

In a ninth modified example, as shown in FIG. 45, which is a view corresponding to FIG. 40, the reinforcing member 151 includes the flange 151*d* of which the front end is attached to the end surface of the plate material 151*a* on the inside and that is provided along the front-back direction X and a flange 151*f* attached to the rear end of the flange 151*d* and provided along the left-right direction Y. The end surface of the plate material 151*a* on the inside and the front end of the flange 151*d* are welded. The rear end of the flange 151*d* and the end surface of the flange 151*f* on the inside are welded. With the flange 151*d* and the flange 151*f*, the strength of the reinforcing member 151 can be improved.

Figure 46:
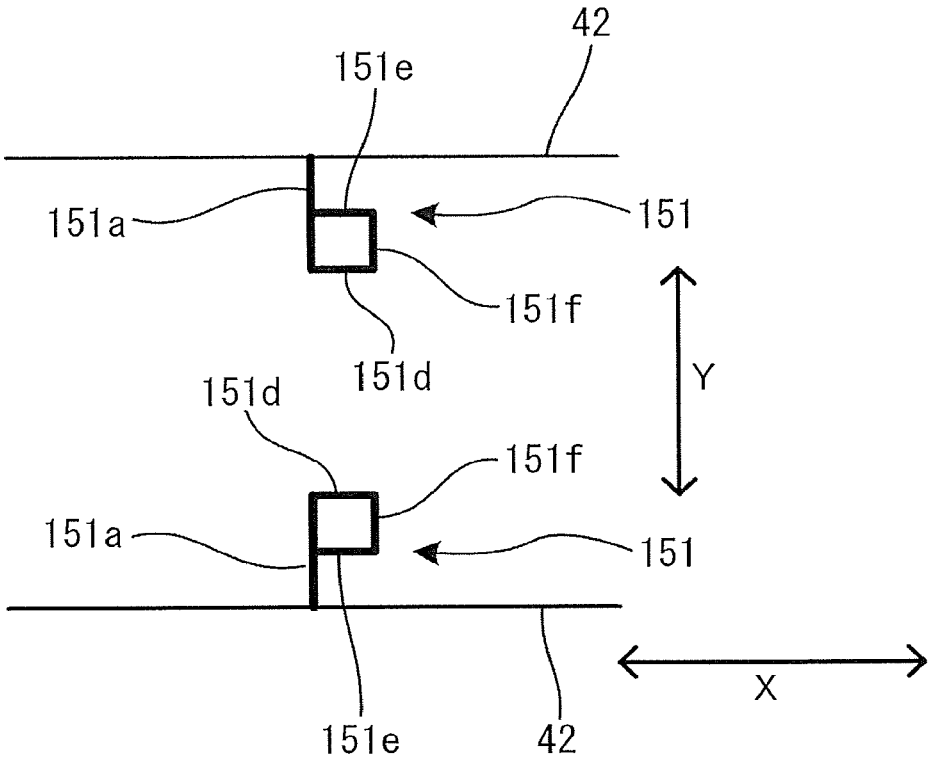
FIG. 46 is a view corresponding to FIG. 40 for a tenth modified example.

In a tenth modified example, as shown in FIG. 46, which is a view corresponding to FIG. 40, the reinforcing member 151 includes the flange 151*d* of which the front end is attached to the end surface of the plate material 151*a* on the inside and that is provided along the front-back direction X, the flange 151*f* attached to the rear end of the flange 151*d* and provided along the left-right direction Y, and the flange 151*e* of which the front end is attached to the middle of the side surface of the plate material 151*a* on the rear side and that is provided along the front-back direction X. The end surface of the plate material 151*a* on the inside and the front end of the flange 151*d* are welded, the rear end of the flange 151*d* and the end surface of the flange 151*f* on the inside are welded, the end surface of the flange 151*f* on the outside and the rear end of the flange 151*e* are welded, and the middle of the side surface of the plate material 151*a* on the rear side and the front end of the flange 151*e* are welded. Accordingly, the reinforcing member 151 is hollow in horizontal section. Accordingly, the strength of the reinforcing member 151 can be improved.

(Effect)

With the upper body 1030 according to this embodiment, as described above, the strength of the reinforcing member 151 can be improved while suppressing an increase in weight due to the reinforcing member 151, by arranging the plate material 151*a* along the direction orthogonal to the surface of the side plate 42 and adjusting the width of the plate material 151*a* in the left-right direction Y, as shown in FIG. 39. Accordingly, the buckling strength of the side plate 42 with respect to the compressive shear force and the stiffness of the side plate 42 with respect to shear deformation can be improved suitably.

Modified Example of this Embodiment

The embodiments of the present invention described above merely illustrate specific examples and do not particularly limit the present invention. The specific configuration or the like can be appropriately changed in design. The workings and effects described in the embodiments of the invention are merely presented as the most preferable workings and effects resulting from the present invention. The workings and effects of the present invention are not limited to those described in the embodiments of the present invention.

Eleventh Embodiment

Figure 47:
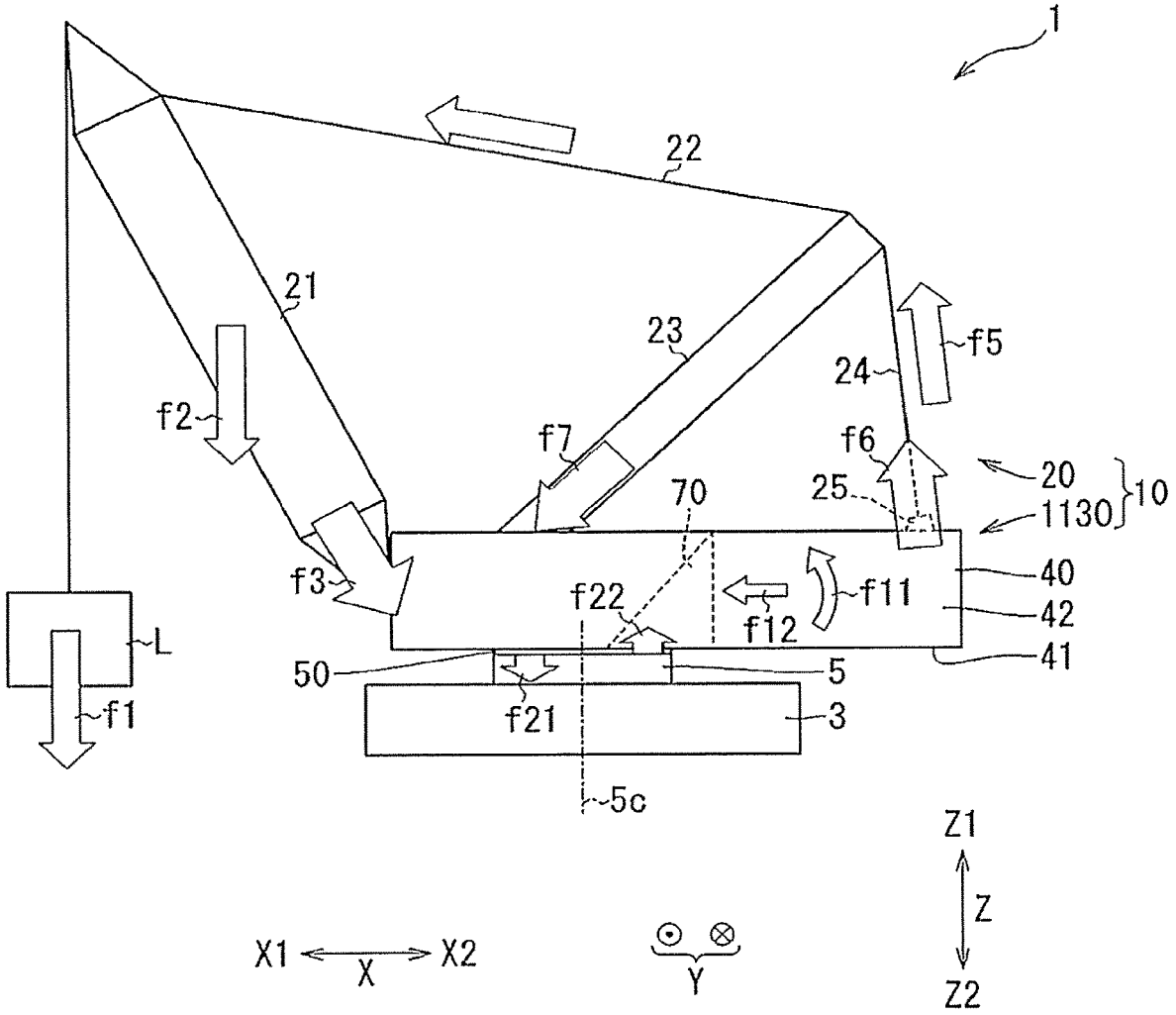
FIG. 47 is a schematic view of the mobile crane 1, seen from the machine-width direction Y.
Figure 48:
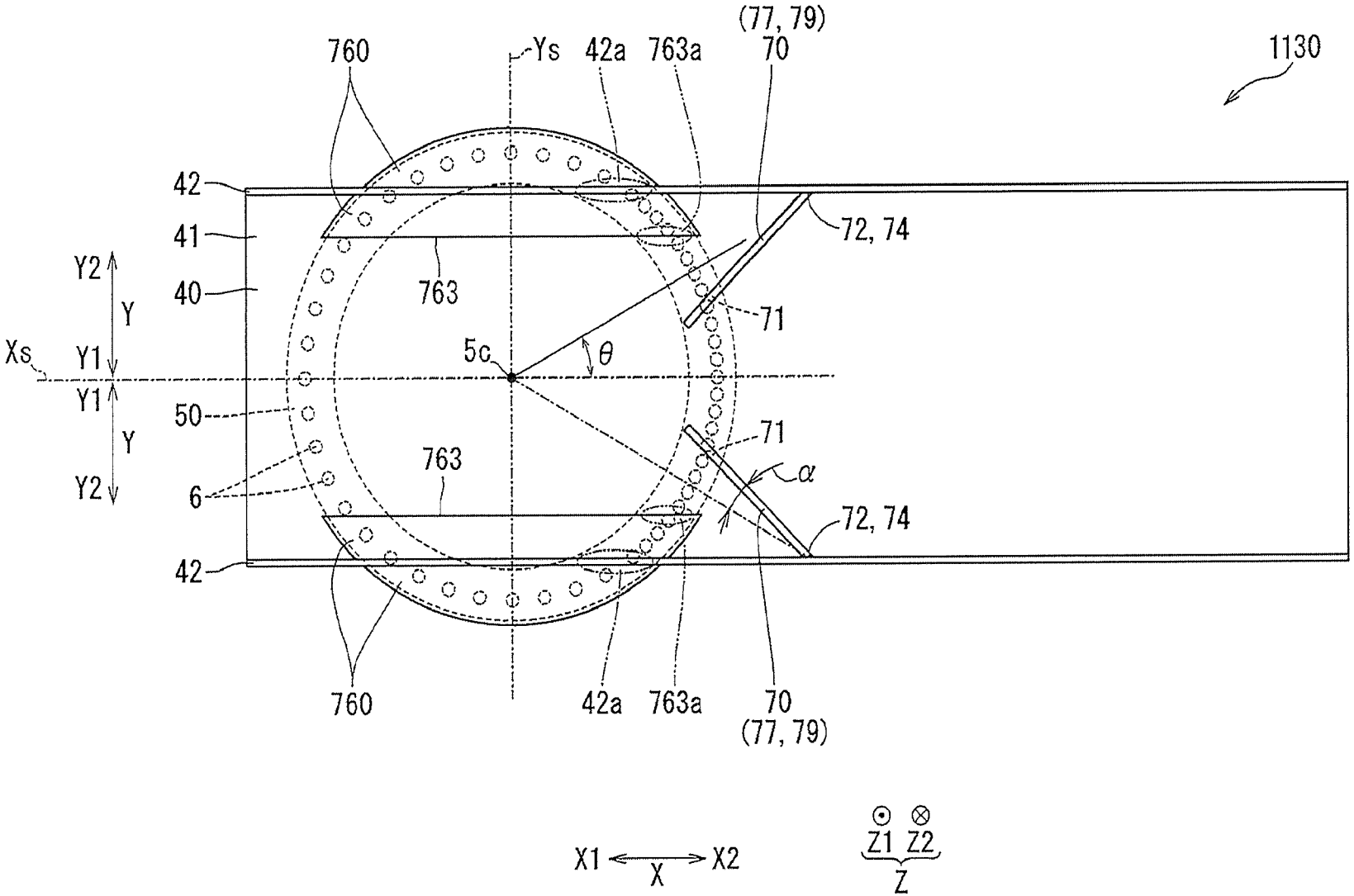
FIG. 48 is a schematic view of an upper body 1130 shown in FIG. 47, seen from the upper side Z1.
Figure 49:
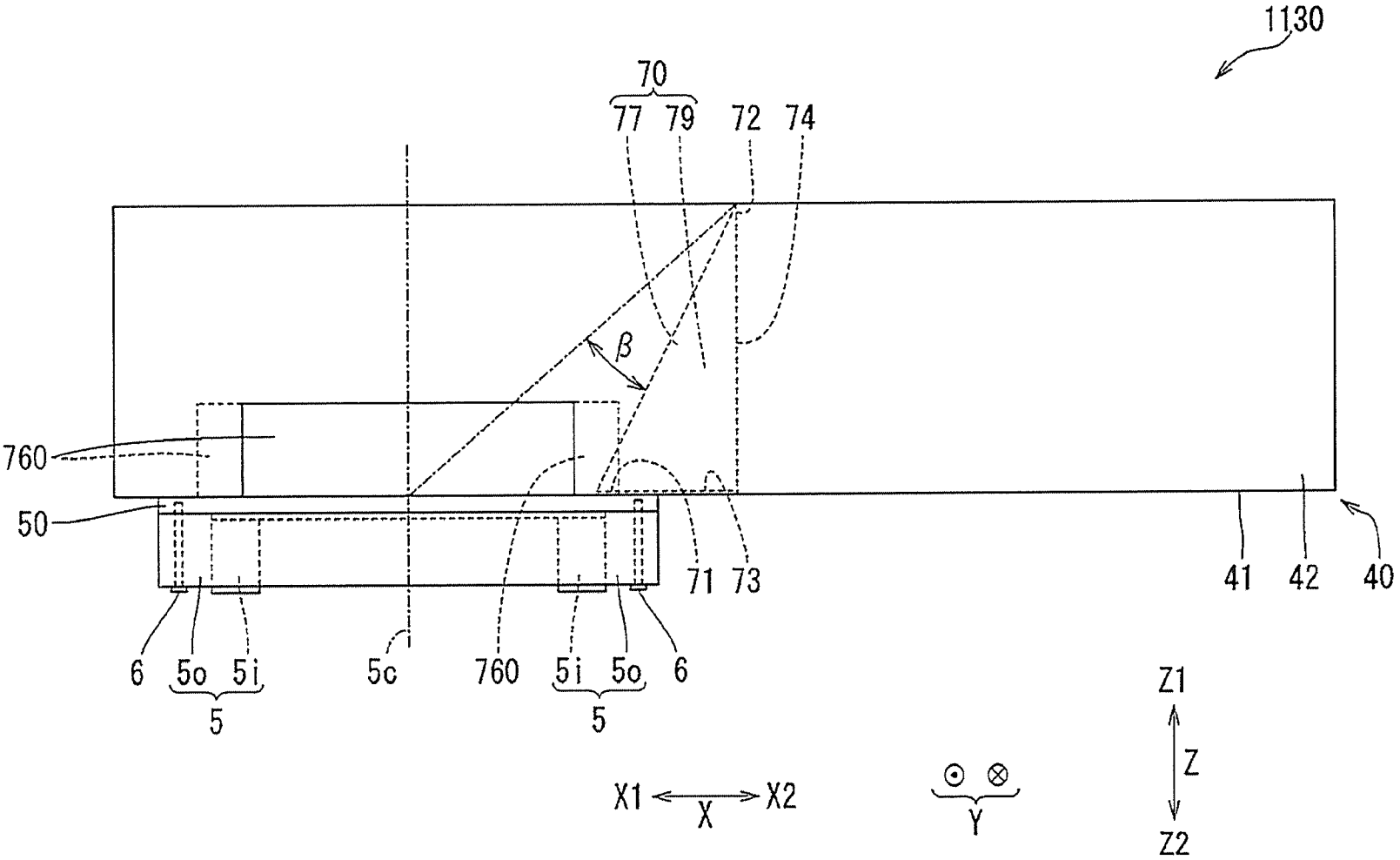
FIG. 49 is a schematic view of the upper body 1130 shown in FIG. 47, seen from the machine-width direction Y.
Figure 50:
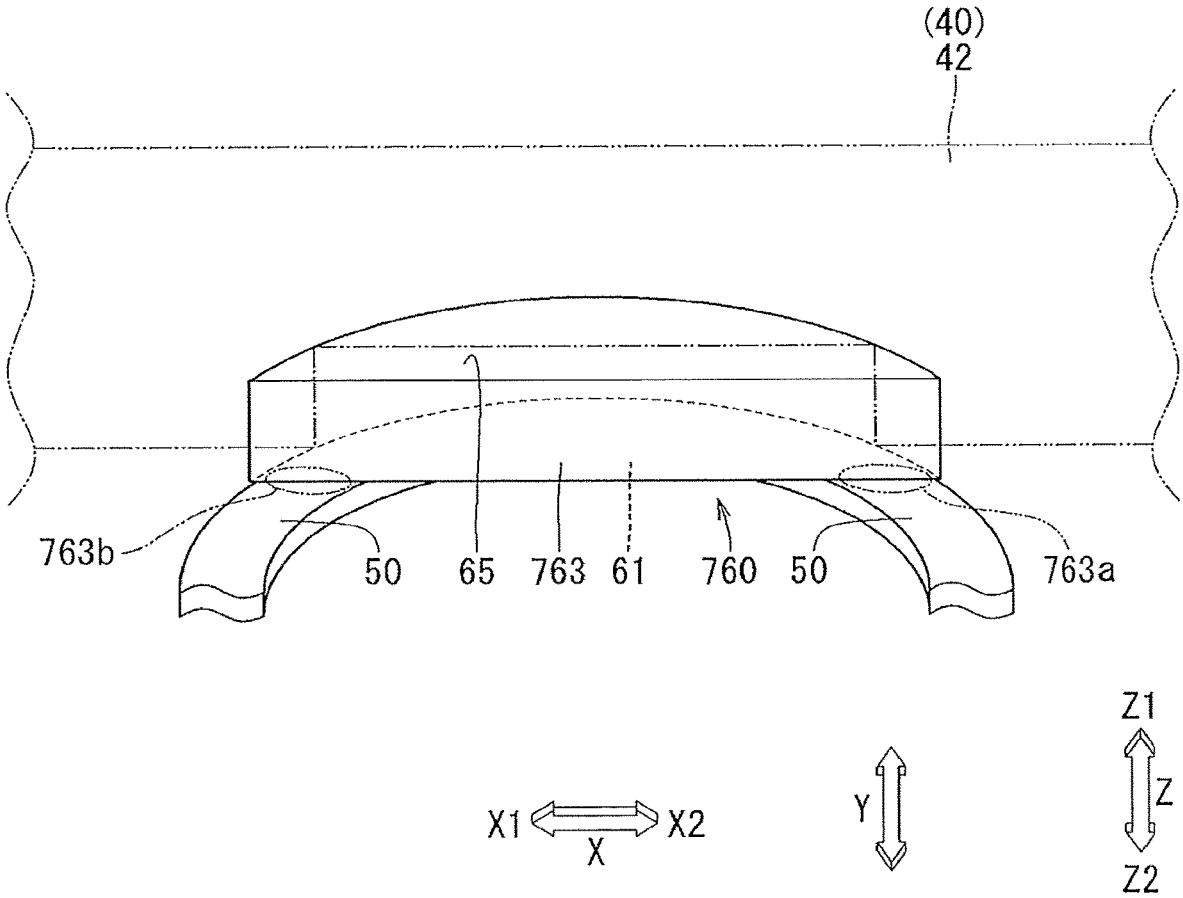
FIG. 50 is a perspective view showing a container-shaped member 60 and the like shown in FIG. 47.

Referring to FIG. 47 to FIG. 53, the difference of the upper body 1130 of the mobile crane 1 of an eleventh embodiment shown in FIG. 47 from the first embodiment will be described. As shown in FIG. 48 and FIG. 49, the upper body 1130 of this embodiment uses the force dispersing member 760 (see FIG. 14) having a similar shape to the seventh embodiment. This upper body 1130 further includes the reinforcing structure member 70. In FIG. 50, the force dispersing member 760 not including the rear-side cutout part 767*a* and the front-side cutout part 767*b* is shown.

Figure 52:
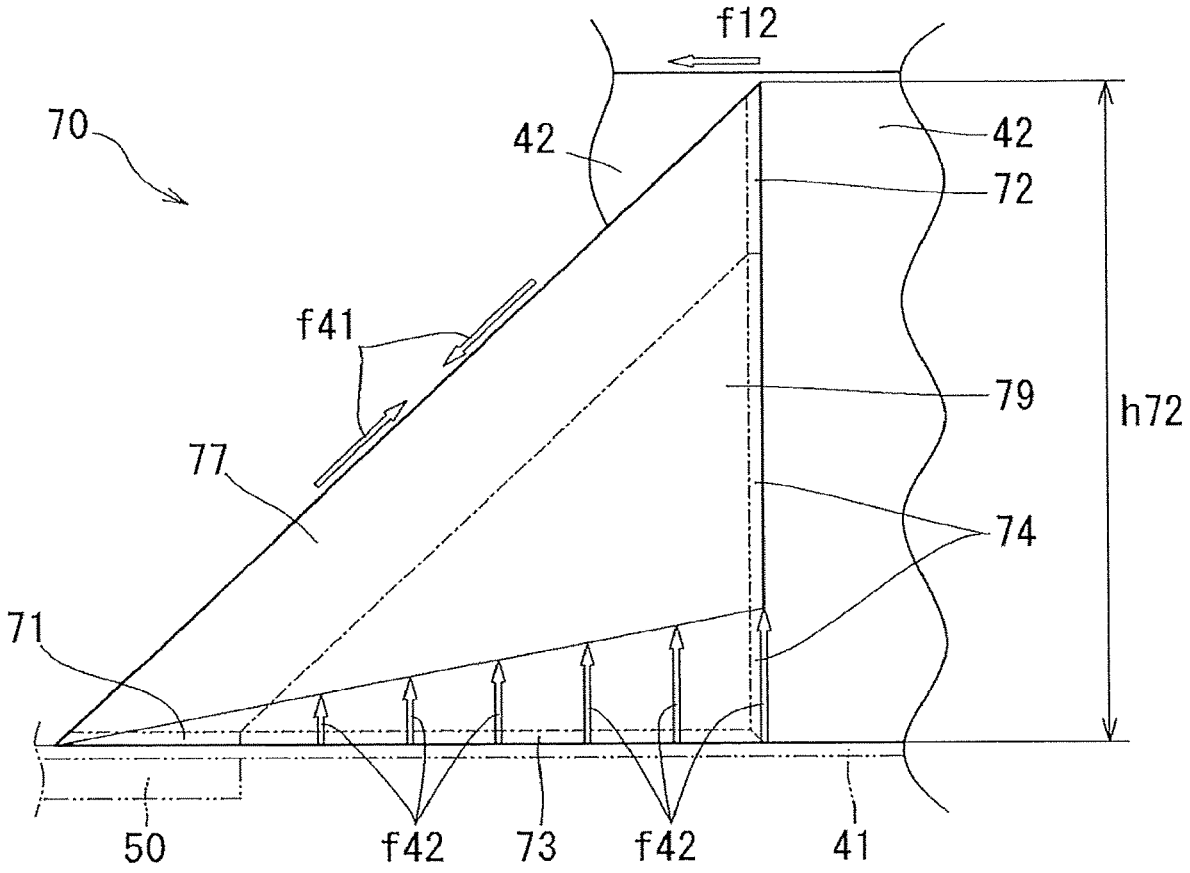
FIG. 52 is a view showing a reinforcing structure member 70 and the like shown in FIG. 49.

As shown in FIG. 48 and FIG. 49, the reinforcing structure member 70 couples the side plate 42 (intersecting side plate 42) of the swing frame 40 and the bearing seat surface 50. The reinforcing structure member 70 transmits the force from the side plate 42 to a portion located at a position further toward the width-direction inside Y1 than to the side plate 42 among the bearing seat surface 50. The reinforcing structure member 70 is plate-shaped (a plate material). The reinforcing structure member 70 may be container-shaped, bar-shaped, etc. (as described later). A case where the reinforcing structure member 70 is plate-shaped will be described below. As shown in FIG. 49, the reinforcing structure member 70 is triangular (triangular seen from the thickness direction of the plate). The reinforcing structure member 70 has a shape of a right triangle. In the right triangle, the angle between the base (side extending in the horizontal direction) and the side extending in the up-down direction Z is a right angle. The reinforcing structure member 70 may be approximately triangular and may be, for example, in a shape of a triangle with a partial cutout (see a fifteenth embodiment (FIG. 62) described later). As shown in FIG. 52, the reinforcing structure member 70 includes a first fixed part 71, a second fixed part 72, a third fixed part 73, a fourth fixed part 74, an inclined part 77, and a bottom-part coupling part 79.

The first fixed part 71 is a portion that is fixed to the bearing seat surface 50 among (the inclined part 77 of) the reinforcing structure member 70. The first fixed part 71 is joined directly to the bearing seat surface 50, for example. The first fixed part 71 may be fixed to the bearing seat surface 50 via the bottom part 41, for example, or may be fixed to the bearing seat surface 50 via a member (see the fifteenth embodiment (FIG. 62) described later), for example. As shown in FIG. 48, the first fixed part 71 is fixed to the bearing seat surface 50 in a position further toward the rear side X2 than the center of revolution 5*c* (further toward rear side X2 than the straight line Ys). The first fixed part 71 is fixed to the bearing seat surface 50 in a position in the vicinity of the end part of the bearing seat surface 50 on the rear side X2, for example. The first fixed part 71 is fixed to the bearing seat surface 50 in a position further toward the width-direction inside Y1 than the side plate 42.

The second fixed part 72 is a portion that is fixed to the side plate 42 among (the inclined part 77 of) the reinforcing structure member 70. As shown in FIG. 52, the second fixed part 72 is the end part (and the vicinity thereof), on the upper side Z1, of a part of the reinforcing structure member 70 fixed to the side plate 42. The second fixed part 72 is joined directly to the side plate 42, for example. Note that the second fixed part 72 may be fixed to the side plate 42 via a member that is not shown, for example (and the same applies to the fourth fixed part 74 described later). The second fixed part 72 is fixed to the side plate 42 in a position further toward the rear side X2 than the first fixed part 71. The second fixed part 72 is fixed to the side plate 42 in a position further toward the upper side Z1 than the first fixed part 71 (further toward upper side Z1 than the bearing seat surface 50). The second fixed part 72 is preferably fixed to the side plate 42 in such a position in which a compressive shear force f31 described later (see FIG. 51) is easily supported. Specifically, the second fixed part 72 being more to the upper side Z1 (closer to the end part of the side plate 42 on the upper side Z1) is more preferable. More specifically, assuming the height (distance in the up-down direction Z) from the end part of the side plate 42 on the lower side Z2 up to the end part of the second fixed part 72 on the upper side Z1 as a height h72, a greater height h72 is more preferable. The height h72 of the second fixed part 72 is greater than or equal to 50%, for example, greater than or equal to 60%, for example, greater than or equal to 70%, for example, greater than or equal to 80%, for example, or greater than or equal to 90%, for example, and may be 100%, for example, of the height (width in the up-down direction Z) of the side plate 42. In the case where the height h72 of the second fixed part 72 is greater than or equal to 80% of the height of the side plate 42, "the second fixed part 72 is fixed to the end part of the side plate 42 on the upper side Z1."

The third fixed part 73 is a portion that is fixed to the bottom part 41 among (the bottom-part coupling part 79 of) the reinforcing structure member 70. The third fixed part 73 is joined directly to the bottom part 41, for example. Note that the third fixed part may be fixed to the bottom part 41 via a member that is not shown, for example. The third fixed part 73 is fixed to the bottom part 41 in a position further toward the rear side X2 than the first fixed part 71. The third fixed part 73 is fixed to the bottom part 41 in a position on the lower side Z2 of (immediately below) a straight line (the inclined part 77) connecting the end part of the first fixed part 71 on the center-of-revolution-5*c* side and the upper end part of the second fixed part 72.

The fourth fixed part 74 is an portion that is fixed to the side plate 42 among (the bottom-part coupling part 79 of) the reinforcing structure member 70. The fourth fixed part 74 is fixed to the side plate 42 in a position further toward the lower side Z2 than the second fixed part 72.

The inclined part 77 is arranged along the straight line connecting the end part of the first fixed part 71 on the center-of-revolution-5*c* side and the upper end part of the second fixed part 72. In the case where the reinforcing structure member 70 has a shape of a right triangle, the inclined part 77 is arranged in a hypotenuse portion (and the vicinity thereof) of the right triangle. The inclined part 77 is the boundary of the reinforcing structure member 70 on the upper side Z1 (and the reinforcing structure member 70 is absent at a position further toward the upper side Z1 than the inclined part 77). In other words, the inclined part 77 forms the edge part of the reinforcing structure member 70 on the upper side. Herein, assume that the reinforcing structure member 70 is joined to a portion (e.g., upper plate) of the swing frame 40 (see FIG. 49) on the upper side Z1 (in which case the reinforcing structure member 70 is, for example, quadrilateral). In this case, there is a risk of buckling in the reinforcing structure member 70, due to the reinforcing structure member 70 being compressed by the portion of the swing frame 40 on the upper side Z1 and the bottom part 41. However, in the case where the reinforcing structure member 70 is not joined to the portion (upper plate) of the swing frame 40 on the upper side Z1 (e.g., in the case where the reinforcing structure member 70 is absent at a position further toward the upper side Z1 than the inclined part 77), the buckling described above does not occur.

As shown in FIG. 48, the inclined part 77 is inclined with respect to the machine-width direction Y (inclined with respect to the machine front-back direction X) when seen from the up-down direction Z. Herein, the angle between a line segment connecting the second fixed part 72 and the center of revolution 5*c* and the inclined part 77 when seen from the up-down direction Z is the angle α. The angle α is preferably an angle in which the compressive shear force f31 described later (see FIG. 51) is easily supported. Specifically, a smaller angle α is more preferable. The angle α is less than or equal to 30°, for example, less than or equal to 20°, for example, or less than or equal to 10°, for example, and may be 0°, for example. In the case where the angle α is less than or equal to 20°, "the inclined part 77 extends in a manner toward the center of revolution 5*c* from the second fixed part 72 when seen from the up-down direction Z."

As shown in FIG. 49, the inclined part 77 is inclined with respect to the horizontal direction (inclined with respect to the machine front-back direction X and inclined with respect to the up-down direction Z) when seen from the machine-width direction Y. When seen from the machine-width direction Y, the inclination of the inclined part 77 with respect to the horizontal direction is greater than or equal to 20°, for example, greater than or equal to 30°, for example, greater than or equal to 40°, for example, or greater than or equal to 45°, for example. When seen from the machine-width direction Y, the inclination of the inclined part 77 with respect to the horizontal direction is less than or equal to 80°, for example, less than or equal to 70°, for example, less than or equal to 60°, for example, less than or equal to 50°, for example, or less than or equal to 45°, for example. Herein, the angle between a line segment connecting the intersection of the end part of the swing frame 40 on the lower side Z2 and the center of revolution 5*c* and the upper end part of the second fixed part 72 and the inclined part 77 when seen from the machine-width direction Y is the angle β. The angle β is preferably an angle in which the compressive shear force f31 described later (see FIG. 51) is easily supported. Specifically, a smaller angle β is more preferable. The angle β is less than or equal to 30°, for example, less than or equal to 20°, for example, or less than or equal to 10°, for example, and may be 0°, for example. In the case where the angle β is less than or equal to 20°, "the inclined part 77 extends in a manner toward the center of revolution 5*c* from the second fixed part 72 when seen from the machine-width direction Y."

As shown in FIG. 52, the bottom-part coupling part 79 is a portion coupling the bottom part 41 of the swing frame 40 and the inclined part 77. The bottom-part coupling part 79 is a portion coupling the third fixed part 73 and the inclined part 77. The bottom-part coupling part 79 is arranged on the lower side Z2 (immediately below) the inclined part 77.

(Force that Occurs in Reinforcing Structure Member 70 and the Like)

Figure 51:
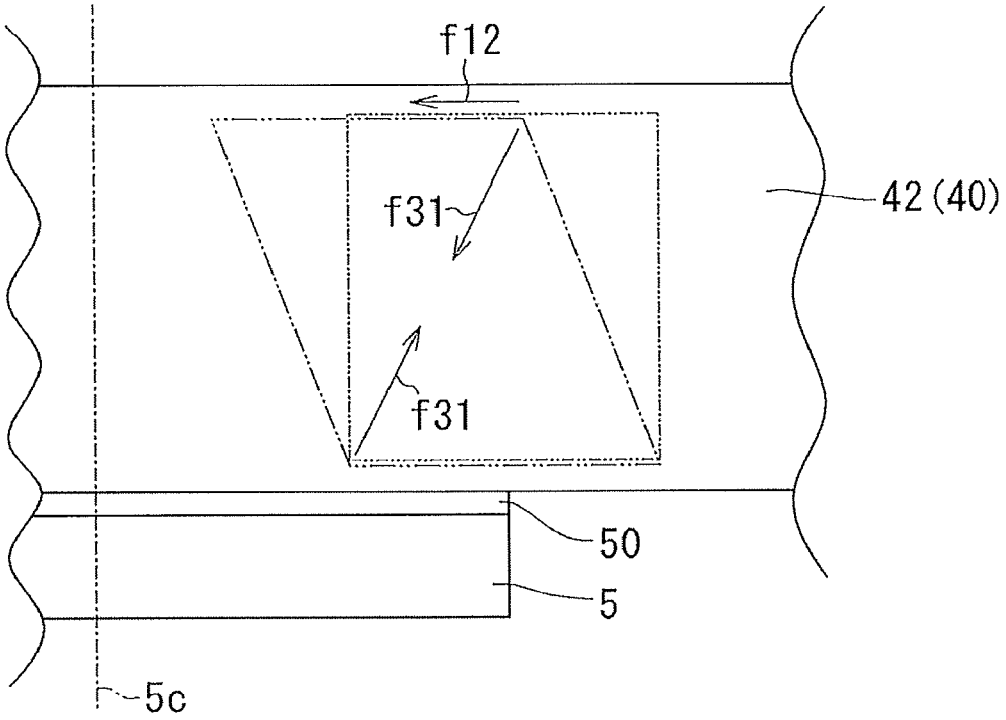
FIG. 51 is a view showing the force that acts on a side plate 42 shown in FIG. 49.

A compressive load f41 shown in FIG. 52 occurs as follows. As shown in FIG. 51, the compressive load f12 occurs in the swing frame 40 (side plate 42). This results in a tendency to cause shear deformation in the side plate 42 (tendency to cause deformation from a rectangle into a rhombus, as shown in FIG. 51). As a result, the compressive load f12 causes the compressive shear force f31 to act on the side plate 42. Herein, as shown in FIG. 52, the reinforcing structure member 70 is fixed to the side plate 42. Thus, a part of the force causing the compressive shear force f31 (see FIG. 51) is transmitted to the reinforcing structure member 70 from the side plate 42. As a result, the compressive shear force f31 is supported by the inclined part 77 of the reinforcing structure member 70. As a result, the compressive load f41 is generated in the inclined part 77 of the reinforcing structure member 70.

A tensile load f42 shown in FIG. 52 occurs as follows. As described above, the bending load f11 (see FIG. 47) occurs in the swing frame 40 (side plate 42). Herein, the reinforcing structure member 70 is fixed to the side plate 42. Therefore, a part of the bending load f11 is transmitted from the side plate 42 to the bottom part 41 and the bearing seat surface 50 via the reinforcing structure member 70. As a result, the end part of the reinforcing structure member 70 on the lower side Z2 shown in FIG. 52 pulls the bottom part 41 and the bearing seat surface 50 to the upper side Z1. As a result, the tensile load f42 occurs in the bottom part 41 and the bearing seat surface 50. The tensile load f42 gradually increases toward the rear side X2 from the front side X1, in the end part of the reinforcing structure member 70 on the lower side Z2 (position in which the reinforcing structure member 70 contacts the bottom part 41 and the bearing seat surface 50).

(Axial Force Distribution of Bearing Bolt)

Figure 53:
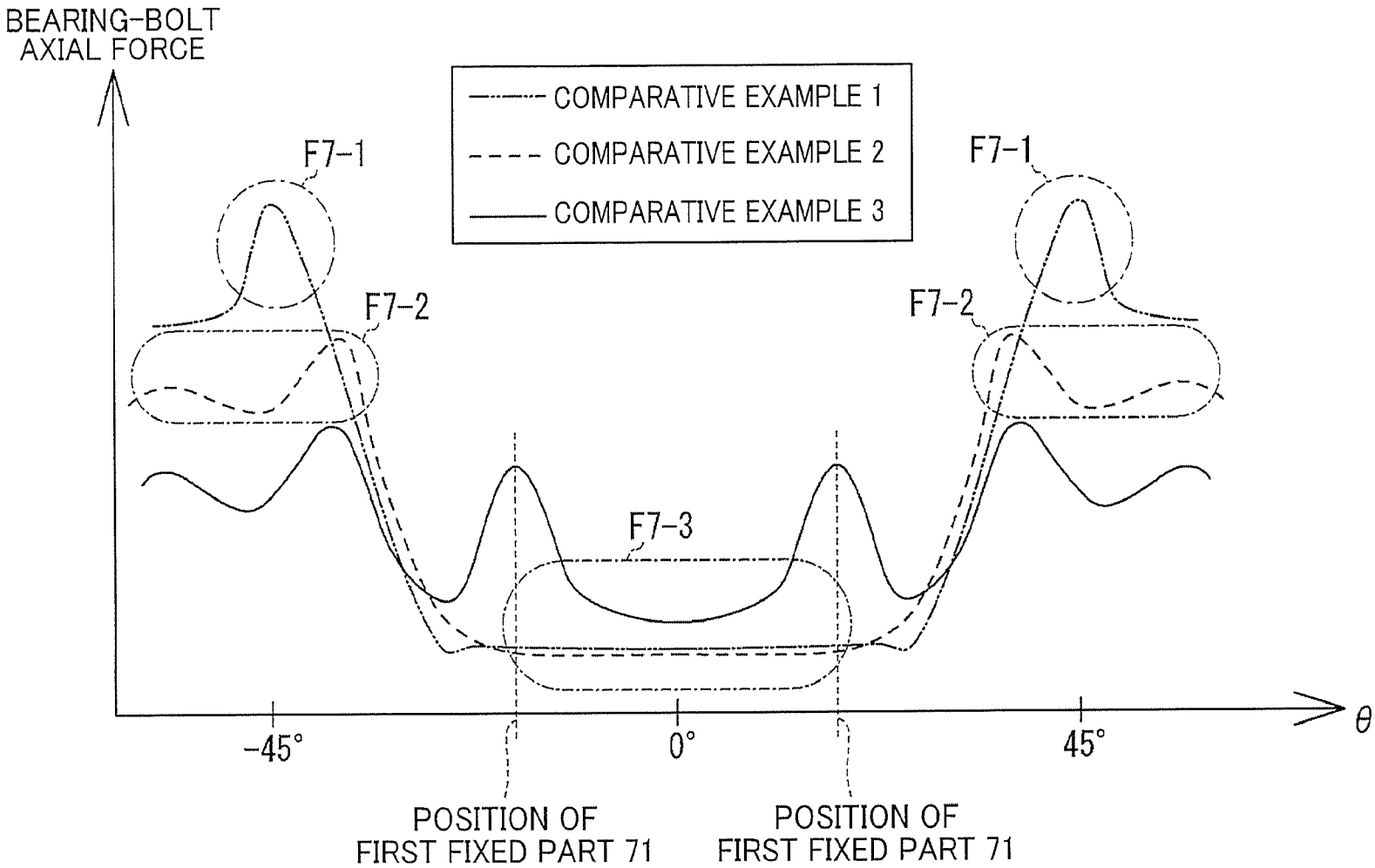
FIG. 53 is a graph showing the relationship of the angle θ shown in FIG. 48 and the bearing-bolt axial force.

As shown in FIG. 53, the relationship of the axial force (bearing-bolt axial force) of the bearing bolt 6 (bearing bolt 606) and the angle θ was examined, for each of comparative example 1 described above (see FIG. 18), comparative example 2 described above (see FIG. 20 and FIG. 21), and comparative example 3 (see FIG. 48 and FIG. 50). In comparative example 3, the force dispersing member 760 (see FIG. 14) of this embodiment is replaced with the force dispersing member 760 shown in FIG. 21 and FIG. 50 (not including the rear-side cutout part 767*a* and the front-side cutout part 767*b*). In reality, the upper body 1130 of this embodiment includes the force dispersing member 760 shown in FIG. 14, instead of the force dispersing member 760 shown in FIG. 21 and FIG. 50. However, to check the effect of the case where the reinforcing structure member 70 is added with respect to comparative example 2, that using the force dispersing member 760 shown in FIG. 21 and FIG. 50, instead of the force dispersing member 760 of this embodiment, is shown as comparative example 3. As shown in FIG. 18, the upper body 1630 in comparative example 1 does not include the force dispersing member 760 (see FIG. 48) and does not include the reinforcing structure member 70 (see FIG. 48). As shown in FIG. 20 and FIG. 21, the upper body 1730 in comparative example 2 includes the container-shaped member 1160, but does not include the reinforcing structure member 70 (see FIG. 48). In FIG. 20 and FIG. 21, components in comparative example 2 that are in common with comparative example 1 are denoted by the same reference signs as in comparative example 1.

The comparison results are shown in FIG. 53.

Comparative Example 1

As shown in portion F7-1 in FIG. 53, the bearing-bolt axial force in comparative example 1 was maximum in the side-plate intersecting position 1042*a* (see FIG. 18) (same position as the side-plate intersecting position 42*a* of this embodiment shown in FIG. 48). As shown in portion F7-3 in FIG. 53, the bearing-bolt axial force in a portion further toward the width-direction inside Y1 than the side-plate intersecting position 1042*a* (see FIG. 18) was smaller than the bearing-bolt axial force in the side-plate intersecting position 1042*a*.

Comparative Example 2

As shown in portion F7-2 in FIG. 53, the bearing-bolt axial force in comparative example 2 was maximum in the vertical-plate intersecting position 1163*a* (see FIG. 21) (same position as the vertical-plate intersecting position 763*a* shown in FIG. 48). As shown in portion F7-3 in FIG. 53, the bearing-bolt axial force in a portion at a position further toward the width-direction inside Y1 than the vertical-plate intersecting position 1163*a* (see FIG. 21) was smaller than the bearing-bolt axial force in the vertical-plate intersecting position 1163*a*.

[Comparative example 3] As shown in FIG. 53, the bearing-bolt axial force in comparative example 3 (see FIG. 21 and FIG. 50) was locally large in the vertical-plate intersecting position 763*a* (in which $\theta \cong \pm 45°$). However, the maximum value of the bearing-bolt axial force in comparative example 3 was smaller than the maximum value of the bearing-bolt axial force in each of comparative example 1 and comparative example 2. The bearing-bolt axial force in comparative example 3 (see FIG. 21 and FIG. 50) was locally large in the position of the first fixed part 71 (in which $\theta \cong \pm 20°$ in the example shown in FIG. 53, see FIG. 48). However, the peak value of the bearing-bolt axial force in the position of the first fixed part 71 (in which $\theta \cong \pm 20°$, see FIG. 48) is smaller than the peak value of the bearing-bolt axial force in the vertical-plate intersecting position 763*a* (in which $\theta \cong \pm 45°$). From the above, it is presumed that the maximum value of the bearing-bolt axial force in the vertical-plate intersecting position 763*a* is smaller compared to the value shown in comparative example 3, in the case where the upper body 1130 includes the force dispersing member 760 shown in FIG. 48 (including the rear-side cutout part 767*a* and the front-side cutout part 767*b*).

(Effect 14)

The effect of the upper body 1130 shown in FIG. 47 will be described. The upper body 1130 includes the swing frame 40, the bearing seat surface 50, and the reinforcing structure member 70. As shown in FIG. 48 and FIG. 49, the reinforcing structure member 70 couples the side plate 42 of the swing frame 40 and the bearing seat surface 50. As shown in FIG. 52, the reinforcing structure member 70 includes the first fixed part 71 and the second fixed part 72.

[Configuration 14-1] The first fixed part 71 is the portion fixed to the bearing seat surface 50.

[Configuration 14-2] The second fixed part 72 is the portion fixed to the side plate 42.

[Configuration 14-3] As shown in FIG. 48, the first fixed part 71 is fixed to the bearing seat surface 50 in the position further toward the rear side X2 than the center of revolution 5*c* of the swing bearing 5.

[Configuration 14-4] The first fixed part 71 is fixed to the bearing seat surface 50 in the position further toward the width-direction inside Y1 than the side plate 42.

[Configuration 14-5] As shown in FIG. 49, the second fixed part 72 is fixed to the side plate 42 (intersecting side plate) in the position further toward the rear side X2 and the upper side Z1 than the first fixed part 71.

The upper body 1130 includes [Configuration 14-1], [Configuration 14-2], and [Configuration 14-4] described above. Thus, the force is transmitted from the side plate 42 shown in FIG. 48 to an area of the bearing seat surface 50 at a position further toward the width-direction inside Y1 than the side plate 42 (located away from the side plate 42, so to speak). Thus, a part of the force transmitted to the bearing seat surface 50 from the side plate 42 is carried by the bearing bolt 6 in the vicinity of the first fixed part 71. Thus, the load carried by the bearing bolt 6 in the side-plate intersecting position 42*a* and the vicinity thereof can be reduced. Thus, increasing the plate thickness of the bearing seat surface 50 is not necessary, and the maximum value of the axial force on the bearing bolt 6 can be reduced (see FIG. 53). In the case where the lifting capacity or strength of the mobile crane 1 (see FIG. 47) is determined (governed) by the axial force on the bearing bolt 6, the influence of the strength of the bearing bolt 6 on the lifting capacity or strength of the mobile crane 1 can be eliminated or suppressed by reducing the maximum value of the axial force on the bearing bolt 6.

The upper body 1130 includes [Configuration 14-1], [Configuration 14-4], and [Configuration 14-5] described above. Thus, as shown in FIG. 48 and FIG. 49, a line segment connecting the end part of the first fixed part 71 on the center-of-revolution-5*c* side and the upper end part of the second fixed part 72 (specifically, a portion in which the inclined part 77 is arranged) is inclined with respect to the machine front-back direction X and inclined with respect to the machine-width direction Y. Thus, compared to a case where the line segment (inclined part 77) is parallel to the machine front-back direction X or the machine-width direction Y, the force is transmitted reliably to the first fixed part 71 (bearing seat surface 50) from the second fixed part 72 (side plate 42). As a result, the maximum value of the axial force on the bearing bolt 6 can be reduced reliably.

(Effect 15)

[Configuration 15-1] As shown in FIG. 48, the reinforcing structure member 70 includes the inclined part 77 arranged along the straight line connecting the end part of the first fixed part 71 on the center-of-revolution-5*c* side and the upper end part of the second fixed part 72.

[Configuration 15-2] The inclined part 77 forms the edge part of the reinforcing structure member 70 on the upper side Z1.

With [Configuration 15-1] and [Configuration 15-2] described above, occurrence of buckling in the reinforcing structure member 70 is suppressed, even when the reinforcing structure member 70 is compressed between a portion of the swing frame 40 on the upper side Z1 and the bottom part 41.

(Effect 16)

[Configuration 16] The inclined part 77 extends in a manner toward the center of revolution 5*c* from the second fixed part 72 when seen from the up-down direction Z (specifically, the angle α is less than or equal to 20°).

With [Configuration 16] described above, the force is transmitted reliably from the side plate 42 (second fixed part 72) to a portion located at a position toward the inner side in the machine-width direction Y than the side plate 42 among the bearing seat surface 50 (the first fixed part 71), via the inclined part 77. As a result, the maximum value of the axial force on the bearing bolt 6 can be reduced further reliably.

(Effect 17)

[Configuration 17] When seen from the machine-width direction (left-right direction) Y, the inclination of the inclined part 77 with respect to the horizontal direction is greater than or equal to 20° and less than or equal to 80°.

With [Configuration 17] described above, the force is transmitted reliably from the side plate 42 (second fixed part 72) to a portion located at a position toward the lower side Z2 than the second fixed part 72 among the bearing seat surface 50 (the first fixed part 71), via the inclined part 77. As a result, the maximum value of the axial force on the bearing bolt 6 can be reduced further reliably.

(Effect 18)

[Configuration 18] The second fixed part 72 is fixed to the end part of the side plate (intersecting side plate) 42 on the upper side Z1 (specifically, as shown in FIG. 52, fixed to a portion in which the height h72 from the bottom part 41 up to the end part of the second fixed part 72 on the upper side Z1 is greater than or equal to 80% of the height of the side plate 42).

With [Configuration 18] described above, the force is transmitted from the end part of the side plate 42 shown in FIG. 49 on the upper side Z1 to the bearing seat surface 50 (first fixed part 71) via the reinforcing structure member 70. Thus, compared to a case where the force is transmitted to the first fixed part 71 only from an area located further toward the lower side Z2 than the end part of the side plate 42 on the upper side Z1, the force is transmitted more reliably to the first fixed part 71 from the side plate 42 (second fixed part 72). As a result, the maximum value of the axial force on the bearing bolt 6 can be reduced further reliably.

(Effect 19)

[Configuration 19] The reinforcing structure member 70 includes the third fixed part 73 fixed to the bottom part 41 of the swing frame 40 of the reinforcing structure member 70.

(Effect 19-1)

With [Configuration 19] described above, the force is transmitted from the side plate 42 (first fixed part 71) to not only the bearing seat surface 50 (the second fixed part 72) but also the bottom part 41 (third fixed part 73) via the reinforcing structure member 70. Thus, the force transmitted to the bearing seat surface 50 from the side plate 42 is reduced. As a result, the maximum value of the axial force on the bearing bolt 6 can further be reduced.

(Effect 19-2)

In [Configuration 19] described above, the reinforcing structure member 70 couples the side plate 42 and the bottom part 41. Thus, the stiffness (torsional stiffness) of the swing frame 40 with respect to torsional deformation can be improved. Specifically, since the section (section seen from the machine-width direction Y or machine front-back direction X) of the swing frame 40 is a rectangle, the section of the swing frame 40 deforms into a rhombus upon the swing frame 40 receiving a torsional load (torsional load about the axis line in the machine-width direction Y or machine front-back direction X). However, with [Configuration 19] described above, the deformation of the section of the swing frame 40 into a rhombus is suppressed. The section of the swing frame 40 may be not a rectangle.

Twelfth Embodiment

Figure 54:
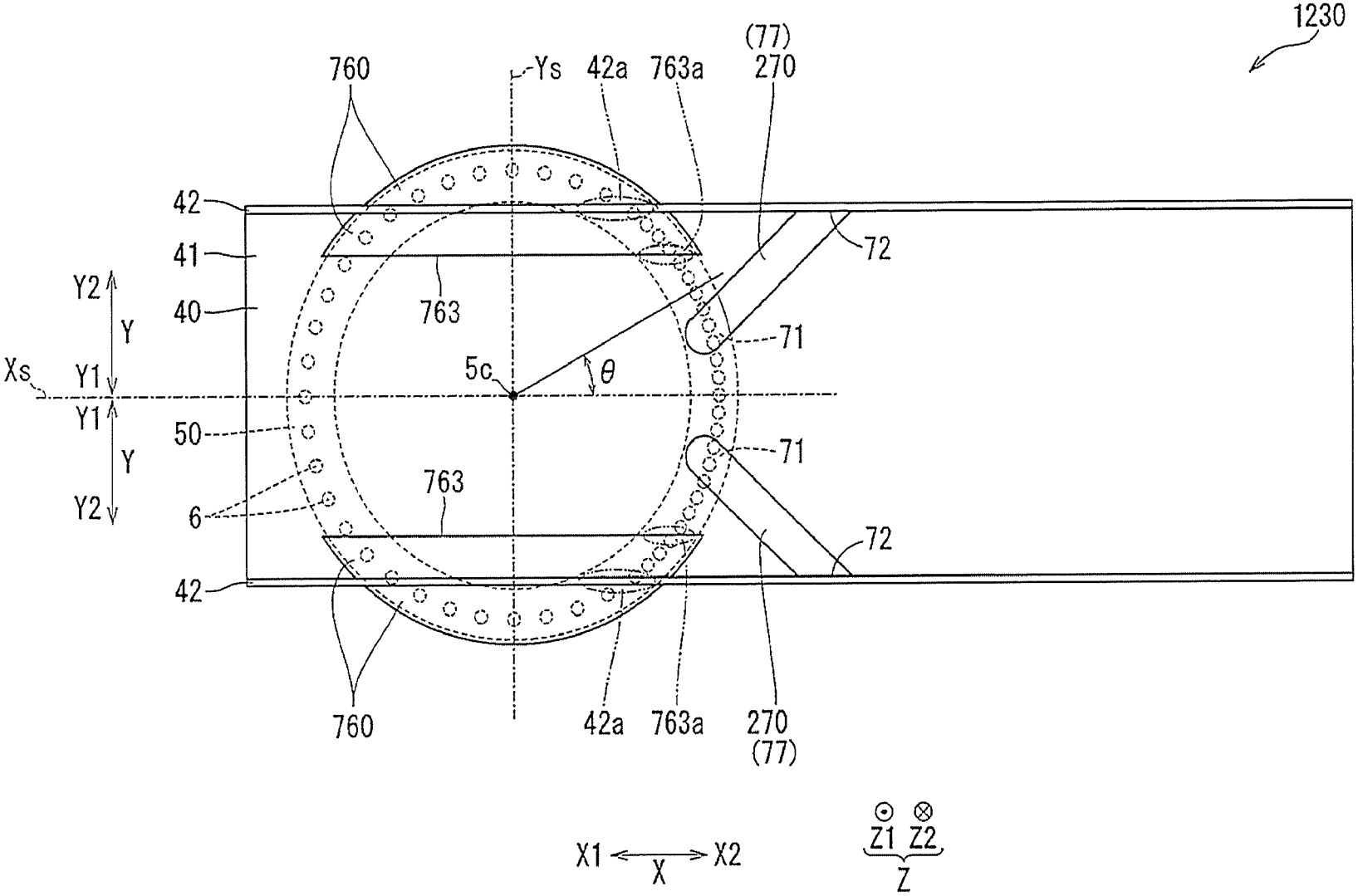
FIG. 54 is a view corresponding to FIG. 48 for a twelfth embodiment.
Figure 55:
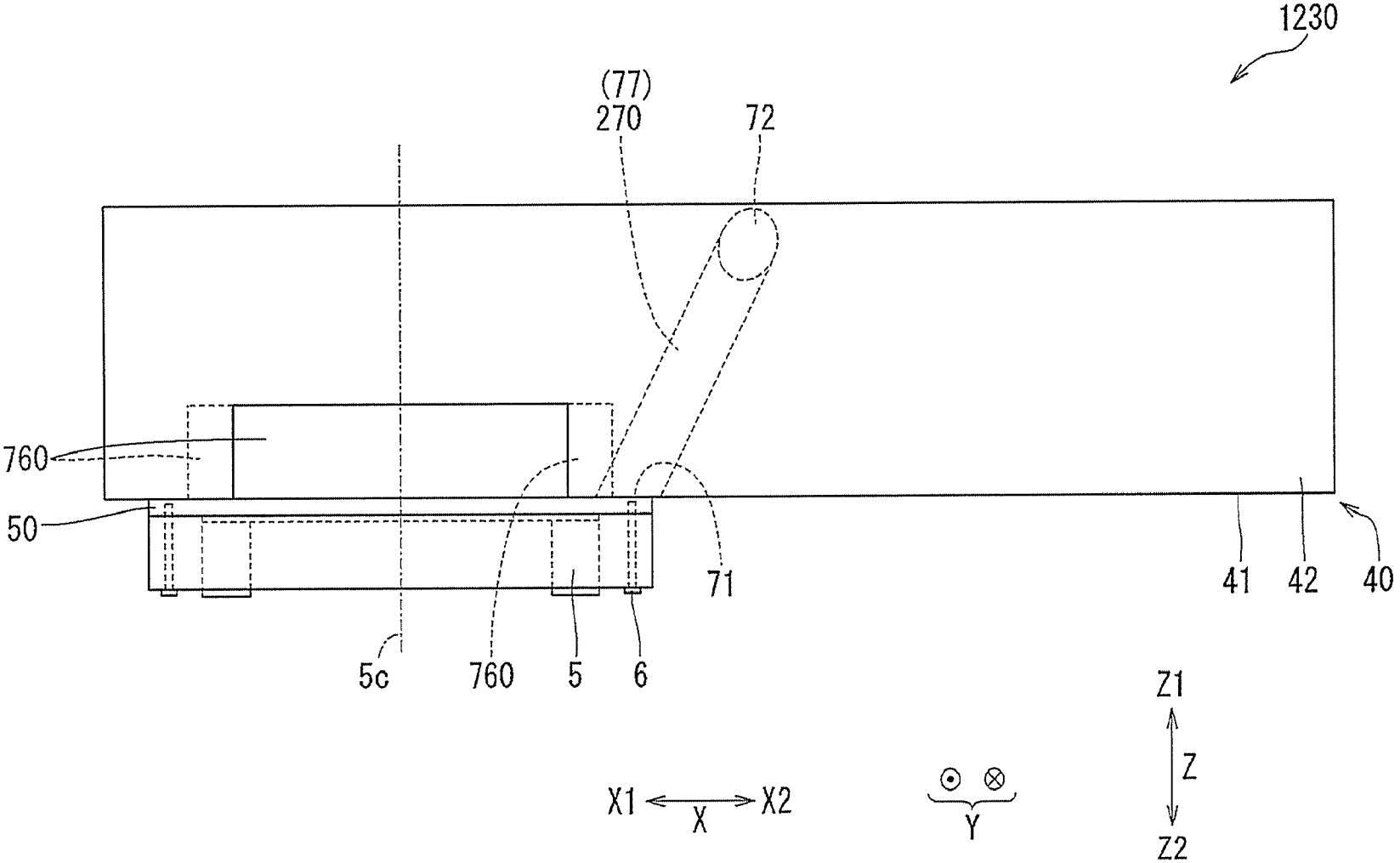
FIG. 55 is a view corresponding to FIG. 49 for the twelfth embodiment.

Referring to FIG. 54 and FIG. 55, the difference of an upper body 1230 of a twelfth embodiment from the eleventh embodiment will be described. While the reinforcing structure member 70 (see FIG. 49) has been in the shape of a triangular plate in the eleventh embodiment, a reinforcing structure member 270 of the twelfth embodiment shown in FIG. 54 and FIG. 55 is bar-shaped.

The reinforcing structure member 270 has a shape of a bar along the straight line connecting the end part of the first fixed part 71 on the center-of-revolution-5*c* side and the upper end part of the second fixed part 72. The reinforcing structure member 270 forms the inclined part 77. The reinforcing structure member 270 does not include the bottom-part coupling part 79 (see FIG. 49) of the eleventh embodiment. The reinforcing structure member 270 has a shape of a hollow bar (shape of a pipe), for example, or may have a shape of a solid bar. The sectional shape of the reinforcing structure member 270 seen from the longitudinal direction is a circle, for example, or may be a polygon (such as a triangle or quadrilateral), for example.

Thirteenth Embodiment

Figure 56:
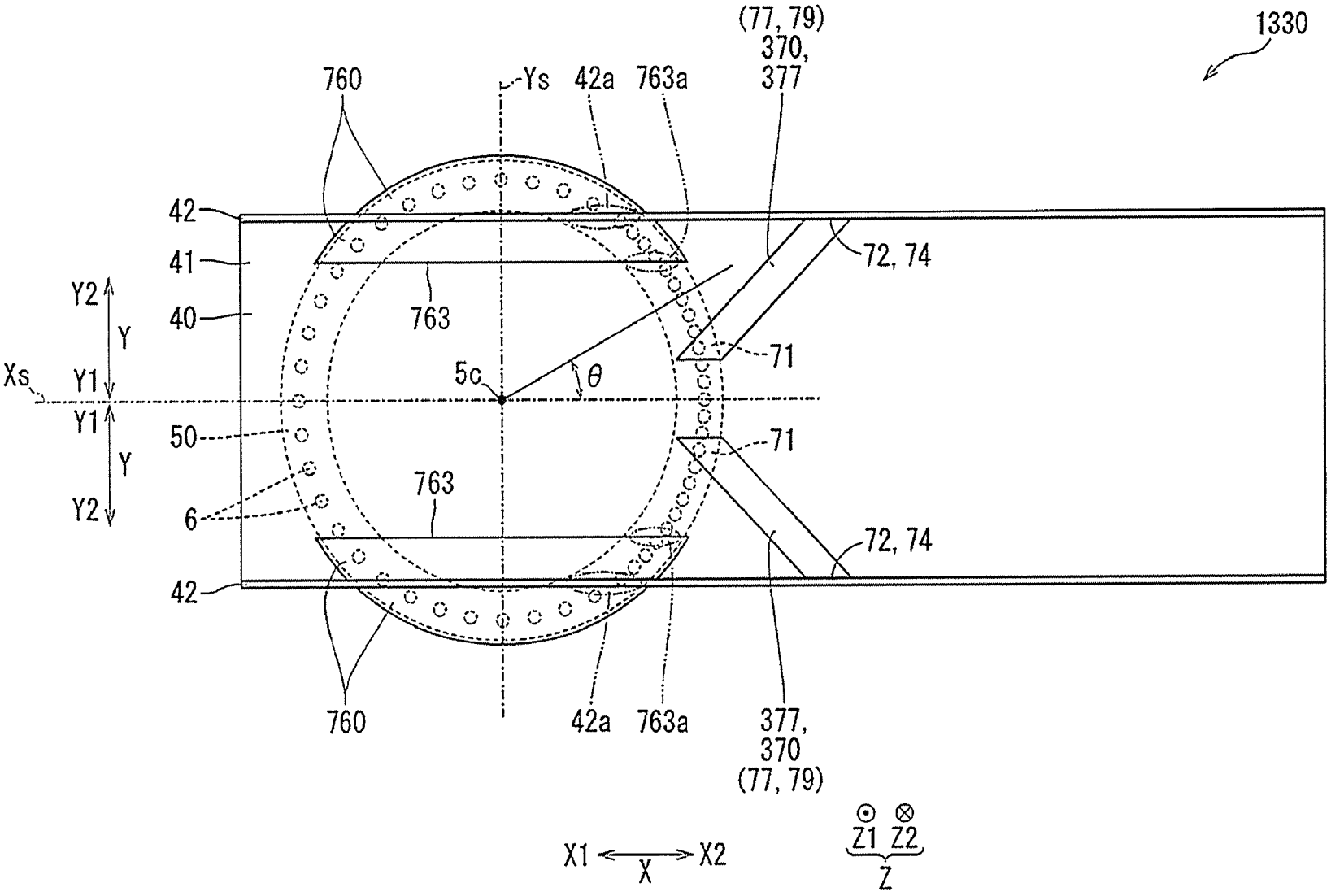
FIG. 56 is a view corresponding to FIG. 48 for a thirteenth embodiment.
Figure 57:
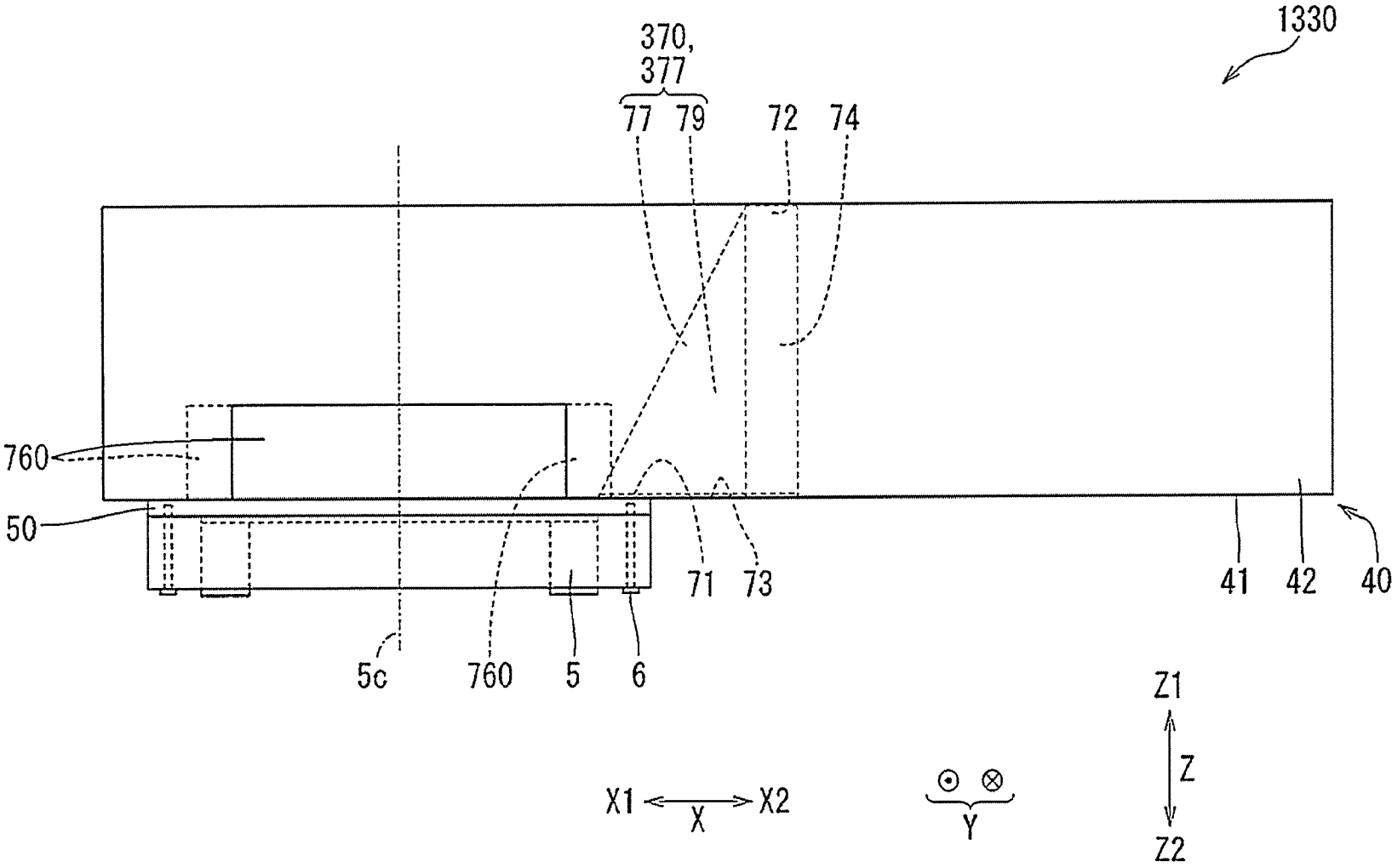
FIG. 57 is a view corresponding to FIG. 49 for the thirteenth embodiment.

Referring to FIG. 56 and FIG. 57, the difference of an upper body 1330 of a thirteenth embodiment from the eleventh embodiment will be described. In the eleventh embodiment, the reinforcing structure member 70 (see FIG. 49) has been in the shape of a triangular plate. A reinforcing structure member 370 of the thirteenth embodiment shown in FIG. 56 and FIG. 57 includes a container-shaped part 377.

The container-shaped part 377 includes a hollow portion. The container-shaped part 377 has a shape approximately of a triangular prism container, for example. The shape of the container-shaped part 377 is, for example, a shape in which the plate-shaped reinforcing structure member 70 (see FIG. 49) of the eleventh embodiment is thickened in the thickness direction and made hollow inside. For example, the reinforcing structure member 370 as a whole is the container-shaped part 377. A part of the reinforcing structure member 370 may be the container-shaped part 377. A structure may be provided inside the container-shaped part 377 (see a fourteenth embodiment described later, for example). In the case where the reinforcing structure member 270 (see FIG. 54) of the twelfth embodiment is hollow, the hollow reinforcing structure member 270 is included in the container-shaped part 377.

(Effect 20)

The effect of the upper body 1330 of the thirteenth embodiment shown in FIG. 56 and FIG. 57 is as follows.

[Configuration 20] The reinforcing structure member 370 includes the container-shaped part 377 including a hollow portion.

With [Configuration 20] described above, the strength of the reinforcing structure member 370 can be improved, compared to a case where the reinforcing structure member 370 does not include the container-shaped part 377 (case of a plate shape or the like). Since the container-shaped part 377 is hollow, the reinforcing structure member 370 can be made lightweight.

Fourteenth Embodiment

Figure 58:
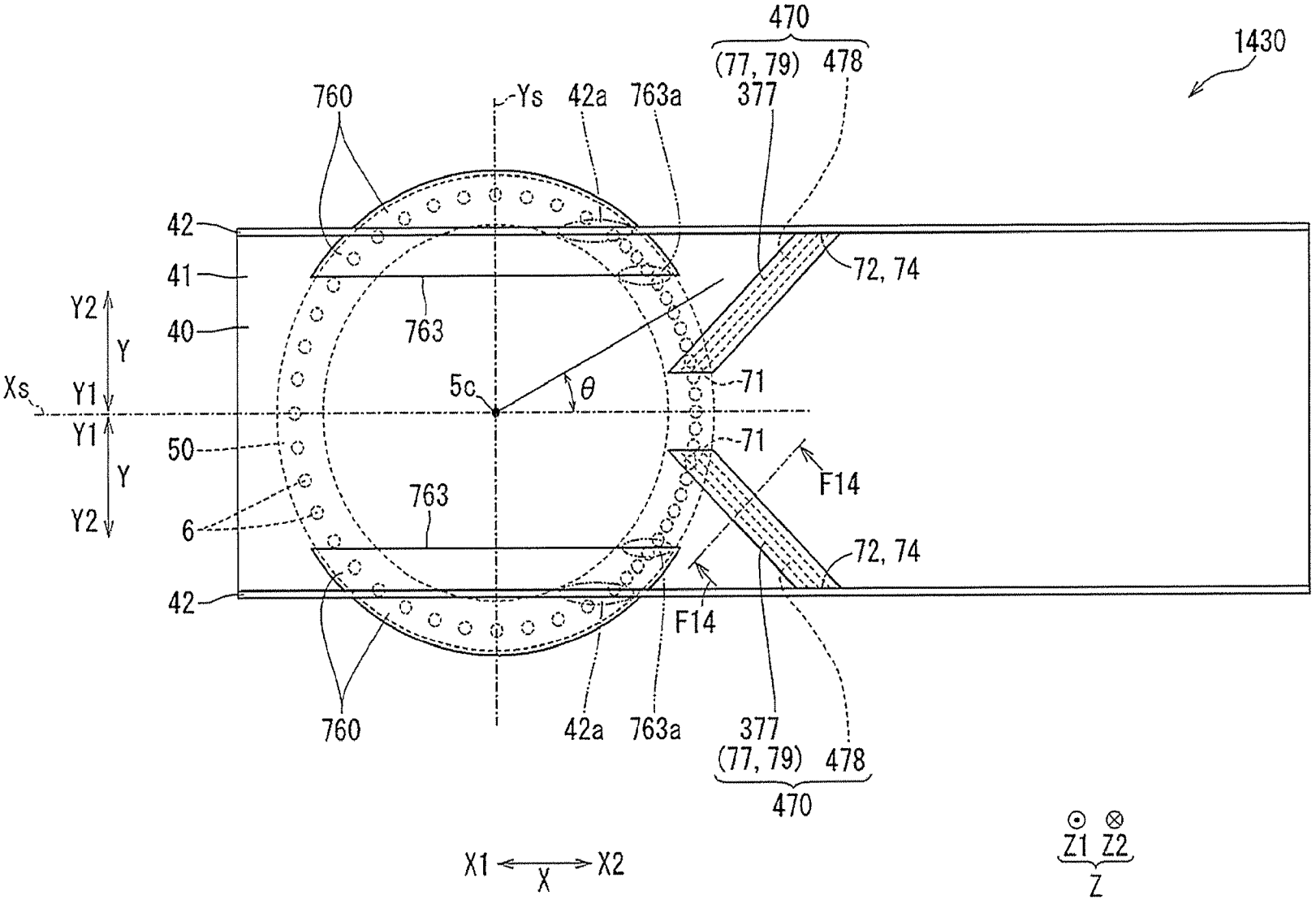
FIG. 58 is a view corresponding to FIG. 48 for a fourteenth embodiment.
Figure 59:
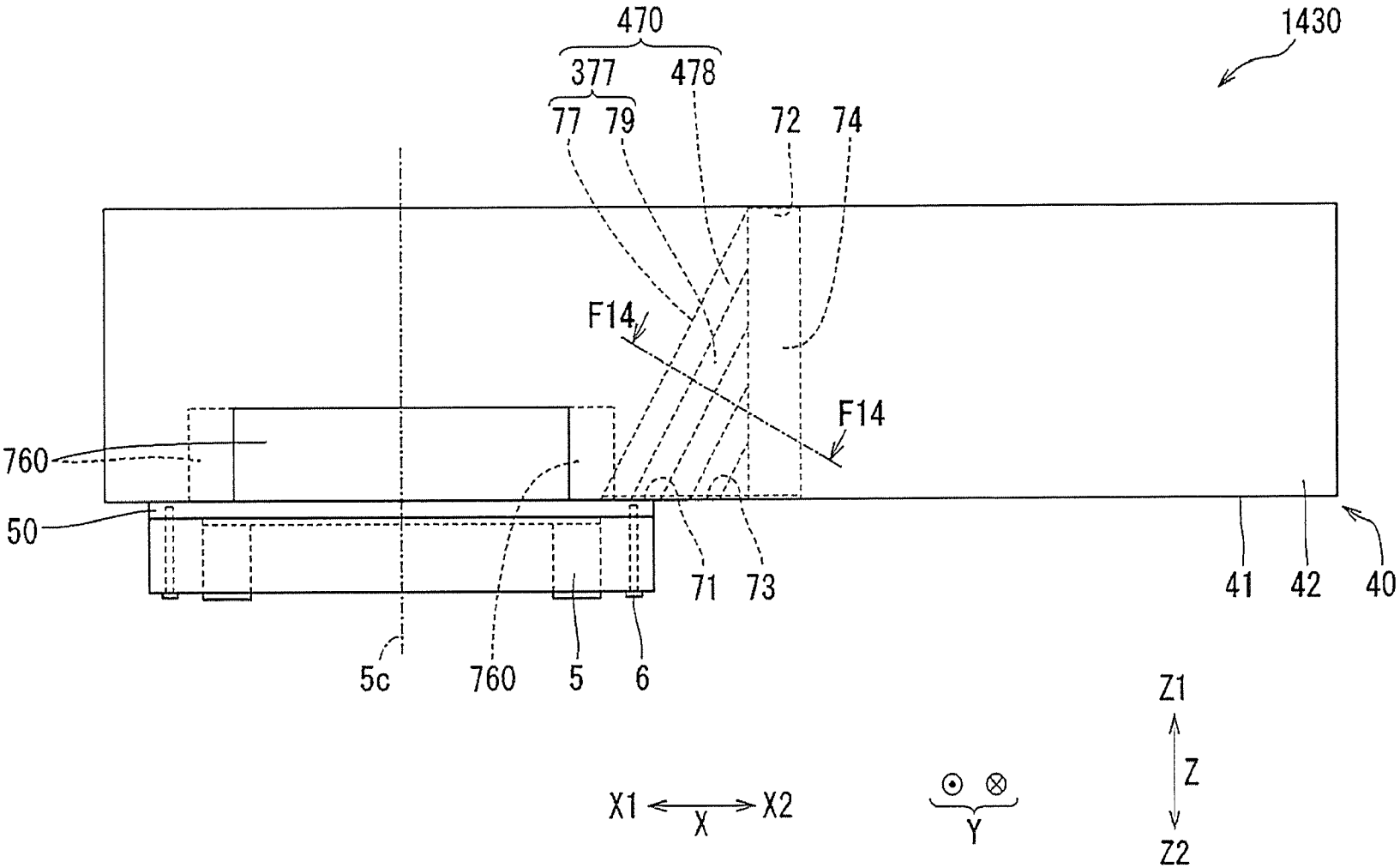
FIG. 59 is a view corresponding to FIG. 49 for the fourteenth embodiment.
Figure 60:
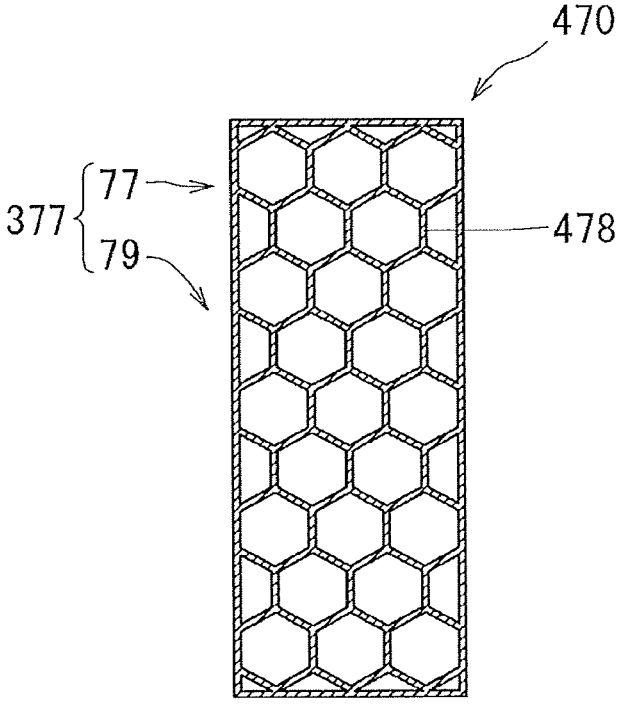
FIG. 60 is a schematic view of a section on arrow F14 shown in FIG. 58 and FIG. 59.

Referring to FIG. 58 to FIG. 60, the difference of an upper body 1430 of the fourteenth embodiment from the thirteenth embodiment will be described. As shown in FIG. 58 and FIG. 59, a reinforcing structure member 470 of the fourteenth embodiment is the reinforcing structure member 370 (see FIG. 57) of the thirteenth embodiment with a honeycomb part 478 added inside the container-shaped part 377.

As shown in FIG. 59, the honeycomb part 478 is provided (continuously) from the first fixed part 71 up to the second fixed part 72. The honeycomb part 478 is provided throughout the entire inclined part 77. The honeycomb part 478 is provided from the fourth fixed part 74 up to the third fixed part 73. The honeycomb part 478 is provided throughout the entire bottom-part coupling part 79. The honeycomb part 478 includes a plurality of hollow polygons in section, as shown in FIG. 60, when seen from the direction connecting the first fixed part 71 and the second fixed part 72. The polygon forming the polygons in section is a hexagon, for example, or may be a triangle, quadrilateral, or the like (not shown). The direction of the dashed line within the honeycomb part 478 shown in FIG. 58 and FIG. 59 shows the axis-line direction of the honeycomb part 478 (direction in which the polygons in section are contiguous).

(Effect 21)

The effect of the upper body 1430 of the fourteenth embodiment is as follows.

[Configuration 21-1] The reinforcing structure member 470 includes the honeycomb part 478 provided from the first fixed part 71 up to the second fixed part 72.

[Configuration 21-2] The honeycomb part 478 includes a plurality of hollow polygons in section, as shown in FIG. 60, when seen from the direction connecting the first fixed part 71 and the second fixed part 72.

With [Configuration 21-1] described above, the area of a fixed portion of the reinforcing structure member 470 and the bearing seat surface 50 in the first fixed part 71 increases by the amount of the honeycomb part 478 arranged in the first fixed part 71. As a result, the stress on the bearing seat surface 50 in the first fixed part 71 and the vicinity thereof is dispersed. Thus, the axial force on the bearing bolt 6 in the first fixed part 71 and the vicinity thereof can be dispersed.

With [Configuration 21-2] described above, the strength of the reinforcing structure member 470 with respect to the force in the direction connecting first fixed part 71 and the second fixed part 72 can be improved.

(Other Effects)

[Configuration 21-3] The honeycomb part 478 is provided to the third fixed part 73.

With [Configuration 21-3] described above, the area of a fixed portion of the reinforcing structure member 470 and the bottom part 41 in the third fixed part 73 increases by the amount of the honeycomb part 478. Thus, the force is more easily transmitted to the bottom part 41 (third fixed part 73) from the side plate 42 (second fixed part 72 or fourth fixed part 74). As a result, the force transmitted to the bearing seat surface 50 from the side plate 42 decreases. As a result, the axial force on the bearing bolt 6 can further be reduced.

Fifteenth Embodiment

Figure 61:
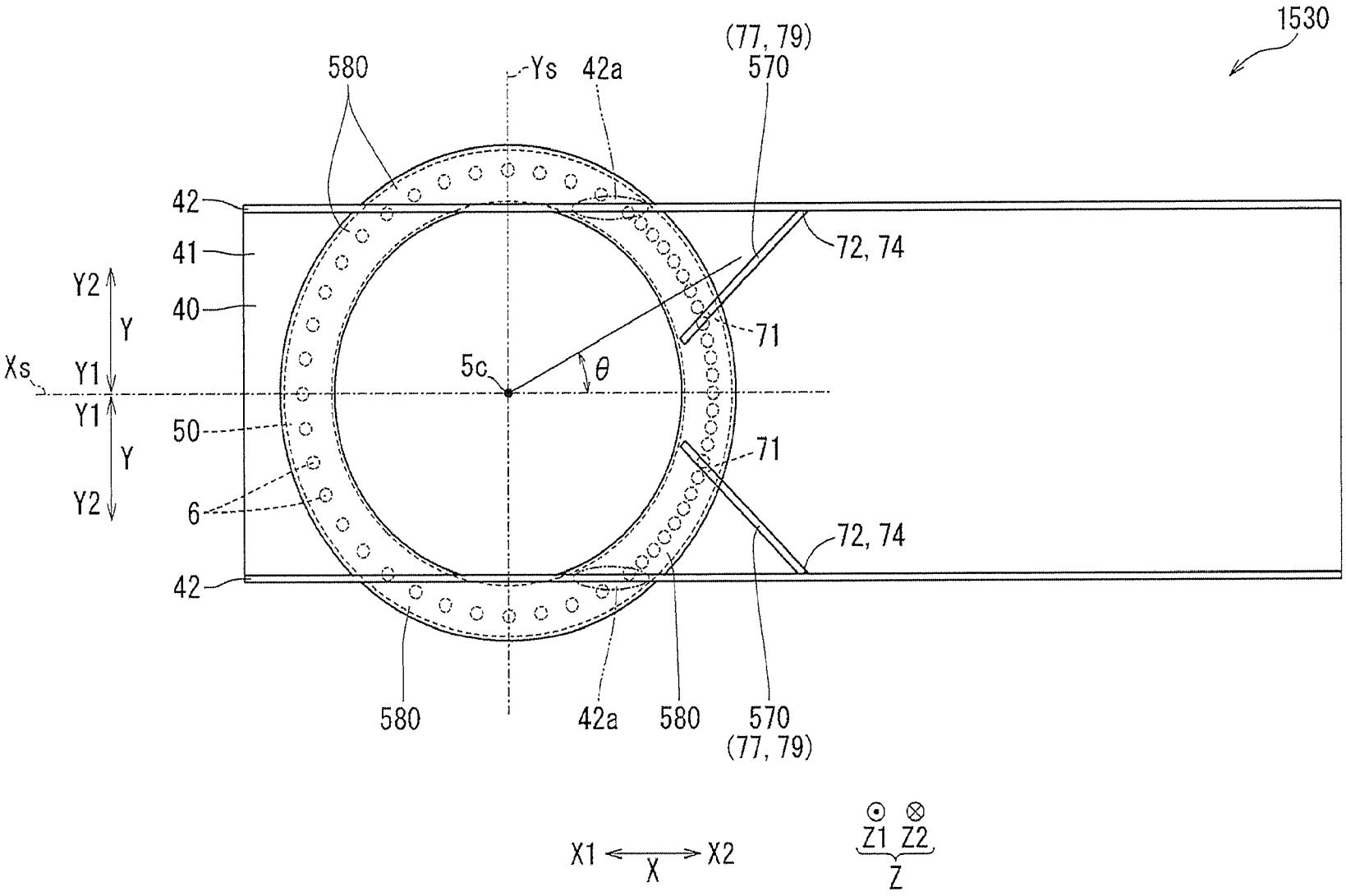
FIG. 61 is a view corresponding to FIG. 48 for a fifteenth embodiment.
Figure 62:
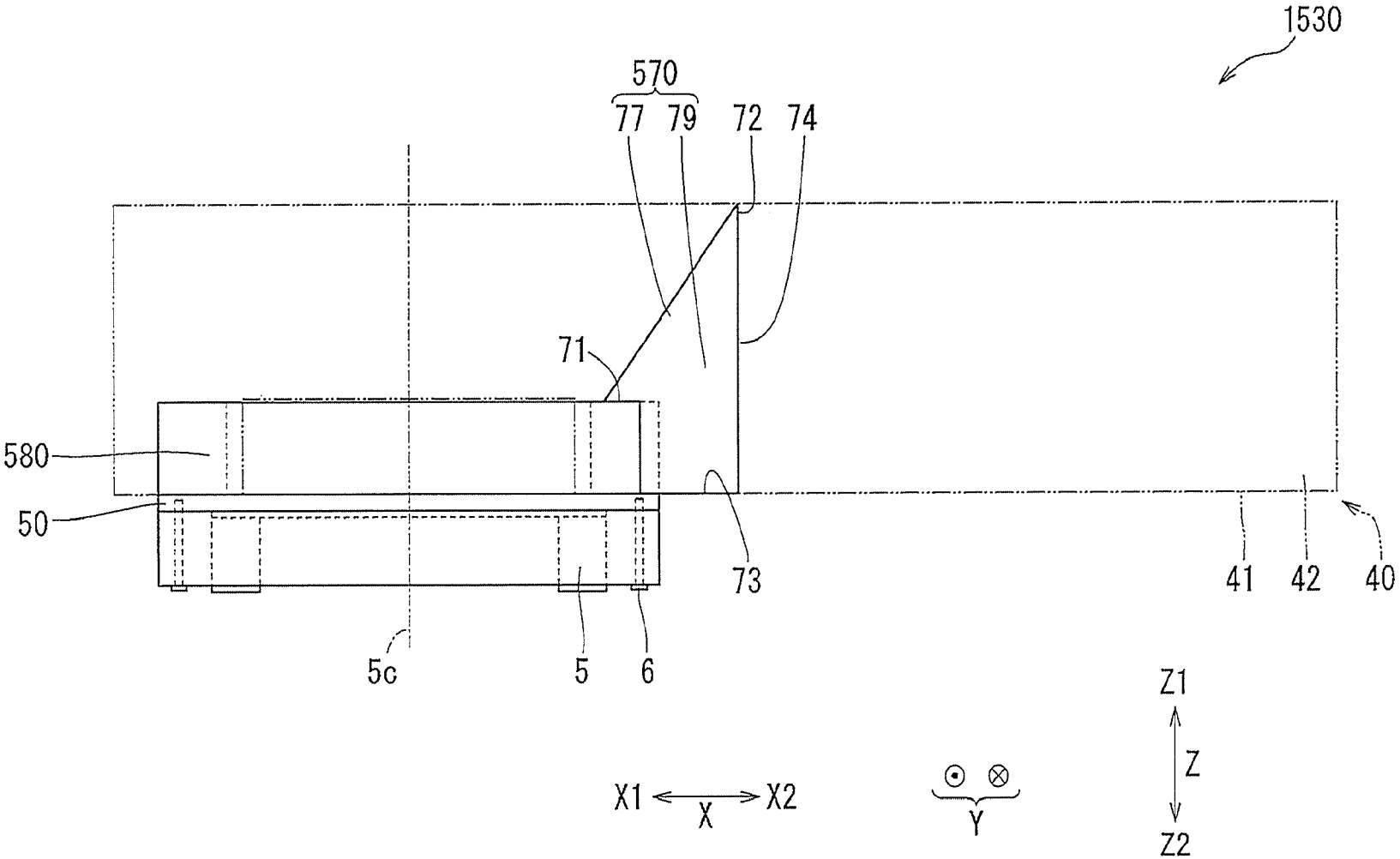
FIG. 62 is a view corresponding to FIG. 49 for the fifteenth embodiment.

Referring to FIG. 61 and FIG. 62, the difference of an upper body 1530 of the fifteenth embodiment from the eleventh embodiment will be described. The force dispersing member 760 (see FIG. 49) of the eleventh embodiment has been not provided in the connecting part of the first fixed part 71 and the bearing seat surface 50. However, a force dispersing member 580 of the fifteenth embodiment is arranged also in the connecting part of the first fixed part 71 and the bearing seat surface 50. The configuration of a reinforcing structure member 570 of the fifteenth embodiment differs with respect to the reinforcing structure member 70 (see FIG. 49) of the eleventh embodiment.

The reinforcing structure member 570 is fixed to the bearing seat surface 50 via the force dispersing member 580. The first fixed part 71 of the reinforcing structure member 570 is fixed to the force dispersing member 580. Specifically, as shown in FIG. 62, the first fixed part 71 of the reinforcing structure member 570 is fixed to the upper surface (surface on the upper side Z1) of the force dispersing member 580. The first fixed part 71 is arranged further toward the upper side Z1 than the bottom part 41 (than the third fixed part 73). The end part of the reinforcing structure member 570 on the lower side Z2 is formed along the step (step in the up-down direction Z) of the force dispersing member 580 with respect to the bottom part 41. For example, the reinforcing structure member 570 has a shape in which the vicinity of one angle is cut out from a triangular plate shape.

As shown in FIG. 61, the force dispersing member 580 is annular, seen from the up-down direction Z. The force dispersing member 580 is arranged along the bearing seat surface 50. In FIG. 61, the outer circumference and inner circumference of the force dispersing member 580 and the outer circumference and inner circumference of the bearing seat surface 50 are depicted with a displacement, so that the lines do not overlap. The displacement may be absent (or may be present). The force dispersing member 580 is arranged on the upper side Z1 of the bearing seat surface 50. The force dispersing member 760 (see FIG. 49) of the eleventh embodiment has been not arranged in the end part of the bearing seat surface 50 on the rear side X2 or the end part of the bearing seat surface 50 on the front side X1. The force dispersing member 580 of the fifteenth embodiment is arranged in the end part of the bearing seat surface 50 on the rear side X2 and the end part of the bearing seat surface 50 on the front side X1.

Modified Example

The respective embodiments described above can be modified in various ways. For example, parts of the components of the respective embodiments may be combined. For example, to the upper body 1130 including the reinforcing structure member 70 having a shape of a triangular plate in the eleventh embodiment shown in FIG. 49, the bar-shaped reinforcing structure member 270 of the twelfth embodiment shown in FIG. 55 may be further added. The reinforcing structure member 570 shown in FIG. 62 may be container-shaped as with the reinforcing structure member 370 of the thirteenth embodiment shown in FIG. 57.

The embodiments will be summarized herein.

An upper body of a mobile crane according to one aspect of the present invention is an upper body of a mobile crane that is fixed to a swing bearing by a bearing bolt and attached to a lower travelling body via the swing bearing, including: a bearing seat surface that is fixed to an upper surface of the swing bearing by the bearing bolt; a swing frame that includes an intersecting side plate intersecting the bearing seat surface when seen from an up-down direction and is fixed to the bearing seat surface; and a force dispersing member that is arranged between the intersecting side plate of the swing frame and the bearing seat surface and configured to allow a force transmitted to the bearing seat surface from the intersecting side plate to be dispersed into a plurality of routes. The bearing seat surface includes a force dispersion target region. The force dispersion target region includes a side-plate intersecting position, in which the bearing seat surface and the intersecting side plate intersect when seen from an up-down direction, and a position located in a vicinity of the side-plate intersecting position, further toward a rear side than a center of revolution of the swing bearing, and in a middle part of the bearing seat surface between two end parts of the bearing seat surface in a bearing radial direction, which is a radial direction of the swing bearing. The force dispersing member includes at least one vertical plate extending in an up-down direction. The at least one vertical plate is fixed to a region of the bearing seat surface other than the force dispersion target region.

In this upper body, since the vertical plate is fixed to the region other than the force dispersion target region among the bearing seat surface, the force is dispersed and transmitted from the intersecting side plate to a portion located on the outside of the force dispersion target region among the bearing seat surface, via the force dispersing member. Thus, a local increase, at the force dispersion target region, of the force transmitted to the bearing seat surface from the intersecting side plate is suppressed. Thus, the axial force on the bearing bolt in the force dispersion target region is reduced. Thus, increasing the plate thickness of the bearing seat surface is not necessary, and the maximum value of the axial force on the bearing bolt can be reduced. In the case where the lifting capacity or strength of the mobile crane is determined (governed) by the axial force on the bearing bolt, the lifting capacity or strength of the mobile crane can be improved by reducing the maximum value of the axial force on the bearing bolt.

Since the force dispersing member is fixed to the bearing seat surface, the second moment of area of the force dispersing member and the bearing seat surface increases, compared to a case where the force dispersing member is not fixed to the bearing seat surface. As a result, the stiffness of a lower-side portion of the swing frame in the vicinity of the bearing seat surface increases, and therefore deflection of the same portion can be reduced. Since the stiffness of the same portion increases, the stiffness (torsional stiffness) of the same portion with respect to torsional deformation can be improved. As a result, the torsional stiffness of the swing frame can be improved.

Specifically, the vertical plate is preferably fixed to the bearing seat surface along an edge part of the bearing seat surface.

Accordingly, a configuration in which the vertical plate is fixed to the region other than the force dispersion target region among the bearing seat surface can be realized reliably. The force dispersing member can be formed in a compact manner, compared to a case where the vertical plate is arranged in a position apart from the edge part.

It is preferable that the at least one vertical plate include an inside vertical plate arranged on an inside in the bearing radial direction and an outside vertical plate arranged on an outside in the bearing radial direction, the inside vertical plate and the outside vertical plate be connected at upper end parts thereof to each other in a posture inclined with respect to an up-down direction, and an upper end part of each of the inside vertical plate and the outside vertical plate be fixed to the intersecting side plate of the swing frame.

Accordingly, the force dispersing member can transmit the force to the bearing seat surface from the intersecting side plate, without causing the problem of bending in the upper plate.

It is preferable that the vertical plate include a seat-surface inside vertical plate arranged further toward an inner side in the bearing radial direction than the bearing seat surface, the seat-surface inside vertical plate include a cutout part, and the cutout part be formed at a vertical-plate intersecting position of the seat-surface inside vertical plate in which an extended line from the seat-surface inside vertical plate and an area of the bearing seat surface further toward a rear side than the center of revolution intersect when seen from an up-down direction.

Accordingly, the vertical plate is fixed reliably to the region other than the force dispersion target region of the bearing seat surface.

It is preferable that the force dispersing member further include a honeycomb part including a plurality of vertical-plate members each having a shape extending from an upper-side portion up to a lower-side portion of the vertical plate, and the honeycomb part be fixed to the force dispersion target region and include a plurality of hollow polygons in section when seen from an up-down direction.

Accordingly, the force is dispersed and transmitted from the intersecting side plate to the force dispersion target region via the plurality of vertical-plate members. Thus, a local increase, at the side-plate intersecting position or the like, of the force transmitted to the bearing seat surface from the intersecting side plate is suppressed. Thus, the maximum value of the axial force on the bearing bolt can be reduced, without increasing the plate thickness of the bearing seat surface.

Compared to a case where the honeycomb part is absent, the area of a fixed portion of the bearing seat surface and the force dispersing member in the force dispersion target region increases. Thus, the stress that occurs in the bearing seat surface is further dispersed, and therefore a local increase in the axial force on the bearing bolt is suppressed.

It is preferable that the swing frame include: a bottom part provided horizontally on the swing bearing; a pair of side plates each provided to stand on the bottom part with a predetermined interval in a left-right direction of the mobile crane and each arranged to be parallel to a front-back direction of the mobile crane; and a pair of reinforcing members attached to side surfaces of the respective side plates opposing each other in the left-right direction, and least one of the pair of side plates be the intersecting side plate, and each reinforcing member be inclined from a lower front toward an upper rear in the mobile crane and arranged further toward a rear side than to a center of revolution of the swing bearing.

Accordingly, the direction of attachment of the reinforcing member approximately matches the direction in which the compressive shear force acts, and therefore the buckling strength of the intersecting side plate with respect to the compressive shear force can be improved efficiently. By arranging the pair of reinforcing members further toward the rear side than the center of revolution of the swing bearing, the buckling strength of the intersecting side plate with respect to the compressive shear force can be improved efficiently. Accordingly, occurrence of buckling in the intersecting side plate can be suppressed while suppressing an increase in weight. By causing the direction of attachment of the reinforcing member to approximately match the direction in which the compressive shear force acts, the stiffness of the intersecting side plate with respect to shear deformation can be improved. As a result, the stiffness of the swing frame with respect to torsional deformation can be improved.

In an up-down direction of the mobile crane, each reinforcing member is preferably provided over an entire width of each side plate in the up-down direction.

Accordingly, the buckling strength with respect to the compressive shear force and the stiffness with respect to shear deformation can be improved over the entire width of each side plate in the up-down direction.

An inclination angle of each reinforcing member with respect to a horizontal direction is preferably greater than or equal to 45° and less than or equal to 60°.

Accordingly, the direction of attachment of the reinforcing member can be caused to approximately match the direction in which the compressive shear force acts. Accordingly, the buckling strength with respect to the compressive shear force and the stiffness with respect to shear deformation can be improved efficiently.

Each reinforcing member preferably includes a plate material arranged along a direction orthogonal to a side surface of each side plate.

Accordingly, by adjusting the width of the plate material in the left-right direction, the strength of the reinforcing member can be improved while suppressing an increase in weight due to the reinforcing member. Accordingly, the buckling strength with respect to the compressive shear force and the stiffness with respect to shear deformation can be improved efficiently.

It is preferable that, when seen in horizontal section, a closed space be formed between each of the respective reinforcing members and the respective side plates, or each reinforcing member be hollow in horizontal section.

Accordingly, the strength of the reinforcing member can be improved while suppressing an increase in weight due to the reinforcing member.

A lower end of each reinforcing member may be secured to the bottom part.

Accordingly, the stress that acts on the lower end of the reinforcing member can be dispersed to the bottom part. Accordingly, the strength of the reinforcing member can be improved.

Alternatively, it may be such that the bottom part is provided around the bearing seat surface, and a lower end of each reinforcing member is secured to the bearing seat surface.

Accordingly, the stress that acts on the lower end of the reinforcing member can be dispersed to the bottom part. Accordingly, the strength of the reinforcing member can be improved.

It is preferable that a reinforcing structure member that couples the intersecting side plate of the swing frame and the bearing seat surface be further provided, the reinforcing structure member including: a first fixed part fixed to the bearing seat surface; and a second fixed part fixed to the intersecting side plate, the first fixed part being fixed to the bearing seat surface at a position further toward a rear side than a center of revolution of the swing bearing and further toward an inner side in a left-right direction than the intersecting side plate, and the second fixed part being fixed to the intersecting side plate at a position further toward a rear side and an upper side than the first fixed part.

Accordingly, the force is transmitted from the intersecting side plate to a portion located at a position further toward the inner side in the left-right direction than the intersecting side plate among the bearing seat surface. Thus, a part of the force transmitted to the bearing seat surface from the intersecting side plate is carried by the bearing bolt in the vicinity of the first fixed part. Thus, the load carried by the bearing bolt in the side-plate intersecting position and the vicinity thereof can be reduced. Thus, increasing the plate thickness of the bearing seat surface is not necessary, and the maximum value of the axial force on the bearing bolt can be reduced.

A line segment connecting the end part of the first fixed part on the center-of-revolution side and the upper end part of the second fixed part is inclined with respect to the machine front-back direction and inclined with respect to the left-right direction. Thus, compared to a case where the line segment is parallel to the machine front-back direction or the left-right direction, the force is transmitted reliably to the first fixed part (bearing seat surface) from the second fixed part (intersecting side plate). As a result, the maximum value of the axial force on the bearing bolt can be reduced reliably.

It is preferable that the reinforcing structure member include an inclined part arranged along a straight line connecting an end part of the first fixed part on a side of the center of revolution and an upper end part of the second fixed part, this inclined part forming an edge part of the reinforcing structure member on an upper side.

Accordingly, even when the reinforcing structure member is compressed between an upper-side portion and the bottom part of the swing frame, occurrence of buckling in the reinforcing structure member is suppressed.

The inclined part preferably extends in a manner toward the center of revolution from the second fixed part when seen from an up-down direction.

Accordingly, the force is transmitted reliably from the intersecting side plate (second fixed part) to a portion (the first fixed part) located at a position further toward the inner side in the left-right direction than the intersecting side plate among the bearing seat surface, via the inclined part. As a result, the maximum value of the axial force on the bearing bolt can be reduced further reliably.

An inclination of the inclined part with respect to a horizontal direction when seen from a left-right direction is preferably greater than or equal to 20° and less than or equal to 80°.

Accordingly, the force is transmitted reliably from the intersecting side plate (second fixed part) to a portion (the first fixed part) located at a position further toward the lower side than the second fixed part among the bearing seat surface, via the inclined part. As a result, the maximum value of the axial force on the bearing bolt can be reduced further reliably.

The second fixed part is preferably fixed to an upper-side end part of the intersecting side plate.

Accordingly, the force is transmitted from the upper-side end part of the intersecting side plate to the bearing seat surface (first fixed part) via the reinforcing structure member. Thus, compared to a case where the force is transmitted to the first fixed part only from an area located further toward the lower side than the upper-side end part of the intersecting side plate, the force is transmitted more reliably to the first fixed part from the intersecting side plate (second fixed part). As a result, the maximum value of the axial force on the bearing bolt can be reduced further reliably.

The reinforcing structure member preferably further includes a third fixed part fixed to a bottom part of the swing frame.

Accordingly, the force is transmitted from the intersecting side plate (first fixed part) not only to the bearing seat surface (second fixed part) but also to the bottom part (third fixed part), via the reinforcing structure member. Thus, the force transmitted to the bearing seat surface from the intersecting side plate is reduced. As a result, the maximum value of the axial force on the bearing bolt can further be reduced.

Since the reinforcing structure member couples the intersecting side plate and the bottom part, the stiffness (torsional stiffness) of the swing frame with respect to torsional deformation can be improved.

The reinforcing structure member preferably includes a container-shaped part including a hollow portion.

Accordingly, the strength of the reinforcing structure member can be improved, compared to a case where the reinforcing structure member does not include the container-shaped part (case of a plate shape or the like). Since the container-shaped part is hollow, the reinforcing structure member can be made lightweight.

It is preferable that the reinforcing structure member include a honeycomb part provided from the first fixed part up to the second fixed part, and the honeycomb part include a plurality of hollow polygons in section when seen from a direction connecting the first fixed part and the second fixed part.

Accordingly, the area of a fixed portion of the reinforcing structure member and the bearing seat surface in the first fixed part increases by the amount of the honeycomb part arranged in the first fixed part. As a result, the stress on the bearing seat surface in the first fixed part and the vicinity thereof is dispersed. Thus, the axial force on the bearing bolt in the first fixed part and the vicinity thereof can be dispersed. The strength of the reinforcing structure member with respect to the force in the direction connecting first fixed part and the second fixed part can be improved.

The invention claimed is:

1. An upper body of a mobile crane that is fixed to a swing bearing by a bearing bolt and attached to a lower travelling body via the swing bearing, the upper body comprising:

a bearing seat surface that is fixed to an upper surface of the swing bearing by the bearing bolt;

a swing frame that includes a pair of intersecting side plates spaced from each other in a width direction of the upper body, each intersecting side plate comprising a plate defining a side of the swing frame and carrying the load of the swing frame, the side plate intersecting the bearing seat surface when seen from an up-down direction and being fixed to the bearing seat surface; and a force dispersing member that is arranged between the intersecting side plate of the swing frame and the bearing seat surface and configured to allow a force transmitted to the bearing seat surface from the intersecting side plate to be dispersed into a plurality of routes, the bearing seat surface including a force dispersion target region, the force dispersion target region including a side-plate intersecting position, in which the bearing seat surface and the intersecting side plate intersect when seen from an up-down direction, and a position located in a vicinity of the side-plate intersecting position, further toward a rear side than a center of revolution of the swing bearing, and in a middle part of the bearing seat surface between two end parts of the bearing seat surface in a bearing radial direction which is a radial direction of the swing bearing when seen from the up-down direction, the force dispersing member including at least one vertical plate extending in the up-down direction, and the at least one vertical plate being fixed to a region of the bearing seat surface other than the force dispersion target region when seen from the up-down direction.

2. The upper body of a mobile crane according to claim 1, wherein the vertical plate is fixed to the bearing seat surface along an edge part of the bearing seat surface.

3. An upper body of a mobile crane that is fixed to a swing bearing by a bearing bolt and attached to a lower travelling body via the swing bearing, the upper body comprising:

a bearing seat surface that is fixed to an upper surface of the swing bearing by the bearing bolt;

a swing frame that includes an intersecting side plate intersecting the bearing seat surface when seen from an up-down direction and is fixed to the bearing seat surface; and a force dispersing member that is arranged between the intersecting side plate of the swing frame and the bearing seat surface and configured to allow a force transmitted to the bearing seat surface from the intersecting side plate to be dispersed into a plurality of routes, the bearing seat surface including a force dispersion target region, the force dispersion target region including a side-plate intersecting position, in which the bearing seat surface and the intersecting side plate intersect when seen from an up-down direction, and a position located in a vicinity of the side-plate intersecting position, further toward a rear side than a center of revolution of the swing bearing, and in a middle part of the bearing seat surface between two end parts of the bearing seat surface in a bearing radial direction which is a radial direction of the swing bearing, the force dispersing member including at least one vertical plate extending in an up-down direction, and the at least one vertical plate being fixed to a region of the bearing seat surface other than the force dispersion target region, wherein the vertical plate is fixed to the bearing seat surface along an edge part of the bearing seat surface, wherein the at least one vertical plate includes an inside vertical plate arranged on an inside in the bearing radial direction and an outside vertical plate arranged on an outside in the bearing radial direction, the inside vertical plate and the outside vertical plate are connected at upper end parts thereof to each other in a posture inclined with respect to an up-down direction, and wherein an upper end part of each of the inside vertical plate and the outside vertical plate is fixed to the intersecting side plate of the swing frame.

4. An upper body of a mobile crane that is fixed to a swing bearing by a bearing bolt and attached to a lower travelling body via the swing bearing, the upper body comprising:

a bearing seat surface that is fixed to an upper surface of the swing bearing by the bearing bolt;

a swing frame that includes an intersecting side plate intersecting the bearing seat surface when seen from an up-down direction and is fixed to the bearing seat surface; and a force dispersing member that is arranged between the intersecting side plate of the swing frame and the bearing seat surface and configured to allow a force transmitted to the bearing seat surface from the intersecting side plate to be dispersed into a plurality of routes, the bearing seat surface including a force dispersion target region, the force dispersion target region including a side-plate intersecting position, in which the bearing seat surface and the intersecting side plate intersect when seen from an up-down direction, and a position located in a vicinity of the side-plate intersecting position, further toward a rear side than a center of revolution of the swing bearing, and in a middle part of the bearing seat surface between two end parts of the bearing seat surface in a bearing radial direction which is a radial direction of the swing bearing, the force dispersing member including at least one vertical plate extending in an up-down direction, and the at least one vertical plate being fixed to a region of the bearing seat surface other than the force dispersion target region, wherein the vertical plate includes a seat-surface inside vertical plate arranged further toward an inner side in the bearing radial direction than the bearing seat surface, the seat-surface inside vertical plate includes a cutout part, and wherein the cutout part is formed in a vertical-plate intersecting position of the seat-surface inside vertical plate in which an extended line from the seat-surface inside vertical plate and an area of the bearing seat surface further toward a rear side than the center of revolution intersect when seen from an up-down direction.

5. An upper body of a mobile crane that is fixed to a swing bearing by a bearing bolt and attached to a lower travelling body via the swing bearing, the upper body comprising:

a bearing seat surface that is fixed to an upper surface of the swing bearing by the bearing bolt;

a swing frame that includes an intersecting side plate intersecting the bearing seat surface when seen from an up-down direction and is fixed to the bearing seat surface; and a force dispersing member that is arranged between the intersecting side plate of the swing frame and the bearing seat surface and configured to allow a force transmitted to the bearing seat surface from the intersecting side plate to be dispersed into a plurality of routes, the bearing seat surface including a force dispersion target region, the force dispersion target region including a side-plate intersecting position, in which the bearing seat surface and the intersecting side plate intersect when seen from an up-down direction, and a position located in a vicinity of the side-plate intersecting position, further toward a rear side than a center of revolution of the swing bearing, and in a middle part of the bearing seat surface between two end parts of the bearing seat surface in a bearing radial direction which is a radial direction of the swing bearing, the force dispersing member including at least one vertical plate extending in an up-down direction, and the at least one vertical plate being fixed to a region of the bearing seat surface other than the force dispersion target region, wherein the force dispersing member further includes a honeycomb part including a plurality of vertical-plate members each having a shape extending from an upper-side portion up to a lower-side portion of the vertical plate, and the honeycomb part is fixed to the force dispersion target region and includes a plurality of hollow polygons in section when seen from an up-down direction.

6. An upper body of a mobile crane that is fixed to a swing bearing by a bearing bolt and attached to a lower travelling body via the swing bearing, the upper body comprising:

a bearing seat surface that is fixed to an upper surface of the swing bearing by the bearing bolt;

a swing frame that includes an intersecting side plate intersecting the bearing seat surface when seen from an up-down direction and is fixed to the bearing seat surface; and a force dispersing member that is arranged between the intersecting side plate of the swing frame and the bearing seat surface and configured to allow a force transmitted to the bearing seat surface from the intersecting side plate to be dispersed into a plurality of routes, the bearing seat surface including a force dispersion target region, the force dispersion target region including a side-plate intersecting position, in which the bearing seat surface and the intersecting side plate intersect when seen from an up-down direction, and a position located in a vicinity of the side-plate intersecting position, further toward a rear side than a center of revolution of the swing bearing, and in a middle part of the bearing seat surface between two end parts of the bearing seat surface in a bearing radial direction which is a radial direction of the swing bearing, the force dispersing member including at least one vertical plate extending in an up-down direction, and the at least one vertical plate being fixed to a region of the bearing seat surface other than the force dispersion target region, wherein the swing frame includes:

a bottom part provided horizontally on the swing bearing;

a pair of side plates each provided to stand on the bottom part with a predetermined interval in a left-right direction of the mobile crane and each arranged to be parallel to a front-back direction of the mobile crane; and a pair of reinforcing members attached to side surfaces of the respective side plates opposing each other in the left-right direction, at least one of the pair of side plates is the intersecting side plate, and wherein each reinforcing member is inclined from a lower front toward an upper rear in the mobile crane and arranged further toward a rear side than a center of revolution of the swing bearing.

7. The upper body of a mobile crane according to claim 6, wherein, in an up-down direction of the mobile crane, each reinforcing member is provided over an entire width of each side plate in the up-down direction.

8. The upper body of a mobile crane according to claim 6, wherein an inclination angle of each reinforcing member with respect to a horizontal direction is greater than or equal to 45° and less than or equal to 60°.

9. The upper body of a mobile crane according to claim 6, wherein each reinforcing member includes a plate material arranged along a direction orthogonal to a side surface of each side plate.

10. The upper body of a mobile crane according to claim 6, wherein, when seen in horizontal section, a closed space is formed between each of the respective reinforcing members and the respective side plates.

11. The upper body of a mobile crane according to claim 6, wherein each reinforcing member is hollow in horizontal section.

12. The upper body of a mobile crane according to claim 6, wherein a lower end of each reinforcing member is secured to the bottom part.

13. The upper body of a mobile crane according to claim 6, wherein the bottom part is provided around the bearing seat surface, and a lower end of each reinforcing member is secured to the bearing seat surface.

14. An upper body of a mobile crane that is fixed to a swing bearing by a bearing bolt and attached to a lower travelling body via the swing bearing, the upper body comprising:

a bearing seat surface that is fixed to an upper surface of the swing bearing by the bearing bolt;

a swing frame that includes an intersecting side plate intersecting the bearing seat surface when seen from an up-down direction and is fixed to the bearing seat surface; and a force dispersing member that is arranged between the intersecting side plate of the swing frame and the bearing seat surface and configured to allow a force transmitted to the bearing seat surface from the intersecting side plate to be dispersed into a plurality of routes, the bearing seat surface including a force dispersion target region, the force dispersion target region including a side-plate intersecting position, in which the bearing seat surface and the intersecting side plate intersect when seen from an up-down direction, and a position located in a vicinity of the side-plate intersecting position, further toward a rear side than a center of revolution of the swing bearing, and in a middle part of the bearing seat surface between two end parts of the bearing seat surface in a bearing radial direction which is a radial direction of the swing bearing, the force dispersing member including at least one vertical plate extending in an up-down direction, the at least one vertical plate being fixed to a region of the bearing seat surface other than the force dispersion target region, a reinforcing structure member that couples the intersecting side plate of the swing frame and the bearing seat surface, the reinforcing structure member including:

a first fixed part fixed to the bearing seat surface, and a second fixed part fixed to the intersecting side plate, the first fixed part being fixed to the bearing seat surface at a position further toward a rear side than a center of revolution of the swing bearing and further toward an inner side in a left-right direction than the intersecting side plate, and the second fixed part being fixed to the intersecting side plate at a position further toward a rear side and an upper side than the first fixed part.

15. The upper body of a mobile crane according to claim 14, wherein the reinforcing structure member includes an inclined part arranged along a straight line connecting an end part of the first fixed part on a side of the center of revolution and an upper end part of the second fixed part, this inclined part forming an edge part of the reinforcing structure member on an upper side.

16. The upper body of a mobile crane according to claim 15, wherein the inclined part extends in a manner toward the center of revolution from the second fixed part when seen from an up-down direction.

17. The upper body of a mobile crane according to claim 15, wherein an inclination of the inclined part with respect to a horizontal direction when seen from a left-right direction is greater than or equal to 20° and less than or equal to 80°.

18. The upper body of a mobile crane according to claim 14, wherein the second fixed part is fixed to an upper-side end part of the intersecting side plate.

19. The upper body of a mobile crane according to claim 14, wherein the reinforcing structure member further includes a third fixed part fixed to a bottom part of the swing frame.

20. The upper body of a mobile crane according to claim 14, wherein the reinforcing structure member includes a container-shaped part including a hollow portion.

21. The upper body of a mobile crane according to claim 14, wherein the reinforcing structure member includes a honeycomb part provided from the first fixed part up to the second fixed part, and the honeycomb part includes a plurality of hollow polygons in section when seen from a direction connecting the first fixed part and the second fixed part.

* * * * *